US006495058B1

(12) United States Patent
Frankenbach et al.

(10) Patent No.: US 6,495,058 B1
(45) **Date of Patent: *Dec. 17, 2002**

(54) AQUEOUS WRINKLE CONTROL COMPOSITIONS DISPENSED USING OPTIMAL SPRAY PATTERNS

(75) Inventors: Gayle Marie Frankenbach, Cincinnati, OH (US); Anne Marie Candido, Mason, OH (US); John Henry Shaw, Jr., Cincinnati, OH (US); Gabrielle Holly (Spangler) Detzel, Cincinnati, OH (US); Stephan Gary Bush, Sharonville, OH (US); Todd Stephen Alwart, Cincinnati, OH (US); Dimitris Ioannis Collias, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/610,561

(22) Filed: Jul. 5, 2000

Related U.S. Application Data

(60) Provisional application No. 60/182,386, filed on Feb. 14, 2000.

(51) Int. Cl.[7] ..... D06M 23/00; D06M 13/00; D06M 15/00

(52) U.S. Cl. ..... 252/8.91; 38/144; 252/8.61; 427/370; 427/393.2

(58) Field of Search ..... 252/8.61, 8.91; 38/144; 427/370, 393.2

(56) References Cited

U.S. PATENT DOCUMENTS

| | | | | |
|---|---|---|---|---|
| 3,674,688 | A | | 7/1972 | Schwartz et al. |
| 3,965,014 | A | | 6/1976 | Giordano et al. |
| 4,085,243 | A | | 4/1978 | Giordano et al. |
| 4,565,647 | A | | 1/1986 | Llenado |
| 4,661,268 | A | | 4/1987 | Jacobson et al. |
| 4,780,499 | A | | 10/1988 | Villarreal et al. |
| 4,806,254 | A | | 2/1989 | Church |
| 4,818,242 | A | | 4/1989 | Burmeister et al. |
| 4,851,140 | A | | 7/1989 | Nuesslein et al. |
| 4,857,212 | A | | 8/1989 | Ona et al. |
| 4,923,623 | A | | 5/1990 | Coffindaffer |
| 5,021,264 | A | | 6/1991 | Kästele et al. |
| 5,042,986 | A | | 8/1991 | Kitchens et al. |
| 5,062,971 | A | | 11/1991 | Coffindaffer et al. |
| 5,064,543 | A | | 11/1991 | Coffindaffer et al. |
| 5,100,566 | A | | 3/1992 | Agbomeirele et al. |
| 5,346,725 | A | | 9/1994 | Targosz |
| 5,520,827 | A | | 5/1996 | Danner |
| 5,532,023 | A | * | 7/1996 | Vogel et al. ..... 427/8 |
| 5,573,694 | A | | 11/1996 | Danner |
| 5,573,695 | A | | 11/1996 | Targosz |
| 5,645,751 | A | | 7/1997 | Haley |
| 5,695,677 | A | | 12/1997 | Silvester et al. |
| 5,798,107 | A | * | 8/1998 | Vogel et al. ..... 424/400 |
| 5,824,814 | A | | 10/1998 | Cray et al. |
| 5,851,431 | A | | 12/1998 | Ishikawa et al. |
| 5,965,514 | A | | 10/1999 | Mooney |
| 5,968,404 | A | * | 10/1999 | Trinh et al. ..... 252/8.91 |
| 6,001,343 | A | | 12/1999 | Trinh et al. |
| 6,013,683 | A | | 1/2000 | Hill et al. |

FOREIGN PATENT DOCUMENTS

| | | |
|---|---|---|
| EP | 0190839 A2 | 8/1986 |
| GB | 1312247 | 7/1970 |
| JP | 01168967 | 7/1989 |
| JP | 01260064 | 10/1989 |
| JP | 01292184 | 11/1989 |
| JP | 02112477 | 4/1990 |
| JP | 05239774 | 9/1993 |
| JP | 07119044 | 5/1995 |
| JP | 08246350 | 9/1996 |
| JP | 08246351 | 9/1996 |
| JP | 09105077 | 4/1997 |
| JP | 09209274 | 8/1997 |
| JP | 09241973 | 9/1997 |
| JP | 10046471 | 2/1998 |
| JP | 10072778 | 3/1998 |
| JP | 10110386 | 4/1998 |
| JP | 99/55951 | 11/1999 |
| JP | 99/55953 | 11/1999 |
| WO | 96/15309 | 5/1996 |
| WO | 99/55948 | 11/1999 |
| WO | 99/55949 | 11/1999 |
| WO | 99/55950 | 11/1999 |
| WO | 99/55952 | 11/1999 |
| WO | 00/08127 | 2/2000 |
| WO | 00/24853 | 5/2000 |
| WO | 00/24857 | 5/2000 |
| WO | 00/27991 | 5/2000 |

* cited by examiner

*Primary Examiner*—Anthony J. Green
(74) *Attorney, Agent, or Firm*—Jason J. Camp; Kim William Zerby; Steven W. Miller

(57) ABSTRACT

The present invention relates to selecting dispensers having optimal spray patterns for use together with aqueous wrinkle removal and/or reduction compositions to minimize the potential to stain fabrics and significantly reduce drying time associated with aqueous-based wrinkle control compositions. The present invention also relates to wrinkle control compositions suitable for use in dispensers with optimal spray patterns and articles of use including instructions for use. The present invention also relates to methods of use for wrinkle control compositions in dispensers with optimal spray patterns.

41 Claims, 8 Drawing Sheets

AQUEOUS WRINKLE CONTROL COMPOSITIONS DISPENSED USING OPTIMAL SPRAY PATTERNS

CROSS REFERENCE TO RELATED APPLICATION

This application claims the benefit of U.S. Provisional Application No. 60/182,386, filed on Feb. 14, 2000.

TECHNICAL FIELD

The present invention relates to utilizing dispensers with optimal spray patterns for reducing staining and the drying time associated with aqueous wrinkle spray compositions. The present invention also relates to aqueous compositions suitable for use in such sprayers, articles of manufacture optionally including a set of instructions and a method of use for removing and/or reducing wrinkles using optimal sprayers and wrinkle removing compositions

BACKGROUND OF THE INVENTION

Wrinkles in textile fabrics are caused by the bending and creasing of the textile material which places an external portion of a filament in a yarn under tension while the internal portion of that filament in the yam is placed under compression. Particularly with cotton fabrics, the hydrogen bonding that occurs between the cellulose molecules contributes to keeping wrinkles in place. The wrinkling of fabric, in particular clothing and certain household fabrics, is therefore subject to the inherent tensional elastic deformation and recovery properties of the fibers which constitute the yarn and fabrics.

In the modem world, with the increase of hustle and bustle and travel, there is a demand for a quick fix which will help to diminish the labor involved in home laundering and/or the cost and time involved in dry cleaning or commercial laundering. This has brought additional pressure to bear on textile technologists to produce a product that will sufficiently reduce wrinkles in fabrics, especially clothing and household fabrics, and to produce a good appearance through a simple, convenient application of a product.

To further enhance the convenience of such a product, the product should not have a tendency to stain fabrics or this will detract from acceptability of the product and the aspect of convenience. Low dry time is also essential to the convenience of the product. If dry time, is too long consumers tend not to use the product to full advantage. When a wrinkle control product has long dry time, consumers must plan ahead to choose what they will wear and treat the article of clothing well in advance of when they plan to wear it. With a short dry time, consumers can choose what they will wear at a convenient time e.g. when they perform their grooming ritual for the day. The garment can be treated and worn after a short drying time, such as for instance, after the time it would take a consumer to shower. Short dry times are also convenient for wrinkle control products that are taken on trips. Typically, consumers do not have a lot of space or time to dry clothes when traveling, so short dry times are especially important for wrinkle control products to be taken on trips.

In prior art, staining and dry time are generally controlled by maintaining a low level of non-aqueous, non-volatile components in the formulation or controlling the structure of such compounds (U.S. Pat. No. 4,661,268, Jacobson, J. A., et al., U.S. Pat. No. 5,573,695, Targosz, E. F.). It is not always desirable to control staining and dry time by limiting the composition, because this limits the performance as well. Many surfactants, especially a preferred silicone surfactant can contribute to softness and wrinkle release. Optional fabric care polysaccharides can provide enhanced wrinkle performance, reduction and prevention of fabric damage, and give fabrics body.

The prior art cites small particles sizes (typically less than 100 micron) and 'fine' mists as ways to control staining and reducing dry time (U.S. Pat. No. 3,674,688, Schwart, L.; et al, U.S. Pat. No. 4,661,268, Jacobson, J. A. et al., U.S. Pat. No. 4,806,254, Church, J. A.; U.S. Pat. No. 5,573,695, Targosz, E. F.). Surprisingly, it is discovered that dispensers that generate similar size particles of sizes less than 100 microns with finely divided particles and generating 'fine' mists can have very significant differences in their tendencies to stain and in their dry times. Surprisingly, it is found that staining and dry times are both minimized by controlling the uniformity of distribution on the fabric. Not to be bound by theory, but some sprayers with particle sizes about or below about 100 microns and producing 'fine' mists also deposit a high volume of produce in a small surface area and this is generally termed a 'hot spot'. Some prior art is cited that does imply that uniform distribution is important for wrinkle control sprays (U.S. Pat. No. 5,708,107 and U.S. Pat. No. 5,532,023, both by Vogel, A. M., et al.). This art relates to the combination of silicone and film-forming polymer to provide wrinkle contol.

It is suprisingly found in the present invention that water alone provides acceptable wrinkle control benefits and that even for water alone, uniform distribution is important for reducing dry time. It is found for the present invention that limiting the volume deposited per unit of surface area and the standard deviation in volume per unit of surface area will significantly minimize staining and reduce dry time of such compositions.

SUMMARY OF THE INVENTION

The present invention relates to selecting dispensers with acceptable spray patterns for use with wrinkle control compositions to minimize staining and reduce drying time. The present invention also relates to wrinkle control compositions for use in said dispensers, articles of manufacture together with an optional set of instructions for using said wrinkle control compositions in said dispensers and methods of using said wrinkle control compositions in said dispensers.

Dispensers that are useful in the present invention produce a spray that provides uniform distribution on the surface which can be described by the parameters of volume dispensed per unit of surface area and the standard deviation in the volume dispensed per unit of surface area as follows: volume per unit surface area of less than about 0.07 ml/inch$^2$ (0.011 ml/cm$^2$); preferably less than about 0.05 ml/inch$^2$ (0.0078 ml/cm$^2$); more preferably less than about 0.035 ml/inch$^2$ (0.0054 ml/cm$^2$); even more preferably less than about 0.025 ml/inch$^2$ (0.0039 ml/cm$^2$); and most preferably less than about 0.02 ml/inch$^2$ (0.0031 ml/cm$^2$); with a standard deviation in the volume per unit surface area of less than about 0.056 ml/inch$^2$ (0.0087 ml/cm$^2$); preferably less than about 0.05 ml/inch$^2$ (0.0078 ml/cm$^2$); more preferably less than about 0.03 ml/inch$^2$ (0.0047 ml/cm$^2$); even more preferably less than about 0.022 ml/inch$^2$ (0.0034 ml/cm$^2$); still more preferably less than about 0.02 ml/inch$^2$ (0.0031 ml/cm$^2$); most preferably less than about 0.018 ml/inch$^2$ (0.0028 ml/cm$^2$).

The compositions suitable for the present invention should have acceptable levels of extensional viscosity. Not to be bound by theory, it is believed that to distribute the product well from a dispenser, the product must be able to form distinct small droplets and adequate-size spray pattern. Both spray characteristics, i.e., droplet size distribution and spray pattern, depend strongly on the extensional viscosity of the product, and to a lesser extent on shear viscosity, density and surface tension. The effect of product density on the spray characteristics is minimal since for most products the density varies only slightly (e.g. between 0.8 and 1.2 $g/cm^3$). On the other hand, the surface tension of the product affects the droplet size distribution (i.e., higher surface tension causes formation of larger droplets), but not the size of the spray pattern for pressure swirl atomizers. Finally, as the shear viscosity increases the size of the droplets increases, and in pressure swirl atomizers the spray pattern decreases. The extensional viscosity of the product is typically denoted as the Trouton ratio, which is the ratio of the extensional viscosity to the shear viscosity. The Trouton ratio of Newtonian fluids is constant and equal to 3 (e.g. water and glycerin; regardless of the extensional and shear rates), whereas that of solutions of flexible polymers is much greater than 3 (e.g. polyacrylamide; dependent on the extensional and shear rates). The Trouton ratio of solutions of rigid polymers (e.g. xanthan; dependent on the extensional and shear rates) is typically less than that of the solutions of flexible polymers. Acceptable compositions should have a Trouton ratio of less than about 10,000 at extensional rates of less than 20,000 $s^{-1}$ and comprise:

(A) Aqueous base comprising water which can be deionized, distilled or tap water. The level of water in the composition can be as high as about 100% of the composition, but is preferably lower than about 100%, more preferably lower than about 99.975%, even more preferably lower than about 99.9%, still more preferably lower than about 99.5%, and higher than about 40%, preferably higher than about 50%, more preferably higher than about 60%, even more preferably higher than about 70%, still more preferably higher than about 75% by weight of the usage composition.

The compostion may optionally comprise:

(B) optionally, to reduce surface tension, an effective amount of surfactant;

(C) optionally, a solvent and/or plasticizer;

(D) optionally, but preferably, an effective amount to absorb malodor, of an odor control agent;

(E) optionally, to enhance wrinkle control and other fabric benefits, an effective amount of fabric care polysaccharide chosen from the group of primary fabric care polysaccharide, adjunct fabric care oligosacchride, and starch;

(F) optionally, but preferably, an effective amount to provide olfactory effects of perfume;

(G) optionally, an effective amount, to kill, or reduce the growth of microbes, of antimicrobial active;

(H) optionally, an effective amount to provide improved antimicrobial action for, e.g., the antimicrobial active, of aminocarboxylate chelator;

(I) optionally, an effective amount of solubilized, water-soluble, antimicrobial preservative, especially when said antimicrobial active is not sufficient to act as a preservative;

(J) optionally, other ingredients such as adjunct odor-controlling materials, chelating agents, additional anti-static agents if more static control is desired, insect and moth repelling agents, colorants, viscosity control agents; anti-clogging agents; agents for pH adjustment; buffers; whiteness preservative; and (K) mixtures of optional components (A) through (J).

The present wrinkle control compositions are prefereably esentially free of any material that would soil or stain fabric under usage conditions, or preferably essentially free of materials at a level that would soil or stain fabrics unacceptably under usage conditions. The present invention also relates to concentrated compositions, including liquid, fluid and solid forms of concentrated compositions which are diluted to form compositions with the usage concentrations for use under usage conditions. It is preferred that the concentrated compositions be delivered in forms that rapidly and smoothly dissolve or disperse to the usage concentration.

The present invention also relates to articles of manufacture comprising the present compositions incorporated into a container, such as a spray dispenser, that can facilitate treatment of articles and/or surfaces with said compositions containing a wrinkle control agent and other optional ingredients at a level that is effective, yet is not discernible when dried on the surfaces. The dispenser comprises manually activated and non-manual powered (operated) spray means and a container containing the wrinkle controlling composition.

The present article of manufacture can further comprise a set of instructions to communicate methods of using the present compositions to the consumer.

DETAILED DESCRIPTION OF THE INVENTION

1. Wrinkle Control Composition

Figure 1:
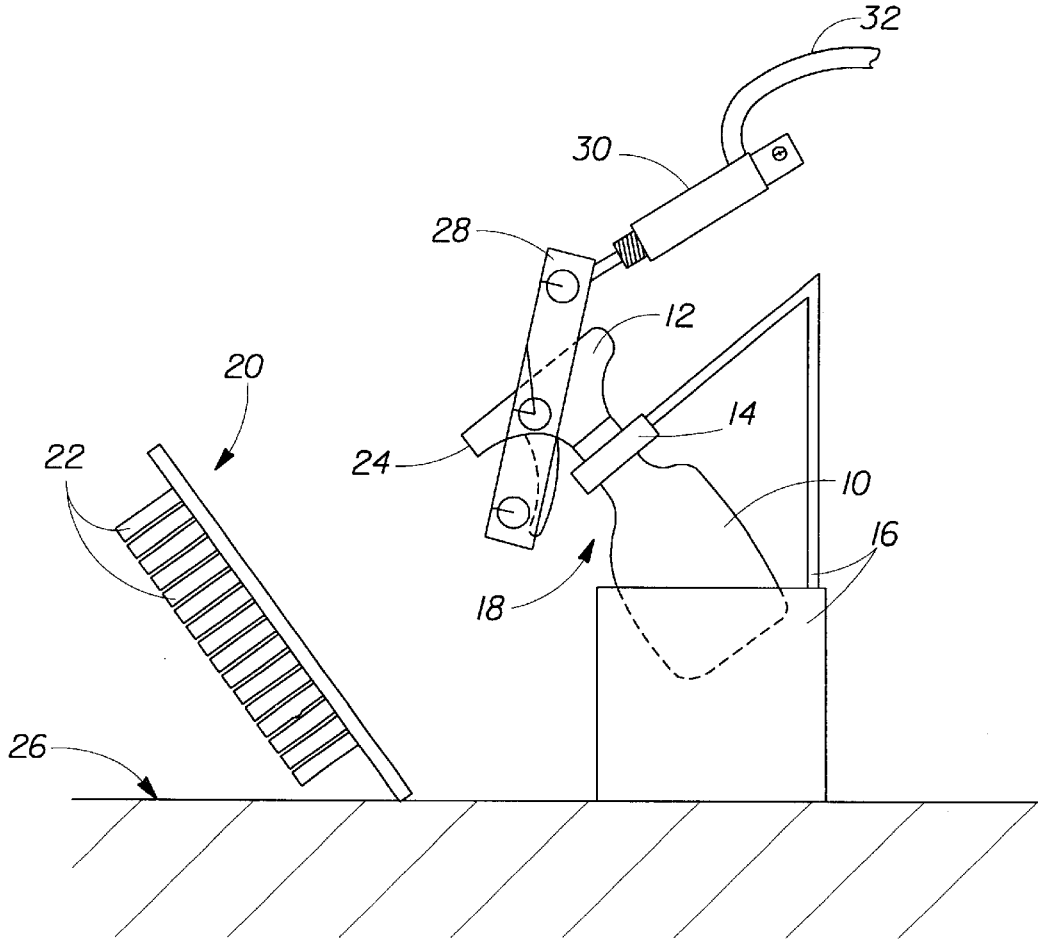
FIG. 1 is a schematic view of an apparatus for conducting the Patternator Test method described hereinafter in Section V.A.
Figure 2:
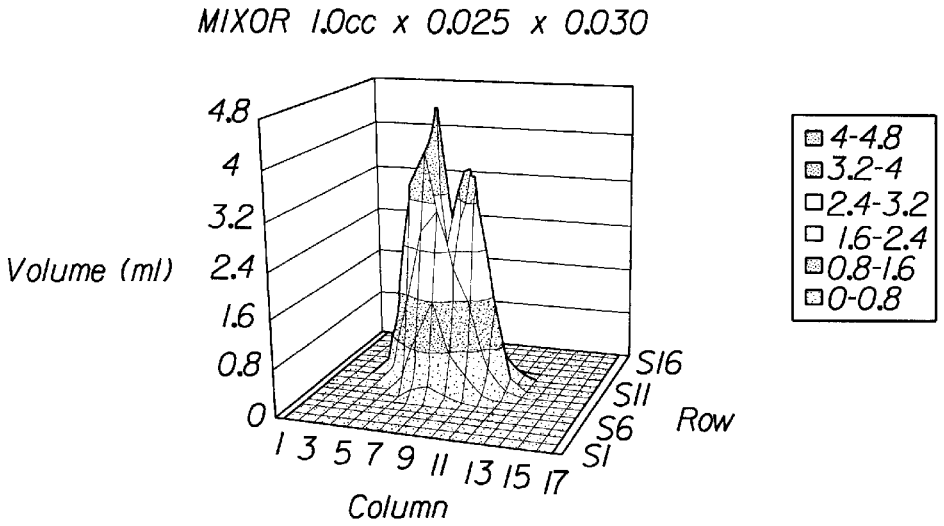
FIG. 2 is a three dimensional graph illustrating the spray pattern of a Mixor sprayer from Calmar.
Figure 3:
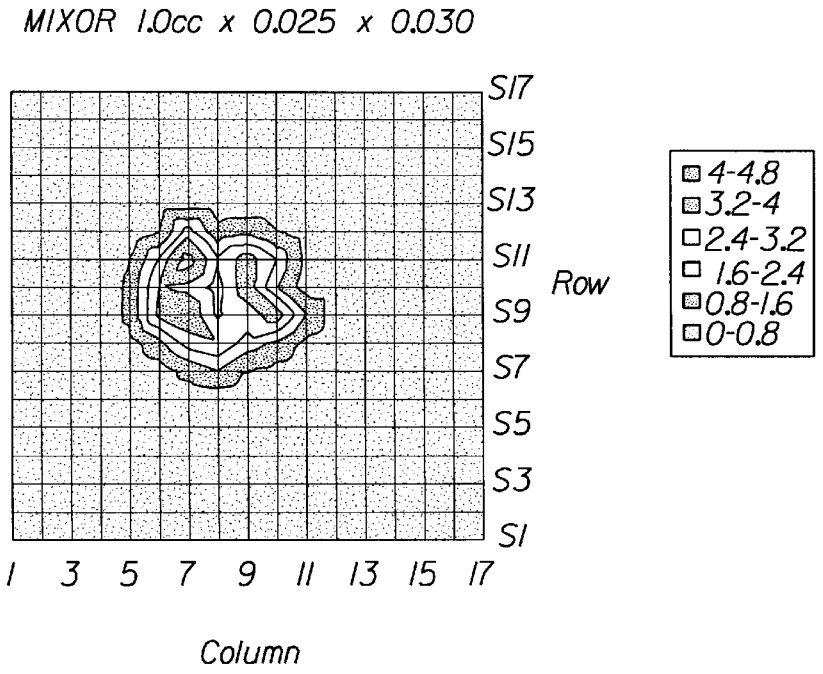
FIG. 3 is a cross sectional view of the three dimensional graph in FIG. 2.
Figure 4:
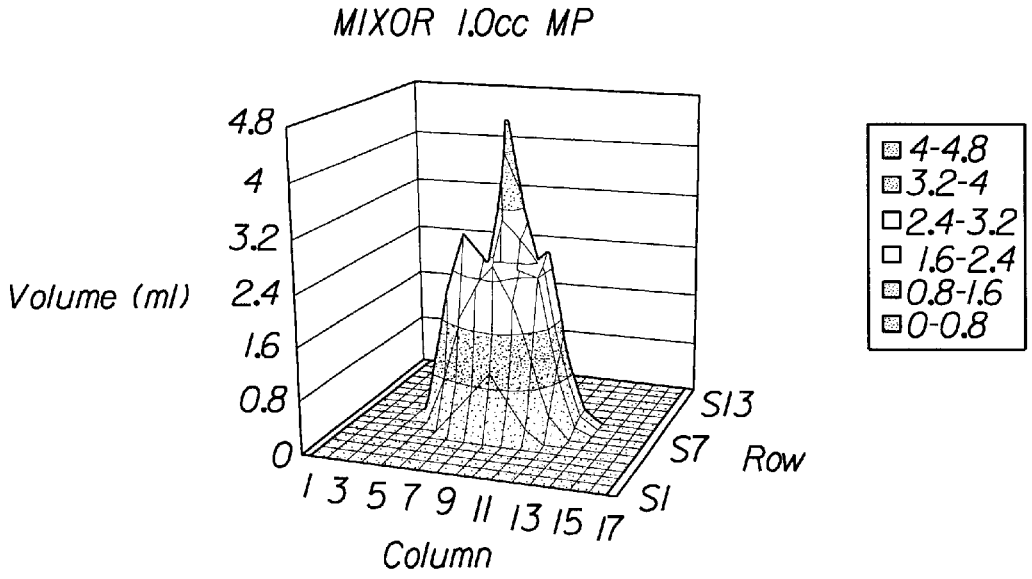
FIG. 4 is a three dimensional graph illustrating the spray pattern of a Mixor sprayer from Calmar.
Figure 5:
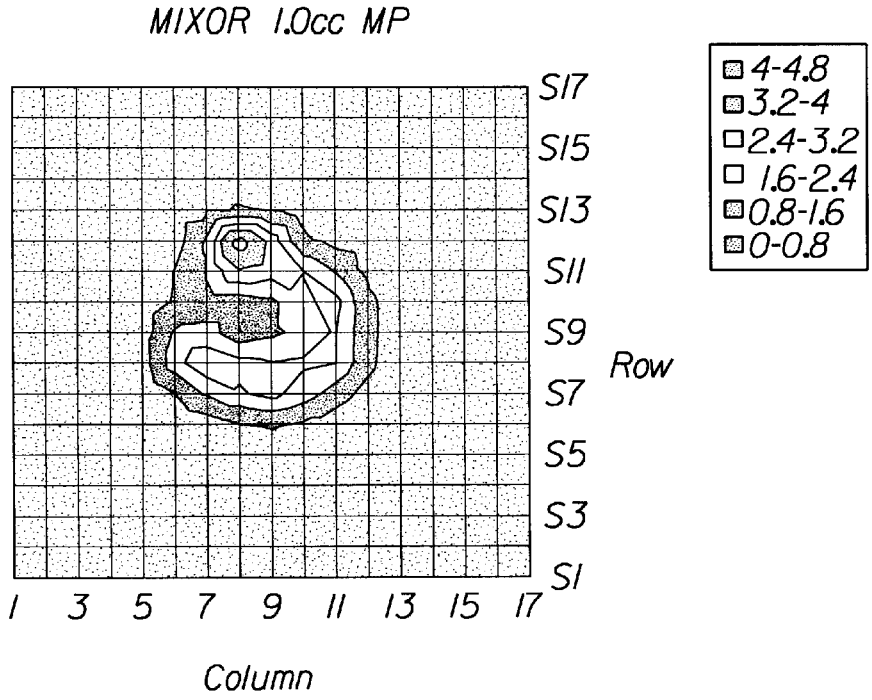
FIG. 5 is a cross sectional view of the three dimensional graph in FIG. 4.
Figure 6:
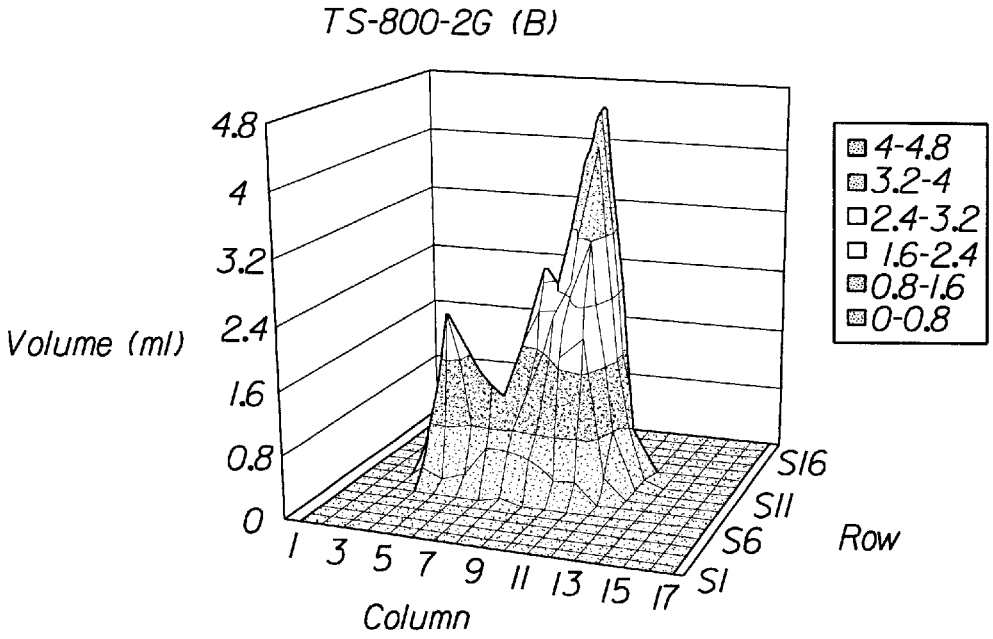
FIG. 6 is a three dimensional graph illustrating the spray pattern of the TS-800G sprayer from Calmar.
Figure 7:
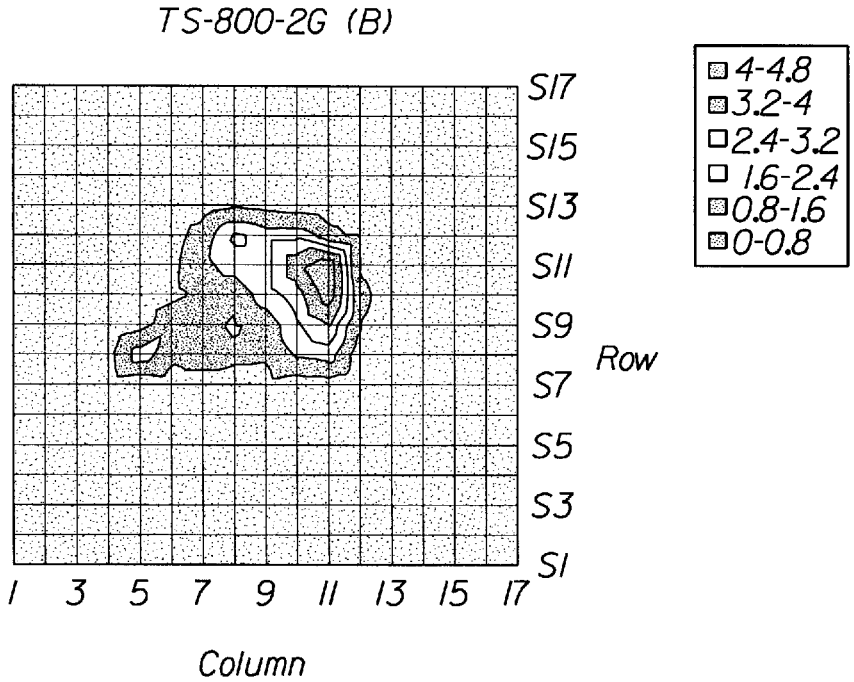
FIG. 7 is a cross sectional view of the three dimensional graph in FIG. 6.
Figure 8:
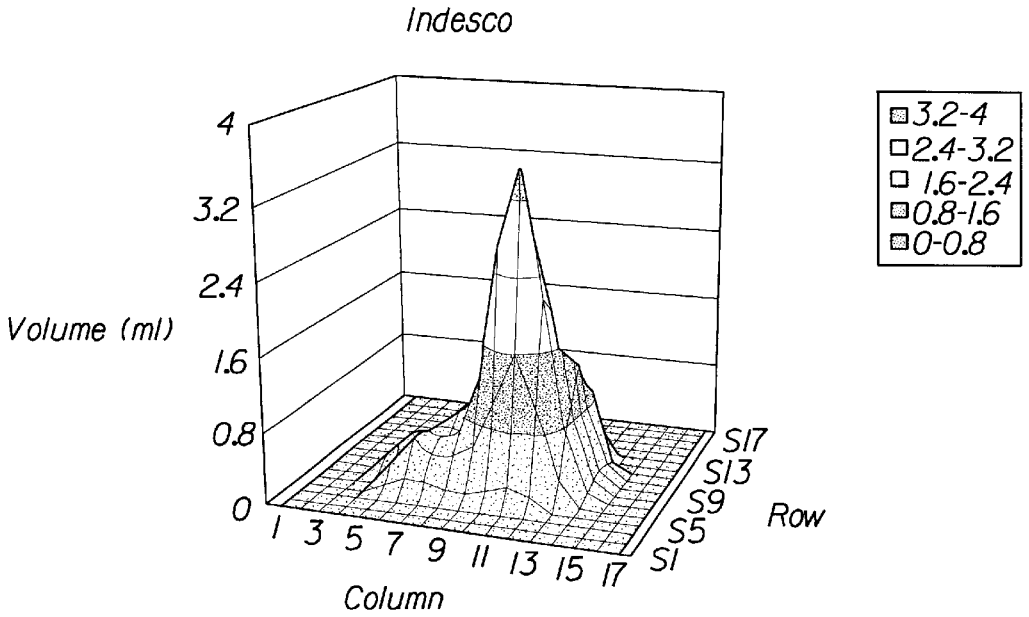
FIG. 8 is a three dimensional graph illustrating the spray pattern of a Indesco sprayer from Calmar.
Figure 9:
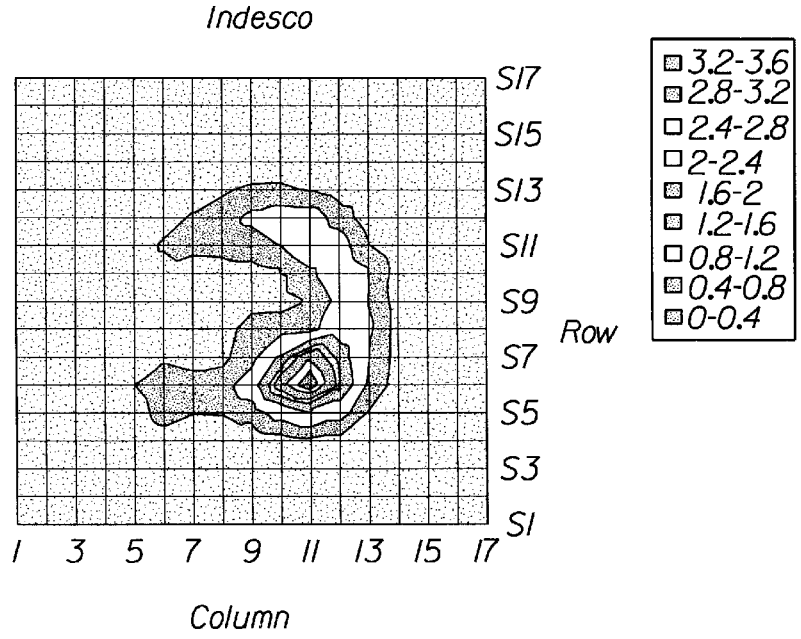
FIG. 9 is a cross sectional view of the three dimensional graph in FIG. 8.
Figure 10:
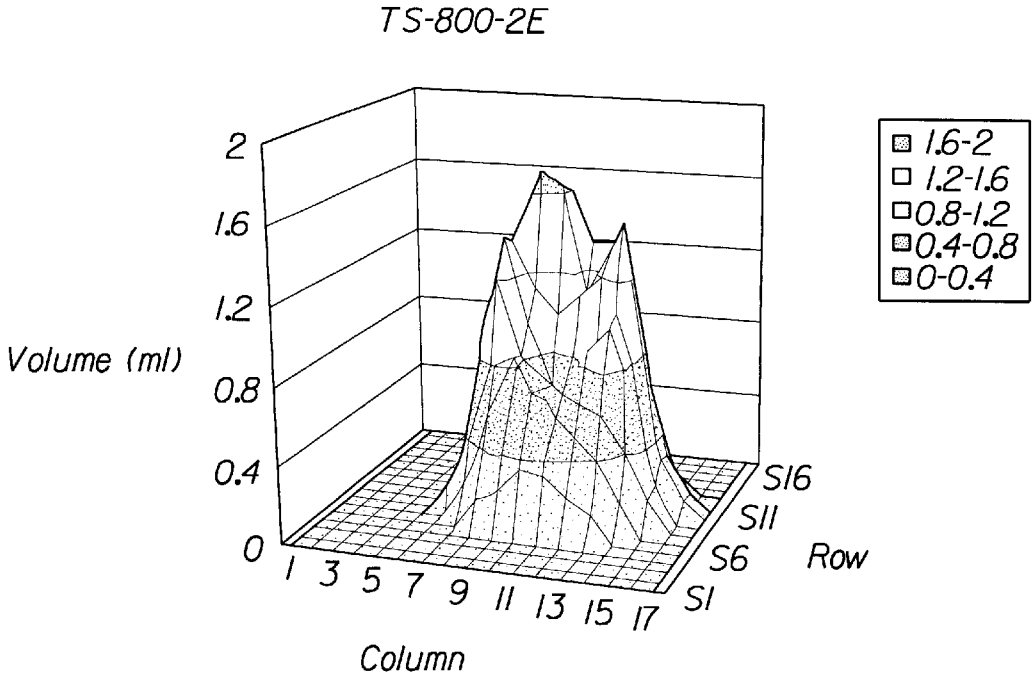
FIG. 10 is a three dimensional graph illustrating the spray pattern of a TS-8002E sprayer from Calmar.
Figure 11:
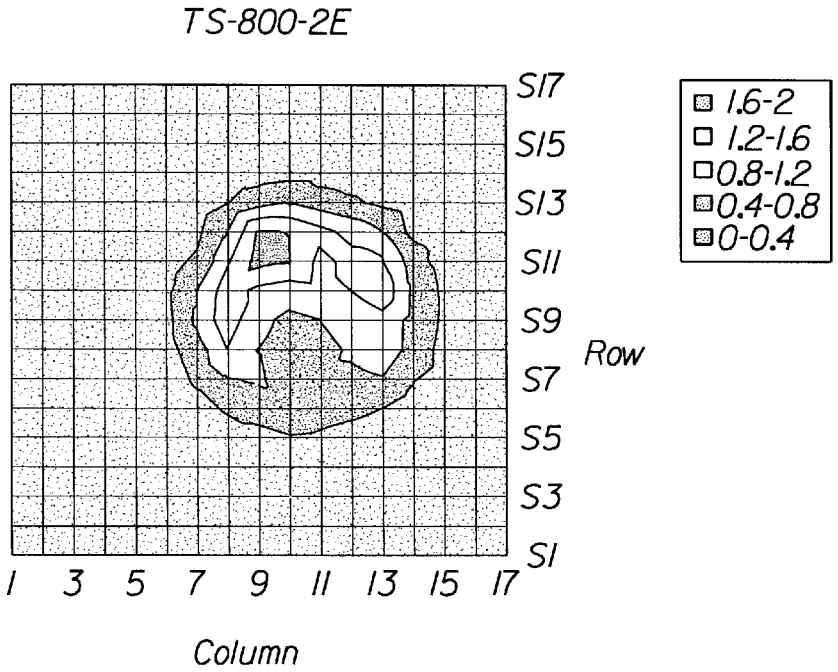
FIG. 11 is a cross sectional view of the three dimensional graph in FIG. 10.
Figure 12:
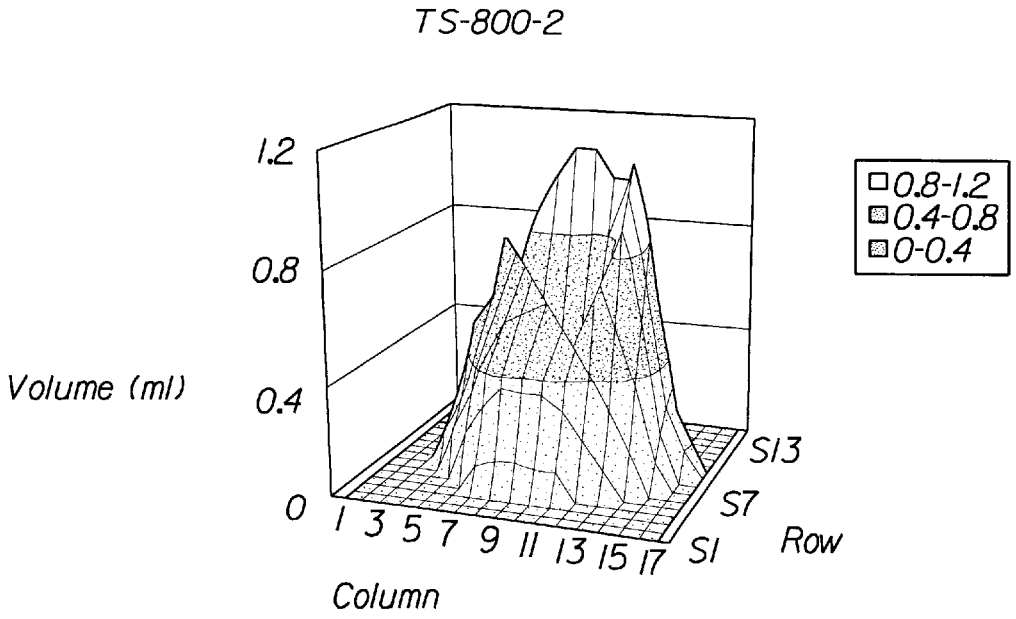
FIG. 12 is a three dimensional graph illustrating the spray pattern of a TS-8002 sprayer from Calmar.
Figure 13:
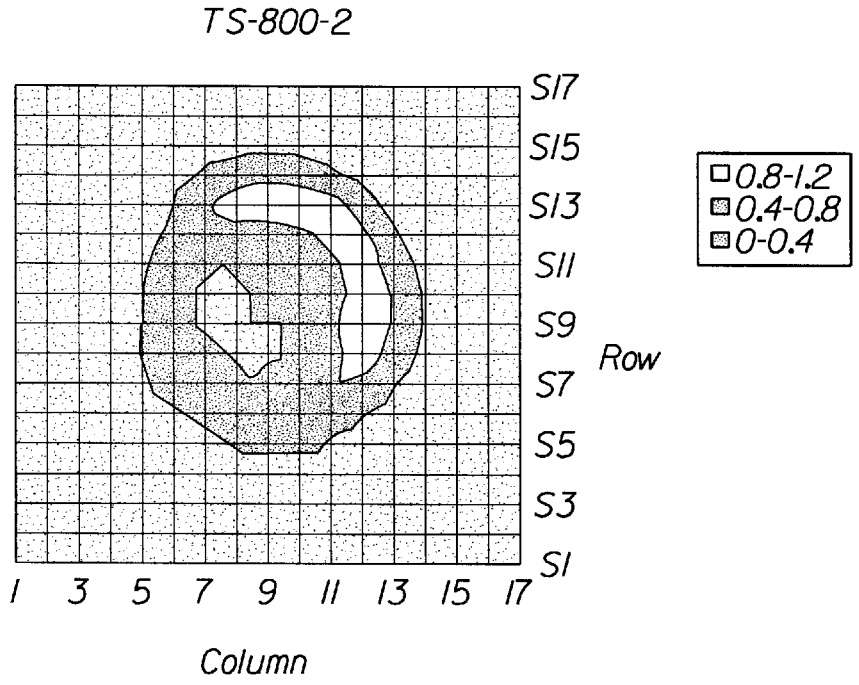
FIG. 13 is a cross sectional view of the three dimensional graph in FIG. 12.

Acceptable wrinkle control compositions of the present invention should have a Trouton ratio of less than about 10,000 at extensional rates of less than 20,000 $s^{-1}$ and comprise:

(A) Aqueous base comprising water which can be deionized, distilled or tap water. The level of water in the composition can be as high as about 100% of the composition, but is preferably lower than about 100%, more preferably lower than about 99.999%, even more preferably lower than about 99.99%, still more preferably lower than about 99.9%, and higher than about 40%, preferably higher than about 50%, more preferably higher than about 60%, even more preferably higher than about 70%, still more preferably higher than about 75% by weight of the usage composition.

The wrinkle control compositions may optionally comprise:

(B) optionally, to reduce surface tension, an effective amount of surfactant;

(C) optionally, solvent and/or plasticizer;

(D) optionally, but preferably, an effective amount to absorb malodor, of an odor control agent;

(E) optionally, to enhance wrinkle control and other fabric benefits, an effective amount of fabric care polysaccharide chosen from the group of primary fabric care polysaccharide, adjunct fabric care oligosacchride, and starch;

(F) optionally, but preferably, an effective amount to provide olfactory effects of perfume;

(G) optionally, an effective amount, to kill, or reduce the growth of microbes, of antimicrobial active;

(H) optionally, an effective amount to provide improved antimicrobial action for, e.g., the antimicrobial active, of aminocarboxylate chelator;

(I) optionally, an effective amount of solubilized, water-soluble, antimicrobial preservative, especially when said antimicrobial active is not sufficient to act as a preservative.

(J) optionally, other ingredients such as adjunct odor-controlling materials, chelating agents, additional anti-static agents if more static control is desired, insect and moth repelling agents, colorants, viscosity control agents; anti-clogging agents; agents for pH adjustment; buffers; whiteness preservatives; and (K) mixtures of optional components (A) through (J).

The present wrinkle control compositions are preferably essentially free of any material that would soil or stain fabric under usage conditions, or preferably essentially free of materials at a level that would soil or stain fabrics unacceptably under usage conditions.

The present invention also relates to concentrated wrinkle controlling compositions, including liquid, fluid and solid forms of concentrated compositions which are diluted to form compositions with the usage concentrations for use under usage conditions. It is preferred that the concentrated compositions be delivered in forms that rapidly and smoothly dissolve or disperse to the usage concentration.

The present invention also relates to articles of manufacture comprising the present compositions incorporated into a container having a spray dispenser, that can facilitate treatment of articles and/or surfaces with said compositions containing wrinkle control agent and other optional ingredients at a level that is effective, yet is not discernible when dried on the surfaces. The spray dispenser comprises manually activated and non-manual powered (operated) spray means and a container containing the wrinkle controlling composition.

The present article of manufacture can further comprise a set of instructions to communicate methods of using the present compositions to the consumer.

A. Aqueous Base

Surprisingly, it has been found that water alone is capable of plasticizing fibers such that a sufficient degree of wrinkle removal and/or reduction can be attained by spraying water onto a surface and gently pulling or smoothing the garment to release wrinkles.

Although water alone is sufficient to remove wrinkles, the present compositions preferably comprise optional ingredients such as surfactants and/or solvents.

A variety of water sources including, but not limited to deionized water, distilled water or tap water are suitable for the present composition. Water is present at a level of about 100% of the composition, but is preferably lower than about 100%, more preferably lower than about 99.975%, even more preferably lower than about 99.9%, still more preferably lower than about 99.5%, and higher than about 40%, preferably higher than about 50%, more preferably higher than about 60%, even more preferably higher than about 70%, still more preferably higher than about 75% by weight of the usage composition.

B. Optional Ingredients

Optionally, the present wrinkle controlling composition can also contain the following:

1. Surfactants

Surfactants are optional, but preferred ingredients in the present composition. Surfactants aid water penetration into fibers thus making the natural wrinkle control properties of water more effective. Surfactant also aids water in penetrating fabrics treated with hydrophobic fabric finishes that tend to repel water. Residual surfactant also helps keep fibrils flat against the fiber surface, thus smoothing the surface and aiding in wrinkle release. Residual surfactant can also act to stiffen fibers, thus helping to prevent rewrinkling.

Surfactants normally fall into several groups, a preferred class known as silicone surfactants, nonionic surfactants, ionic surfactants, amphoteric surfactants, and fluorine-based surfactants. Another special class of surfactants are cyclodextrin compatible surfactants which are disclosed under the section titled 'Odor Control Agents'. It is preferred to use cyclodextrin compatible surfactants when optional cyclodextrin is incorporated in the formulation.

Surfactants can also have varying degrees of saturation. Different levels of saturation to unsaturation are preferred for various applications. In applications where fabrics are chronically exposed to conditions that stimulate oxidation or polymerization that can lead to fabric yellowing (i.e. high heat, the presence of transition metals, UV radiation) it is preferably to have a higher degree of saturation (e.g. IV less than 50). In applications where oxidation or polymerization leading to yellowing is not a factor, a lower level of saturation (e.g. IV above 50) is desirable, since less saturated surfactants can additionally act as fabric-fiber lubricants to enhance wrinkle release.

When it is desireable to have lubrication under conditions where oxidation or polymerization are a risk, a whiteness preservative selected from the group of chelants, fabric substantive chelants, optical brightening agents, bluing agents, UV absorbers, and oxidative stabilizers such as anti-oxidants and/or reductive agents as well as mixtures of whiteness preservatives can be used to advantage. When whiteness preservatives are used, these should be added at levels of at least about 0.001, preferably at least about 0.005%, more preferably at least about 0.01%, even more preferably at least about 0.05%, still more preferably at least about 0.2%, and typically below about 10%, preferably below about 5%, more preferably below about 3%, and still more preferably below about 1.5%. Whiteness preservatives are discussed in additional detail below under other optional ingredients.

When optional surfactants are incorporated, typical levels are at least about 0.0001%, preferably 0.001%, more preferably at least about 0.01%, and even more preferably at least about 0.1% and typically less than about 20%, preferably less than about 15%, more preferably less than about 10%, even more preferably less than about 5% of the weight of the composition.

(a) Silicone Surfactant

Silicone surfactants are highly preferred surfactants because these compounds typically impart lubricity and smoothness to fibers that allows them to slip or glide easily past one another and therefore enhances the process of wrinkle release or wrinkle control. These compounds can also smooth the surface of fabrics, by smoothing down fibrils and pills, to leave a silky or soft feeling to fabric surface and also provide color and surface appearance benefits. Residual silicone surfactant helps to keep fibrils and fibers in place, thus preventing rewrinkling.

A preferred, but nonlimiting class of nonionic silicone surfactants is the class of polyalkylene oxide polysiloxanes. Typically the polyalkylene oxide polysiloxanes have a dimethyl polysiloxane hydrophobic moiety and one or more hydrophilic polyalkylene chains. The hydrophilic polyakylene chains can be incorporated as side chains (pendant moieties) or as block copolymer moieties with the polysiloxane hydrophobic moiety. Polyalkylene oxide polysiloxanes are described by the following general formulas:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 1 to about 30, more preferably from about 1 to about 25, and each $R^1$ is the same or different and is selected from the group consisting of methyl and a poly(ethyleneoxide/propyleneoxide) copolymer group having the general formula:

$$—(CH_2)_nO(C_2H_4O)_c(C_3H_6O)_dR^2$$

with at least one $R^1$ being a poly(ethyleneoxy/propyleneoxy) copolymer group, and wherein n is 3 or 4, preferably 3; total c (for all polyalkyleneoxy side groups) has a value of from 1 to about 100, preferably from about 6 to about 100; total c+d has a value of from about 5 to about 150, preferably from about 7 to about 100 and each $R^2$ is the same or different and is selected from the group consisting of hydrogen, an alkyl having 1 to 4 carbon atoms, and an acetyl group, preferably hydrogen and/or methyl group. Each polyalkylene oxide polysiloxane has at least one $R^1$ group being a poly(ethyleneoxide/propyleneoxide) copolymer group.

Nonlimiting examples of these type of surfactants are the Silwet® surfactants which are available from Crompton. Representative Silwet® surfactants which contain only ethyleneoxy ($C_2H_4O$) groups are as follows.

| Name | Average MW | Average a + b | Average total c |
|---|---|---|---|
| L-7608 | 600 | 1 | 8 |
| L-7607 | 1,000 | 2 | 17 |
| L-77 | 600 | 1 | 9 |
| L-7605 | 6,000 | 20 | 99 |

-continued

| Name | Average MW | Average a + b | Average total c |
|---|---|---|---|
| L-7604 | 4,000 | 21 | 53 |
| L-7600 | 4,000 | 11 | 68 |
| L-7657 | 5,000 | 20 | 76 |
| L-7602 | 3,000 | 20 | 29 |
| L-7622 | 10,000 | 88 | 75 |
| L-8600 | 2,100 | | |
| L-8610 | 1,700 | | |
| L-8620 | 2,000 | | |

Nonlimiting examples of Silwet® surfactants which contain both ethyleneoxy ($C_2H_4O$) and propyleneoxy ($C_3H_6O$) groups are as follows:

| Name | Average MW | EO/PO ratio |
|---|---|---|
| L-720 | 12,000 | 50/50 |
| L-7001 | 20,000 | 40/60 |
| L-7002 | 8,000 | 50/50 |
| L-7210 | 13,000 | 20/80 |
| L-7200 | 19,000 | 75/25 |
| L-7220 | 17,000 | 20/80 |

Nonlimiting examples of Silwet® surfactants which contain only propyleneoxy ($C_3H_6O$) groups are as follows:

| Name | Average MW |
|---|---|
| L7500 | 3,000 |
| L7510 | 13,000 |
| L7550 | 300 |
| L8500 | 2,800 |

The molecular weight of the polyalkyleneoxy group ($R^1$) is less than or equal to about 10,000. The preferred molecular weight of the polyalkylene oxide polysiloxane is dependent on the exact functionality in a given composition. If propyleneoxy groups are present in the polyalkylenoxy chain, they can be distributed randomly in the chain or exist as blocks. Other nonlimiting examples of polyalkylene oxide polysiloxane useful in the present invention include include the following compounds available from Dow Coming® 193, 190, FF-400 Fluid, Q2-5220, Q4-3667, Q2-5211, as well as compounds available from Toray Dow Coming Silicone Co., Ltd. know as SH3771C, SH3772C, SH3773C, SH3746, SH3748, SH3749, SH8400, SF8410, and SH8700, KF351 (A), KF352 (A), KF354 (A), and KF615 (A) of Shin-Etsu Chemical Co., Ltd., TSF4440, TSF4445, TSF4446, TSF4452 of Toshiba Silicone Co.

The number of ethyleneoxy units (—$C_2H_4O$) in the polyether chain ($R^1$) must be sufficient to render the polyalkylene oxide polysiloxane water dispersible or water soluble. In particular cases, it is preferrable to combine the polyalkylene oxide polysiloxane with another of the surfactants disclosed below (in sections on nonionic, ionic, zwitterionic, and fluorine-based surfactants) to improve stability or compatibility in aqeuous products. If propyleneoxy groups are present in the polyalkylenoxy chain, they can be distributed randomly in the chain or exist as blocks. Polyalkylene oxide polysiloxane surfactants are very versatile materials which serve a variety of purposes depending on physical characteristics of the material.

A preferred polyalkylene oxide polysiloxane surfactant can be chosen for benefits that it can provide in addition to wrinkle release. Additional benefits can include improved spreading and softness. Improved spreading can be provided by superwetters, some nonlimitng examples of which include Silwet® L77 and DC Q2-5211. Further, additional softness is especially preferred when the other materials such as cyclodextrin, polymer, or detergent residues leave a rough feeling on the surface of the fabric. Nonlimiting examples of polyalkylen oxide polysiloxanes that provide softness include Silwets® L7001, L7200, and L7087 and DC 190. When optional cyclodextrin is used, it is preferred to use polyakylene oxide polysiloxanes with higher molecular weights, at least about 5,000 and preferably at least about 10,000, to prevent significant interaction with the cyclodextrin. Mixtures of polyalkylene oxide polysiloxanes with preferred properties are also preferred. Other additional benefits available from polyalkylene oxide polysiloxane surfactants include antistatic benefits, lubricity, and improvements in fabric appearance.

The preparation of polyalkylene oxide polysiloxanes is well known in the art. Polyalkylene oxide polysiloxanes of the present invention can be prepared according to the procedure set forth in U.S. Pat. No. 3,299,112, incorporated herein by reference. Typically, polyalkylene oxide polysiloxanes of the surfactant blend of the present invention are readily prepared by an addition reaction between a hydrosiloxane (i.e., a siloxane containing silicon-bonded hydrogen) and an alkenyl ether (e.g., a vinyl, allyl, or methallyl ether) of an alkoxy or hydroxy end-blocked polyalkylene oxide). The reaction conditions employed in addition reactions of this type are well known in the art and in general involve heating the reactants (e.g., at a temperature of from about 85° C. to 110° C.) in the presence of a platinum catalyst (e.g., chloroplatinic acid) and a solvent (e.g., toluene).

(b) Nonionic Surfactant

A preferred, but nonlimiting, type of nonionic surfactant is alkyl ethoxylated surfactant, such as addition products of ethylene oxide with fatty alcohols, fatty acids, fatty amines, etc. Optionally, addition products of mixtures of ethylene oxide and propylene oxide with fatty alcohols, fatty acids, fatty amines can be used. The ethoxylated surfactant includes compounds having the general formula:

$$R^8—Z—(CH_2CH_2O)_sB$$

wherein $R^8$ is an alkyl group or an alkyl aryl group, selected from the group consisting of primary, secondary and branched chain alkyl hydrocarbyl groups, primary, secondary and branched chain alkenyl hydrocarbyl groups, and/or primary, secondary and branched chain alkyl- and alkenyl-substituted phenolic hydrocarbyl groups having from about 6 to about 20 carbon atoms, preferably from about 8 to about 18, more preferably from about 10 to about 15 carbon atoms; s is an integer from about 2 to about 45, preferably from about 2 to about 20, more preferably from about 2 to about 15; B is hydrogen, a carboxylate group, or a sulfate group; and linking group Z is selected from the group consisting of: —O—, —$N(R)_x$—, —C(O)O—, —C(O)N(R)—, —C(O)N(R)—, and mixtures thereof, in which R, when present, is $R^8$, a lower alkyl with about 1 to about 4 carbons, a polyalkylene oxide, or hydrogen, and x is 1 or 2.

The nonionic alkyl ethoxylated surfactants herein are characterized by an HLB (hydrophilic-lipophilic balance) of from about 5 to about 20, preferably from about 6 to about 15.

Nonlimiting examples of preferred alkyl ethoxylated surfactants are:

straight-chain, primary alcohol ethoxylates, with $R^8$ being $C_8$–$C_{18}$ alkyl and/or alkenyl group, more preferably $C_{10}$–$C_{14}$, and s being from about 2 to about 8, preferably from about 2 to about 6;

straight-chain, secondary alcohol ethoxylates, with $R^8$ being $C_8$–$C_{18}$ alkyl and/or alkenyl, e.g., 3-hexadecyl, 2-octadecyl, 4-eicosanyl, and 5-eicosanyl, and s being from about 2 to about 10;

alkyl phenol ethoxylates wherein the alkyl phenols having an alkyl or alkenyl group containing from about 3 to about 20 carbon atoms in a primary, secondary or branched chain configuration, preferably from about 6 to about 12 carbon atoms, and s is from about 2 to about 12, preferably from about 2 to about 8;

branched chain alcohol ethoxylates, wherein branched chain primary and secondary alcohols (or Guerbet alcohols) which are available, e.g., from the well-known "OXO" process, or modification thereof, are ethoxylated.

Especially preferred are alkyl ethoxylate surfactants with each $R^8$ being $C_8$–$C_{16}$ straight chain and/or branch chain alkyl and the number of ethyleneoxy groups s being from about 2 to about 6, preferably from about 2 to about 4, more preferably with $R^8$ being $C_8$–$C_{15}$ alkyl and s being from about 2.25 to about 3.5. These nonionic surfactants are characterized by an HLB of from 6 to about 11, preferably from about 6.5 to about 9.5, and more preferably from about 7 to about 9. Nonlimiting examples of commercially available preferred surfactants are Neodol 91-2.5 ($C_9$–$C_{10}$, s=2.7, HLB=8.5), Neodol 23-3 ($C_{12}$–$C_{13}$, s=2.9, HLB=7.9) and Neodol 25-3 ($C_{12}$–$C_{15}$, s=2.8, HLB=7.5). It is found, very surprisingly, that these preferred surfactants which are themselves not very water soluble (0.1% aqueous solutions of these surfactants are not clear), can at low levels, effectively emulsify and or disperse silicone oils and these surfactants can also solubilize and/or disperse shape retention polymers such as copolymers containing acrylic acid and tert-butyl acrylate into clear compositions, even without the presence of a low molecular weight alcohol. Many nonlimiting examples of suitable nonionic surfactants are given in the table below.

Other useful nonionic alkyl alkoxylated surfactants are ethoxylated alkyl amines derived from the condensation of ethylene oxide with hydrophobic alkyl amines, with $R^8$ having from about 8 to about 22 carbon atoms and s being from about 3 to about 30.

Other examples of useful ethoxylated surfactants include carboxylated alcohol ethoxylate, also known as ether carboxylate, with $R^8$ having from about 12 to about 16 carbon atoms and s being from about 5 to about 13; ethoxylated alkyl amine or quaternary ammonium surfactants, $R^8$ having from about 8 to about 22 carbon atoms and s being from about 3 to about 30, such as PEG-5 cocomonium methosulfate, PEG-15 cocomonium chloride, PEG-15 oleammonium chloride and bis(polyethoxyethanol) tallow ammonium chloride.

Additional suitable nonionic surfactants include surfactants derived from carbohydrates such as sorbitan esters, especially sorbitan monoesters, also alkyl glucosides, and alkyl polyglucosides. A specific description of many surfactants which are derived from carbohydrates can be found in *Handbook of Surfactants*, M. R. Porter, 1991, Blackie & Son Ltd, pp. 142–145. Glucamines are additional examples of surfactants derived from carbohydrates and are included herein by reference to U.S. Pat. No. 5,194,639 issued Mar. 16, 1993 to D. S. Connor, J. J. Scheibel, and R. G. Severson; U.S. Pat. No. 5,338,487 issued Aug. 16, 1993 to D. S. Connor, J. J. Scheibel, and J.-N. Kao; U.S. Pat. No. 5,489,393 issued Feb. 6, 1996 to D. S. Connor, J. J. Scheibel, and Y. C. Fu; and U.S. Pat. No. 5,512,699 issued Apr. 30, 1996 to D. S. Connor, Y. C. Fu, and J. J. Scheibel. Preferred alkyl polyglucosides are those having aqueous surface tension below about 35 mN/m such as AG 6202 and AG6210 from Akzo Nobel Chemicals, Inc., Chicago, Ill.

TABLE 1

Nonlimiting Examples of Some Suitable Nonionic Surfactants.

| Name | Structure | HLB Value | Suppliers |
|---|---|---|---|
| Neodol ® 91-2.5 | $C_9$–$C_{10}$ - 2.7 EO | 8.5 | Shell Chemical Co. |
| Neodol ® 23-1 | $C_{12}$–$C_{13}$ - 1.0 EO | 3.7 | Shell Chemical Co. |
| Neodol ® 23-2 | $C_{12}$–$C_{13}$ - 2.0 EO | 5.9 | Shell Chemical Co. |
| Neodol ® 23-3 | $C_{12}$–$C_{13}$ - 2.9 EO | 7.9 | Shell Chemical Co. |
| Neodol ® 25-3 | $C_{12}$–$C_{15}$ - 2.8 EO | 7.5 | Shell Chemical Co. |
| Neodol ® 23-5 | $C_{12}$–$C_{13}$ - 5.0 EO | 10.7 | Shell Chemical Co. |
| Neodol ® 25-9 | $C_{12}$–$C_{15}$ - 8.9 EO | 13.1 | Shell Chemical Co. |
| Neodol ® 25-12 | $C_{12}$–$C_{15}$ - 11.9 EO | 14.4 | Shell Chemical Co. |
| Hetoxol ® TD-3 | C13 - 3 EO | 7.9 | Heterene Inc. |
| Hetoxol ® OL-5 | Oleoyl - 5 EO | 8.0 | Heterene Inc. |
| Kessco ® PEG-8 Monooleate | Oleoyl - 8 EO | 11.0 | Stepan Co. |
| Kessco ® Glycerol monooleate | Glyceryl mono-oleate | 3.8 | Stepan Co. |
| Arlacel ® 20 | Sorbitan mono-laurate | 8.6 | ICI Americas |

(c) Ionic Surfactant

Nonlimiting preferred ionic surfactants are the class of anionic surfactants. Anionic surfactants are preferred ionic surfactants since they are least likely to leave residues. Many suitable nonlimiting examples from the class of anionic surfactants can be found in *Surfactants and Interfacial Phenomena*, 2$^{nd}$ Ed., Milton J. Rosen, 1989, John Wiley & Sons, Inc., pp. 7–16, which is hereby incorporated by reference. Additional suitable nonlimiting examples of anionic surfactants can be found in *Handbook of Surfactants*, M. R. Porter, 1991, Blackie & Son Ltd, pp. 54–115 and references therein, the disclosure of which is incorporated herein by reference.

Structurally, suitable anionic surfactants contain at least one hydrophobic moiety and at least one hydrophilic moiety. The surfactant can contain multiple hydrophobic moieties and/or multiple hydrophilic moieties, but preferably less than or equal to about 2 hydrophobic moieties and less than or equal to about 3 hydrophilic moieties. The hydrophobic moiety is typically comprised of hydrocarbons either as an alkyl group or an alkyl-aryl group. Alkyl groups typically contain from about 6 to about 22 carbons, preferably about 10 to about 18 carbons, and more preferably from about 12 to about 16 carbons; aryl groups typically contain alkyl groups containing from about 4 to about 6 carbons. Each alkyl group can be a branched or linear chain and is either saturated or unsaturated. A typical aryl group is benzene. Some typical hydrophilic groups for anionic surfactants include but are not limited to $—CO_2^-$, $—OSO_3^-$, $—SO_3^-$, $—(OR_1)_x—CO_2^-$, $—(OR_1)_x—OSO_3^-$, $—(OR_1)_x—SO_3^-$ where x is being less than about 10 and preferably less than about 5. Some nonlimiting examples of suitable surfactants includes, Stepanol® WAC, Biosoft® 40 (Stepan Co., Northfield, Ill.).

Anionic surfactants can also be created by sulfating or sulfonating animal or vegetable based oils. An example of these type of surfactants include sulfated canola oil and sulfated castor oil (Freedom SCO-75) available from the Freedom Chemical Co., Charlotte N.C. (owned by BF Goodrich).

Other suitable ionic surfactants include the cationic and amphoteric surfactants. Nonlimiting examples of these classes of surfactants can be found in *Handbook of Surfactants*, M. R. Porter, 1991, Blackie & Son Ltd, pp. 179–202 as well as in *Surfactants and Interfacial Phenomena*, 2$^{nd}$ Ed., Milton J. Rosen, 1989, John Wiley & Sons, Inc., pp. 17–20 and pp. 28–31 and references therein, the disclosures of which are hereby incorporated herein by reference.

(d) Zwitterionic Surfactants

Zwitterionics are suitable for use in the present invention. Zwitterionic surfactants, also referred to as amphoteric surfactants comprise moieties that can have both negative and positive charges. Zwitterionics have advantages over other surfactants since these are less irritating to the skin and yet still provide good wetting. Some nonlimiting examples of zwitterionic surfactants useful for the present invention are: betaines, amine-oxides, sulfobetaines, sultaines, glycinates, aminoipropionates, imidazoline-based amphoterics. Various zwitterionic surfactants are disclosed in the "Handbook of Surfactants" by M. R. Porter, Chapman & Hall, 1991 and references therein and in "Surfactants and Interfacial Phenomena" by M. Rosen, 2$^{nd}$ Ed., John Wiley & Sons, 1989 and references therein. Zwitterionics disclosed in the "Handbook of Surfactants" and in "Surfactants and Interfacial Phenomena" and references therein are incorporated herein by reference.

(e) Fluorine-Based Surfactants

Fluorocarbon surfactants comprise the class of surfactants wherein the hydrophobic part of the amphiphile comprises at least in part some portion of a carbon-based linear or cyclic moiety having fluorines attached to the carbon where typically hydrogens would be attached to the carbons together with a hydrophilic head group. Some typical nonlimiting fluorocarbon surfactants include fluorinated alkyl polyoxyalkylene, and fluorinated alkyl esters as well as ionic surfactants. Representative structures for these compounds are given below:

(1) $R_fR(R_1O)_xR_2$ (2) $R_fR—OC(O)R_3$ (3) $R_fR—Y—Z$ (4) $R_fRZ$ where $R_f$ contains from about 6 to about 18 carbons each having from about 0 to about 3 fluorines attached; R is either an alkyl or alkylene oxide group which when present, has from about 1 to about 10 carbons; $R_1$ represents an alkylene radical having from about 1 to about 4 carbons; $R_2$ is either a hydrogen or a small alkyl capping group having from about 1 to about 3 carbons; and $R_3$ represents a hydrocarbon moiety comprising from about 2 to about 22 including the carbon on the ester group. This hydrocarbon can be linear, branched or cyclic saturated or unsaturated and contained moieties based on oxygen, nitrogen, and sulfur including, but not limited to ethers, alcohols, esters, carboxylates, amides, amines, thio-esters, and thiols; these oxygen, nitrogen, and sulfur moieties can either interrupt the hydrocabon chain or be pendant on the hydrocarbon chain. In structure 3, Y represents a hydrocarbon group that can be an alkyl, pyridine group, amidopropyl, etc. that acts as a linking group between the fluorinated chain and the hydrophilic head group. In structures 3 and 4, Z represents a cationic, anionic, and amphoteric hydrophilic head groups including, but not limited to carboxylates, sulfates, sulfonates, quaternary ammonium groups, and betaines. Nonlimiting commercially available examples of these structures include Zonyl® 9075, FSO, FSN, FS-300, FS-310, FSN-100, FSO-100, FTS, TBC from DuPont and Fluorad™ surfictants FC-430, FC-431, FC-740, FC-99, FC-120, FC-754, FC170C, and FC-171 from the 3M™ company in St. Paul, Minn.

2. Solvents and Plasticizers

Solvents and plasticizers act to aid the natural ability of water to plasticize fibers. Acceptable solvents and plasticizers include compounds having from one to ten carbons. The following non-limiting classes of compounds are suitable: mono-alcohols, diols, polyhydric alcohols, ethers, ketones, esters, organic acids, and alkyl glyceryl ethers, and hydrocarbons. Preferred solvents are soluble in water and/or miscible in the presence of optional surfactant. Some non-limiting examples include methanol, ethanol, isopropanol, hexanol, 1,2-hexanediol, hexylene glycol, (e.g. 2-methyl-2,4-pentanediol), isopropylene glycol (3-methyl-1,3-butanediol), 1,2-butylene glycol, 2,3-butylene glycol, 1,3-butylene glycol, 1,4-butylene glycol, 1,3-propylene glycol, 1,2-propylene glycol, isomers of cyclohexanedimethanol, isomers of propanediol, isomers of butanediol, the isomers of trimethylpentanediol, the isomers of ethylmethylpentanediol, alcohol ethoxylates of 2-ethyl-1,3-hexanediol, 2,2,4-trimethyl-1,3-pentanediol, alcohol ethoxylates of 2,2,4-trimethyl-1,3-pentanediol glycerol, ethylene glycol, diethylene glycol, dipropylene glycol, sorbitol, butoxy ethoxy ethanol, 3-methyl-3-methoxybutanol, 3-methoxybutanol, 1-ethoxy-2-propanol, diethylene glycol monoethyl ether, diethylene glycol monopropyl ether, diethylene glycol monobutyl ether, triethylene glycol monoethyl ether, erythritol, and mixtures of solvents and plasticizers.

Water immiscible solvents may also be used to advantage. Specifically, when a water immiscible solvent is used, an emulsifying system such as a surfactant or a combinations of surfactants is preferred to render the solvent miscible. When optional cyclodextrin is present, the plasticizer should be compatible with it. Mixtures of solvents are also suitable.

When solvent is used, it is used typically at a level of at least about 0.5%, preferably at least about 1%, more preferably at least about 2%, even more preferably at least about 3% and still more preferably at least about 4% and typically less than about 30%, preferably less than about 25%, more preferably less than about 20%, even more preferably less than about 15% by weight of the composition.

3. Malodor Control Agent

The compositions for odor control are of the type disclosed in U.S. Pat. Nos. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated herein by reference. Such compositions can contain several different optional odor control agents in addition to the polymers described hereinbefore that can control amine odors.

(a) Cyclodextrin

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics. As the water is being removed however, e.g., the fabric is being dried off, some low molecular weight organic amines and acids have more affinity and will complex with the cyclodextrins more readily.

The cavities within the cyclodextrin in the solution of the present invention should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatised cyclodextrins. .

Preferably, the cyclodextrins used in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio) propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. Nos.: 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

Preferably, the solution used to treat the surface under usage conditions is virtually not discernible when dry. Typical levels of cyclodextrin in usage compositions for usage conditions are from about 0.01% to about 5%, preferably from about 0.1% to about 4%, more preferably from about 0.5% to about 2% by weight of the composition. Compositions with higher concentrations can leave unacceptable visible stains on fabrics as the solution evaporates off of the fabric. This is especially a problem on thin, colored, synthetic fabrics. In order to avoid or minimize the occurrence of fabric staining, it is preferable that the fabric be treated at a level of less than about 5 mg of cyclodextrin per gram of fabric, more preferably less than about 2 mg of cyclodextrin per gram of fabric. The presence of the surfactant can improve appearance by minimizing localized spotting.

When it is desired to incorporate cyclodextrin into a concentrated product, the cyclodextrin level is typically from about 3% to about 20%, more preferably from about 5% to about 10%, by weight of the concentrated composition, it is preferable to dilute the concentrated composition before treating fabrics in order to avoid staining. The resulting diluted compostion have usage concentrations of cyclodextrin as discussed hereinbefore, e.g., of from about 0.1% to about 5%, by weight of the diluted composition.

Cyclodextrin Preservative

Optionally, but desirably if cyclodextrin is present, preferably solubilized, water-soluble, antimicrobial preservative can be added to the composition of the present invention if the antimicrobial material is not sufficient to protect the cyclodextrin, or is not present, because cyclodextrin molecules are made up of varying numbers of glucose units which can make them a prime breeding ground for certain microorganisms, especially when in aqueous compositions. This drawback can lead to the problem of storage stability of cyclodextrin solutions for any significant length of time. Contamination by certain microorganisms with subsequent microbial growth can result in an unsightly and/or malodorous solution. Because microbial growth in cyclodextrin solutions is highly objectionable when it occurs, it is highly preferable to include a solubilized, water-soluble, antimicrobial preservative, which is effective for inhibiting and/or regulating microbial growth in order to increase storage stability of the preferably clear, aqueous odor-absorbing solution containing water-soluble cyclodextrin.

It is preferable to use a broad spectrum preservative, e.g., one that is effective on both bacteria (both gram positive and gram negative) and fungi. A limited spectrum preservative, e.g., one that is only effective on a single group of microorganisms, e.g., fungi, can be used in combination with a broad spectrum preservative or other limited spectrum preservatives with complimentary and/or supplementary activity. A mixture of broad spectrum preservatives can also be used. In some cases where a specific group of microbial contaminants is problematic (such as Gram negatives), aminocarboxylate chelators may be used alone or as potentiators in conjunction with other preservatives. These chelators which include, e.g., ethylenediaminetetraacetic acid (EDTA), hydroxyethylenediaminetriacetic acid, diethylenetriaminepentaacetic acid, and other aminocarboxylate chelators, and mixtures thereof, and their salts, and mixtures thereof, can increase preservative effectiveness against Gram-negative bacteria, especially Pseudomonas species.

Antimicrobial preservatives useful in the present invention include biocidal compounds, i.e., substances that kill microorganisms, or biostatic compounds, i.e., substances that inhibit and/or regulate the growth of microorganisms. Suitable preservatives are disclosed in U.S. Pat. Nos. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated hereinbefore by reference. Preferred antimicrobial preservatives are those that are water-soluble and are effective at low levels because the organic preservatives can form inclusion complexes with the cyclodextrin molecules and compete with the malodorous molecules for the cyclodextrin cavities, thus rendering the cyclodextrins ineffective as odor controlling actives. Water-soluble preservatives useful in the present invention are those that have a solubility in water of at least about 0.3 g per 100 ml of water, i.e., greater than about 0.3% at room temperature, preferably greater than about 0.5% at room temperature. These types of preservatives have a lower affinity to the cyclodextrin cavity, at least in the aqueous phase, and are therefore more available to provide antimicrobial activity. Preservatives with a water-solubility of less than about 0.3% and a molecular structure that readily fits into the cyclodextrin cavity, have a greater tendency to form inclusion complexes with the cyclodextrin molecules, thus rendering the preservative less effective to control microbes in the cyclodextrin solution.

The water-soluble antimicrobial preservative in the present invention is included at an effective amount. The term "effective amount" as herein defined means a level sufficient to prevent spoilage, or prevent growth of inadvertently added microorganisms, for a specific period of time. In other words, the preservative is not being used to kill microorganisms on the surface onto which the composition is deposited in order to eliminate odors produced by microorganisms. Instead, it is preferably being used to prevent spoilage of the cyclodextrin solution in order to increase the shelf-life of the composition. Preferred levels of preservative are from about 0.0001% to about 0.5%, more preferably from about 0.0002% to about 0.2%, most preferably from about 0.0003% to about 0.1%, by weight of the usage composition.

In order to reserve most of the cyclodextrins for odor control, the cyclodextrin to preservative molar ratio should be greater than about 5:1, preferably greater than about 10:1, more preferably greater than about 50:1, even more preferably greater than about 100:1.

The preservative can be any organic preservative material which will not cause damage to fabric appearance, e.g., discoloration, coloration, bleaching. Preferred water-soluble preservatives include organic sulfur compounds, halogenated compounds, cyclic organic nitrogen compounds, low molecular weight aldehydes, quaternary ammonium compounds, dehydroacetic acid, phenyl and phenolic compounds, and mixtures thereof.

The preservatives of the present invention can be used in mixtures in order to control a broad range of microorganisms.

(b) Low Molecular Weight Polyols

Low molecular weight polyols with relatively high boiling points, as compared to water, such as ethylene glycol, propylene glycol and/or glycerol are preferred optional ingredients for improving odor control performance of the composition of the present invention, especially when cyclodextrin is present. The incorporation of a small amount of low molecular weight glycols into the composition of the present invention typically enhances the formation of the cyclodextrin inclusion complexes as the fabric dries.

The polyols' ability to remain on the fabric for a longer period of time than water, as the fabric dries, typically allows it to form ternary complexes with the cyclodextrin and some malodorous molecules. The addition of the glycols tends to fill up void space in the cyclodextrin cavity that is unable to be filled by some malodor molecules of relatively smaller sizes. Preferably the glycol used is glycerin, ethylene glycol, propylene glycol, diethylene glycol, dipropylene glycol or mixtures thereof, and more preferably ethylene glycol and/or propylene glycol. Cyclodextrins prepared by processes that result in a level of such polyols are highly desirable, since they can be used without removal of the polyols.

Some polyols, e.g., dipropylene glycol, are also useful to facilitate the solubilization of some perfume ingredients in the composition of the present invention.

Typically, glycol is added to the composition of the present invention at a level of from about 0.01% to about 3%, by weight of the composition, preferably from about 0.05% to about 1%, more preferably from about 0.1% to about 0.5%, by weight of the composition. The preferred weight ratio of low molecular weight polyol to cyclodextrin is from about 2:1,000 to about 20:100, more preferably from about 3:1,000 to about 15:100, even more preferably from about 5:1,000 to about 10:100, and most preferably from about 1:100 to about 7:100.

(c) Metal Salts

Optionally, but highly preferred, the present invention can include metallic salts for added odor absorption and/or antimicrobial benefit for the cyclodextrin solution when cyclodextrin is present. The metallic salts are selected from the group consisting of copper salts, zinc salts, and mixtures thereof.

Copper salts have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide. Copper salts also possess some malodor control abilities. See U.S. Pat. No. 3,172,817, Leupold, et al., which discloses deodorizing compositions for treating disposable articles, comprising at least slightly water-soluble salts of acylacetone, including copper salts and zinc salts, all of said patents are incorporated herein by reference.

The preferred zinc salts possess malodor control abilities. Zinc has been used most often for its ability to ameliorate malodor, e.g., in mouth wash products, as disclosed in U.S. Pat. No. 4,325,939, issued Apr. 20, 1982 and U.S. Pat. No. 4,469,674, issued Sep. 4, 1983, to N. B. Shah, et al., all of which are incorporated herein by reference. Highly-ionized and soluble zinc salts such as zinc chloride, provide the best source of zinc ions. Zinc borate functions as a fungistat and a mildew inhibitor, zinc caprylate functions as a fungicide, zinc chloride provides antiseptic and deodorant benefits, zinc ricinoleate functions as a fungicide, zinc sulfate heptahydrate functions as a fungicide and zinc undecylenate functions as a fungistat.

Preferably the metallic salts are water-soluble zinc salts, copper salts or mixtures thereof, and more preferably zinc salts, especially $ZnCl_2$. These salts are preferably present in the present invention primarily to absorb amine and sulfur-containing compounds that have molecular sizes too small to be effectively complexed with the cyclodextrin molecules. Low molecular weight sulfur-containing materials, e.g., sulfide and mercaptans, are components of many types of malodors, e.g., food odors (garlic, onion), body/perspiration odor, breath odor, etc. Low molecular weight amines are also components of many malodors, e.g., food odors, body odors, urine, etc.

When metallic salts are added to the composition of the present invention they are typically present at a level of from about 0.1% to about 10%, preferably from about 0.2% to about 8%, more preferably from about 0.3% to about 5% by weight of the usage composition.

(d) Soluble Carbonate and/or Bicarbonate Salts

Water-soluble alkali metal carbonate and/or bicarbonate salts, such as sodium bicarbonate, potassium bicarbonate, potassium carbonate, cesium carbonate, sodium carbonate, and mixtures thereof can be added to the composition of the present invention in order to help to control certain acid-type odors. Preferred salts are sodium carbonate monohydrate, potassium carbonate, sodium bicarbonate, potassium bicarbonate, and mixtures thereof. When these salts are added to the composition of the present invention, they are typically present at a level of from about 0.1% to about 5%, preferably from about 0.2% to about 3%, more preferably from about 0.3% to about 2%, by weight of the composition. When these salts are added to the composition of the present invention it is preferably that incompatible metal salts not be present in the invention. Preferably, when these salts are used the composition should be essentially free of zinc and other incompatible metal ions, e.g., Ca, Fe, Ba, etc. which form water-insoluble salts.

(e) Enzymes

Enzymes can be used to control certain types of malodor, especially malodor from urine and other types of excretions, including regurgitated materials. Proteases are especially desirable. The activity of commercial enzymes depends very much on the type and purity of the enzyme being considered. Enzymes that are water soluble proteases like pepsin, tripsin, ficin, bromelin, papain, rennin, and mixtures thereof are particularly useful.

Enzymes are normally incorporated at levels sufficient to provide up to about 5 mg by weight, preferably from about 0.001 mg to about 3 mg, more preferably from about 0.002 mg to about 1 mg, of active enzyme per gram of the aqueous compositions. Stated otherwise, the aqueous compositions herein can comprise from about 0.0001% to about 0.5%, preferably from about 0.001% to about 0.3%, more preferably from about 0.005% to about 0.2% by weight of a commercial enzyme preparation. Protease enzymes are usually present in such commercial preparations at levels sufficient to provide from 0.0005 to 0.1 Anson units (AU) of activity per gram of aqueous composition.

Nonlimiting examples of suitable, commercially available, water soluble proteases are pepsin, tripsin, ficin, bromelin, papain, rennin, and mixtures thereof. Papain can be isolated, e.g., from papaya latex, and is available commercially in the purified form of up to, e.g., about 80% protein, or cruder, technical grade of much lower activity. Other suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo. Proteolytic enzymes suitable for removing protein-based stains that are commercially available include those sold under the trade names ALCALASE® and SAVINASE® by Novo Industries A/S (Denmark) and MAXATASE® by International Bio-Synthetics, Inc. (The Netherlands). Other proteases include Protease A (see European Patent Application 130,756, published January 9, 1985); Protease B (see European Patent Application Serial No. 87303761.8, filed Apr. 28, 1987, and European Patent Application 130,756, Bott et al, published Jan. 9, 1985); and proteases made by Genencor International, Inc., according to one or more of the following patents: Caldwell et al, U.S. Pat. Nos. 5,185,258, 5,204,015 and 5,244,791.

A wide range of enzyme materials and means for their incorporation into liquid compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Other enzyme materials useful for liquid formulations, and their incorporation into such formulations, are disclosed in U.S. Pat. No. 4,261,868, Hora et al, issued Apr. 14, 1981. Enzymes can be stabilized by various techniques, e.g., those disclosed and exemplified in U.S. Pat. No. 3,600,319, issued Aug. 17, 1971 to Gedge, et al., European Patent Application Publication No. 0 199 405, Application No. 86200586.5, published Oct. 29, 1986, Venegas, and in U.S. Pat. No. 3,519,570. All of the above patents and applications are incorporated herein, at least in pertinent part.

Enzyme-polyethylene glycol conjugates are also preferred. Such polyethylene glycol (PEG) derivatives of enzymes, wherein the PEG or alkoxy-PEG moieties are coupled to the protein molecule through, e.g., secondary amine linkages. Suitable derivatization decreases immunogenicity, thus minimizes allergic reactions, while still maintaining some enzymatic activity. An example of protease-PEG's is PEG-subtilisin Carlsberg from *B. licheniformis* coupled to methoxy-PEGs through secondary amine linkage, and is available from Sigma-Aldrich Corp., St. Louis, Miss.

(f) Zeolites

When the clarity of the solution is not needed, and the solution is not sprayed on fabrics, other optional odor absorbing materials, e.g., zeolites and/or activated carbon, can also be used. A preferred class of zeolites is characterized as "intermediate" silicate/aluminate zeolites. The intermediate zeolites are characterized by $SiO_2/AlO_2$ molar ratios of less than about 10. Preferably the molar ratio of $SiO_2/AlO_2$ ranges from about 2 to about 10. The intermediate zeolites have an advantage over the "high" zeolites. The intermediate zeolites have a higher affinity for amine-type odors, they are more weight efficient for odor absorption because they have a larger surface area, and they are more moisture tolerant and retain more of their odor absorbing capacity in water than the high zeolites. A wide variety of intermediate zeolites suitable for use herein are commercially available as Valfor® CP301-68, Valfor® 300-63, Valfor® CP300-35, and Valfor CP300-56, available from PQ Corporation, and the CBV100® series of zeolites from Conteka.

Zeolite materials marketed under the trade name Abscents® and Smellrite®, available from The Union Carbide Corporation and UOP are also preferred. These materials are typically available as a white powder in the 3–5 micron particle size range. Such materials are preferred over the intermediate zeolites for control of sulfur-containing odors, e.g., thiols, mercaptans.

(g) Activated Carbon

The carbon material suitable for use in the present invention is the material well known in commercial practice as an absorbent for organic molecules and/or for air purification purposes. Often, such carbon material is referred to as "activated" carbon or "activated" charcoal. Such carbon is available from commercial sources under such trade names as; Calgon-Type CPG®; Type PCB®; Type SGL®; Type CAL®; and Type OL®. Activated carbon fibers and cloth may also be used in combination with the compositions and/or articles of manufacture disclosed herein to provide malodor removal and/or freshness benefits. Such activated carbon fibers and fabrics can be acquired from Calgon.

(h) Mixtures Thereof

Mixtures of the optional odor control agents described above are desirable, especially when the mixture provides control over a broader range of odors.

4. Fabric Care Polysaccharides (a) Primary Fabric Care Polysaccharide

Suitable fabric care polysaccharides for use in the fabric care composition of the present invention are those which have a globular conformation in dilute aqueous solution, via a random coiling structure. Said polysaccharides include homo- and/or hetero- polysaccharides with simple helical structure with or without branching, e.g., with 1,4-α-linked backbone structure (e.g., 1,4-α-glucan, 1,4-α-xylan) with or without branching, 1,3-β-linked backbone with or without branching (e.g., galactan), and all 1,6-linked backbones with or without branching (e.g., dextran, pullulan, pustulan), and with a weight-average molecular weight of from about 5,000 to about 500,000, preferably from about 8,000 to about 250,000, more preferably from about 10,000 to about 150,000, typically with sizes ranging from about 2 nm to about 300 nm, preferably from about 3 nm to about 100 nm, more preferably from about 4 nm to about 30 nm. The size is defined as the gyration length occupied by the molecule in dilute aqueous solutions.

Preferably the fabric care polysaccharide is selected from the group consisting of arabinogalactan, pachyman, curdlan, callose, paramylon, sceleroglucan, lentinan, lichenan, laminarin, szhizophyllan, grifolan, sclerotinia sclerotiorum glucan (SSG), Ompharia lapidescence glucan (OL-2), pustulan, dextran, pullulan, substituted versions thereof, derivatised versions thereof, and mixtures thereof. More preferably the fabric care polysaccharide is selected from the group consisting of arabinogalactan, dextran, curdlan, substituted versions thereof, derivatised versions thereof, and mixtures thereof, and even more preferably the fabric care polysaccharide comprises arabinogalactan, substituted versions thereof, derivatised versions thereof, and mixtures thereof. Substituted and/or derivatised materials of the fabric care polysaccharides listed hereinabove are also preferred in the present invention. Nonlimiting examples of these materials include: carboxyl and hydroxymethyl substitutions (e.g., some uronic acid instead of neutral sugar units); amino polysaccharides (amine substitution); cationic quatemized polysaccharides; $C_1$–$C_{18}$ alkylated polysaccharides; acetylated polysaccharide ethers; polysaccharides having amino acid residues attached (small fragments of glycoprotein); polysaccharides containing silicone moieties, and the like. Some hydrophobic derivatives of the polysaccharides help the polysaccharides maintaining the globular conformation.

A preferred class of fabric care polysaccharides suitable for use in the present invention include those that have the backbone comprising at least some, but preferably almost entirely of 1,3-β-glycosidic linkages, preferably branched, preferably with either side chains attached with 1,6-linkages or derivatised for better water solubility and/or to maintain the globular structure. The 1,6-linked branched polysaccharides with 1,3-β-linked backbone have higher water solubility and/or dispersibility than the non-branched polysaccharides, so that branched polysaccharides can be used at higher molecular weight ranges. Inserting other types of linkages, such as some 1,4-β linkages in the 1,3-β-linked backbone also improves the solubility of the polysaccharides. Nonlimiting examples of useful fabric care polysaccharides with 1,3-β-linked backbone include arabinogalactan, pachyman, curdlan, callose, paramylon, sceleroglucan, lentinan, lichenan, laminarin, szhizophyllan, grifolan, sclerotinia sclerotiorum glucan (SSG), Ompharia lapidescence glucan (OL-2), and mixtures thereof. Low molecular weight materials are preferred for polysaccharides with less or no branching, such as curdlan, while higher molecular weight materials for highly branched polysaccharides, such as arabinogalactan, can be used. Higher molecular weight polysaccharides with mixed 1,3-β and 1,4-β linkages, such as lichenan, can also be used.

A preferred fabric care branched polysaccharide with 1,3-β-linked backbone is arabinogalactan (also named as galactoarabinan or epsilon-galactan). Arabinogalactans are long, densely branched high-molecular weight polysaccharides. Arabinogalactan that is useful in the composition of the present invention has a molecular weight range of from about 5,000 to about 500,000, preferably from about 6,000 to about 250,000, more preferably from about 10,000 to about 150,000. These polysaccharides are highly branched, consisting of a galactan backbone with side-chains of galactose and arabinose units (consisting of β-galactopyranose, β-arabinofuranose, and β-arabinopyranose). The major source of arabinogalactan is the larch tree. The genus Larix (larches) is common throughout the world. Two main sources of larch trees are western larch (*Larix occidentalis*) in Western North America and Mongolian larch (*Larix dahurica*). Examples of other larches are eastern larch (*Larix laricina*) in eastern North America, European larch (*Larix dicidua*), Japanese larch (*Larix leptolepis*), and Siberian larch (*Larix siberica*). Most commercial arabinogalactan is produced from western larch, through a counter-current extraction process. Larch arabinogalactan is water soluble and is composed of arabinose and galactose units in about a 1:6 ratio, with a trace of uronic acid. Glycosyl linkage analysis of larch arabinogalactan is consistent with a highly branched structure comprising a backbone of 1,3-β-linked galactopyranose connected by 1,3-β-glycosidic linkages, comprised of 3,4,6-, 3,6-, and 3,4- as well as 3-linked residues. The molecular weights of the preferred fractions of larch arabinogalactan include one fraction in the range of from about 14,000 to about 22,000, mainly from about 16,000 to about 21,000, and the other in the range of from about 60,000 to about 500,000, mainly from about 80,000 to about 120,000. The fraction that has the average molecular weight of from about 16,000 to about 20,000 is highly preferred for use in direct applications to fabric, such as in spray-on products. The high molecular weight fraction (of about 100,000 molecular weight), as well as the low molecular weight fraction are suitable for use in processes that involve subsequent water treatments, such as, pre-soak, wash-added and/or rinse-added laundry processes and products. High grade larch arabinogalactan is composed of greater than about 98% arabinogalactan. Larch arabinogalactan and some of its derivatives, such as cationic derivatives are commercially available from Larex, Inc., St Paul, Minn.

Arabinogalactans are also present as minor, water-soluble components of softwoods such as hemlock, black spruce, parana pine, mugo pine, Douglas fir, incense cedar, juniper, and the sapwood of sugar maple. Many edible and inedible plants are also rich sources of arabinogalactans, mostly in glycoprotein form, bound to a protein spine of either threonine, proline, or serine ("arabinogalactan-protein"). These plants include leek seeds, carrots, radish, black gram beans, pear, maize, wheat, red wine, Italian ryegrass, tomatoes, ragweed, sorghum, bamboo grass, and coconut meat and milk. Many herbs with well established immune-enhancing properties, such as *Echinacea purpurea, Baptisia tintoria, Thuja occidentalis, Angelica acutiloba*, and *Curcuma longa* contain significant amounts of arabinogalactans. Small quantities of arabinogalactans also occur in other plants, such as, green coffee bean (sugar ratio about 2:5), centrosema seeds (sugar ratio about 1:13), and wheat flour (sugar ratio about 7:3). About 70% of the water solubles from soybean flour is an arabinogalactan with a sugar ratio of about 1:2.

Examples of other fabric care polysaccharides that have 1,3-β-linkage as a part of the backbone include: 1,3-β-xylan (from, e.g., *Pencillus dumetosus*), curdlen, a 1,3-β-glucan (from e.g., *Alcaligenes faecalis*), paramylon B, a 1,3-β-glucan (from, e.g., *Euglena gracilis*), lichenin, a (1,3),(1,4)-β-glucan (from various sources including *Cetraria islandica*), sceleroglucan, a (1,3),(1,6)-β-glucan (from, e.g., *Sclerotium rolfii*), and lentinen, a (1,3),(1,6)-β-glucan (from, e.g., *Lentinus edodes*). More details about these and other polysaccharides with 1,3-β-linked backbone are given in "Chemistry and Biology of (1→3)-β-Glucans", B. A. Stone and A. E. Clarke, La Trobe University Press, Victoria, Australia, 1992, pp. 68–71, and 82–83, incorporated herein by reference.

Substituted and/or derivatised materials of arabinogalactans are also preferred in the present invention. Nonlimiting examples of these materials include: carboxyl and hydroxymethyl substitutions (e.g., some uronic acid instead of neutral sugar units); amino polysaccharides (amine substitution); cationic quatemized polysaccharides; $C_1$–$C_{18}$ alkylated polysaccharides; acetylated polysaccharide ethers; polysaccharides having amino acid residues attached (small fragments of glycoprotein); polysaccharides containing silicone moieties. These substituted and/or derivatised polysaccharides can provide additional benefits, such as: amine substitution can bind and/or condense with oxidatively damaged regions of the fiber to rejuvenate aged fabrics; acetylated sugar ethers can serve as bleach activators in subsequent processes where hydrogen peroxide is present; polysaccharides having amino acid residues can improve delivery of fabric care benefits for fabrics containing proteinaceous fibers, e.g., wool and silk; and silicone-derivatised polysaccharides can provide additional fabric softness and lubricity. Examples of derivatised arabinogalactan include the 3-chloro-2-hydroxypropyltrimethyl ammonium chloride derivative, available from Larex, Inc and the arabinogalactan-proteins given hereinabove.

The 1,3-β-linked backbone of the fabric care polysaccharides of the present invention (as in 1,3-β-galactans, 1,3-β-D-mannans, 1,3-β-D-xylans and 1,3-β-D-glucans) has a pseudohelical conformation. As such, these polysaccharides have a backbone chain that is flexible and in aqueous solution, have a tendency to coil into a globular structure to substantially reduce their apparent dimension (gyration volume), as opposed to the backbone chain of 1,4-β-glucan which has an extended dimension. The polysaccharides with 1,3-β-linked backbone and extensive branching via 1,6-linkages, or polysaccharides with helical confirmation or polysaccharides with 1,6-linked backbone have added flexibility due to the "coiling" nature of the 1,6-linkages. In water these polysaccharides with 1,3-β-linked backbone and 1,6-branching, e.g., arabinogalactans, have a globular conformation with high flexibility to coil into compact, flexible and deformable microscopic particles. For example, an arabinogalactan having a nominal molecular weight of about 18,000 has a size (gyration length) of only from 5 nm to about 10 nm in dilute aqueous solutions. This structural feature of the globular polysaccharides with helical conformation and random coiling nature improves physical properties such as water-solubility, low viscosity and emulsification. Not to be bound by theory is believed that the globular, compact and flexible structural property and low viscosity of the fabric care polysaccharides with 1,3-β-linked backbone of the present invention, such as arabinogalactans, is important for providing the fabric care benefits, either via efficient deposition of the polysaccharide globules on the rough fabric surface or via appropriate fitting/filling of these globules in the openings and/or defective spaces on the fabric fiber surface, where they can orient itself to conform to the space available. Furthermore, it is believed that at low levels, these low molecular weight (about 10,000 to about 150,000) polysaccharide globules of the present invention can very effectively bond fibers and/or microfibrils together by "spot bonding". This way, the fabric care polysaccharide globules can provide many desired benefits such as: fabric strengthening, fabric wear resistance and/or reduction, wrinkle removal and/or reduction, fabric pilling prevention and/or reduction, fabric color maintenance and/or fading reduction, color restoration, fabric soiling reduction, fabric shape retention, fabric shrinkage reduction, and/or improving fabric feel/smoothness, scratchiness reduction, for different types of fabrics such as cellulosic (cotton, rayon, etc. ), wool, silk, and the like.

Polysaccharides with helical conformation, but not within the range of the molecular weight range specified above have different physical properties such as low solubility and gelling characteristics (e.g., starch, a high molecular weight 1,4-α-D-glucan).

The fabric care polysaccharides with globular structure of the present invention can provide at least some fabric care benefits to all types of fabrics, including fabrics made of natural fibers, synthetic fibers, and mixtures thereof. Nonlimiting examples of fabric types that can be treated with the fabric care compositions of the present invention, to obtain fabric care benefits include fabrics made of (1) cellulosic fibers such as cotton, rayon, linen, Tencel, (2) proteinaceous fibers such as silk, wool and related mammalian fibers, (3) synthetic fibers such as polyester, acrylic, nylon, and the like, (4) long vegetable fibers from jute, flax, ramie, coir, kapok, sisal, henequen, abaca, hemp and sunn, and (5) mixtures thereof. Other unanimated substrates and/or surfaces made with natural fibers and/or synthetic fibers, and/or materials, such as non-woven fabrics, paddings, carpets, paper, disposable products, films, foams, can also be treated with the fabric care polysaccharides with 1,3-β-linked backbone to improve their properties.

For specific applications, the composition can contain from about 0.001% to about 20% of fabric care polysaccharide with globular structure, preferably from about 0.01% to about 10%, more preferably from about 0.1% to about 5%, by weight of the usage composition. The present invention also relates to concentrated liquid or solid compositions, which are diluted to form compositions with the usage concentrations, for use in the "usage conditions". Concentrated compositions comprise a higher level of fabric care polysaccharide, typically from about 1% to about 99%, preferably from about 2% to about 65%, more preferably from about 3% to about 40%, by weight of the concentrated fabric care composition. Depending on the target fabric care benefit to be provided, the concentrated compositions should also comprise proportionally higher levels of the desired optional ingredients.

A typical composition to be dispensed from a sprayer contains a level of fabric care polysaccharide with globular structure of from about 0.01% to about 5%, preferably from about 0.05% to about 2%, more preferably from about 0.1% to about 1%, by weight of the usage composition.

Dryer-added compositions typically contain a level of fabric care polysaccharide with globular structure of from about 0.01% to about 40% by weight of the dryer-added compositions.

(b) Adjunct Fabric Care Oligosaccharides

An optional but preferred adjunct fabric care agent in the present invention is selected from the group consisting of oligosaccharides, especially mixtures of oligosaccharides, especially, isomaltooligosaccharides (IMO) (including mixtures), the individual components of said mixtures, substituted versions thereof, derivatised versions thereof, and mixtures thereof. The adjunct fabric fabric care oligosaccharides help to provide some fabric benefits, such as wrinkle removal and/or reduction, anti-pilling, anti-wear, fabric color maintenance, and overall appearance benefits, especially to cellulosic fibers/fabrics, such as cotton, rayon, ramie, jute, flax, linen, polynosic-fibers, Lyocell (Tencel®), polyester/cotton blends, other cotton blends, and the like, especially cotton, rayon, linen, polyester/cotton blends, and mixtures thereof.

Suitable adjunct fabric care oligosaccharides that are useful in the present invention include oligosaccharides with a degree of polymerization (DP) of from about 1 to about 15, preferably from about 2 to about 10, and wherein each monomer is selected from the group consisting of reducing sacchaiide containing 5 and/or 6 carbon atoms, including isomaltose, isomaltotriose, isomaltotetraose, isomaltooligosaccharide, fructooligosaccharide, levooligosaccharides, galactooligosaccharide, xylooligosaccharide, gentiooligosaccharides, disaccharides, glucose, fructose, galactose, xylose, mannose, arabinose, rhamnose, maltose, sucrose, lactose. maltulose, ribose, lyxose, allose, altrose, gulose, idose, talose, trehalose, nigerose, kojibiose, lactulose, oligosaccharides, maltooligosaccharides, trisaccharides, tetrasaccharides, pentasaccharides, hexasaccharides, oligosaccharides from partial hydrolysates of natural polysaccharide sources, and the like, and mixtures thereof, preferably mixtures of isomaltooligosaccharides, especially mixtures including isomaltooligosaccharides, comprising from about 3 to about 7 units of glucose, respectively, and which are linked by 1,2-α, 1,3-α, 1,4-α- and 1,6-α-linkages, and mixtures of these linkages. Oligosaccharides containing β-linkages are also preferred. Preferred oligosaccharides are acyclic and have at least one linkage that is not an α-1,4-glycosidic bond. A preferred oligosaccharide is a mixture containing IMO: from 0 to about 20 % by weight of glucose, from about 10 to about 65 % of isomaltose, from about 1% to about 45% of each of isomaltotriose, isomaltetraose and isomaltopentaose, from 0 to about 3 % of each of isomaltohexaose, isomaltoheptaose, isomaltooctaose and isomaltononaose, from about 0.2% to about 15% of each of isomaltohexaose and isomaltoheptaose, and from 0 to about 50 % by weight of said mixture being isomaltooligosaccharides of 2 to 7 glucose units and from 0 to about 10 % by weight of said mixture being isomaltooligosaccharides of about 7 to about 10 glucose units. Other nonlimiting examples of preferred acyclic oligosaccharides, with approximate content by weight percent, are:

| Isomaltooligosaccharide Mixture I | |
|---|---|
| Trisaccharides (maltotriose, panose, isomaltotriose) | 40–65% |
| Disaccharides (maltose, isomaltose) | 5–15% |
| Monosaccharide (glucose) | 0–20% |
| Higher branched sugars (4 < DP < 10) | 10–30% |
| **Isomaltooligosaccharide Mixture II** | |
| Trisaccharides (maltotriose, panose, isomaltotriose) | 10–25% |
| Disaccharides (maltose, isomaltose) | 10–55% |
| Monosaccharide (glucose) | 10–20% |
| Higher branched sugars (4 < DP < 10) | 5–10% |

-continued

| Isomaltooligosaccharide Mixture III | |
|---|---|
| Tetrasaccharides (stachyose) | 10–40% |
| Trisaccharides (raffinose) | 0–10% |
| Disaccharides (sucrose, trehalose) | 10–50% |
| Monosaccharide (glucose, fructose) | 0–10% |
| Other higher branched sugars (4 < DP < 10) | 0–5% |

Oligosaccharide mixtures are either prepared by enzymatic reactions or separated as natural products from plant materials. The enzymatic synthesis of oligosaccharides involves either adding monosaccharides, one at a time, to a di- or higher saccharide to produce branched oligosaccharides, or it can involve the degradation of polysaccharides followed by transfer of saccharides to branching positions. For instance, Oligosaccharide Mixtures I and II are prepared by enzymatic hydrolysis of starch to maltooligosaccharides, which are then converted to isomaltooligosaccharides by a transglucosidase reaction. Oligosaccharide Mixture III, for example, is a mixture of oligosaccharides isolated from soybean. Soybean oligosaccharides such as Mixture III, are of pure natural origin.

Cyclic oligosaccharides can also be useful in the fabric care composition of the present invention. Preferred cyclic oligosaccharides include α-cyclodextrin, β-cyclodextrin, γ-cyclodextrin, their branched derivatives such as glucosyl-α-cyclodextrin, diglucosyl-α-cyclodextrin, maltosyl-α-cyclodextrin, glucosyl-β-cyclodextrin, diglucosyl-β-cyclodextrin, and mixtures thereof. The cyclodextrins also provide an optional but very important benefit of odor control, and are disclosed more fully hereinbelow.

Substituted and/or derivatised materials of the oligosaccharides listed hereinabove are also preferred in the present invention. Nonlimiting examples of these materials include: carboxyl and hydroxymethyl substitutions (e.g., glucuronic acid instead of glucose); amino oligosaccharides (amine substitution, e.g., glucosamine instead of glucose); cationic quaternized oligosaccharides; $C_1$–$C_6$ alkylated oligosaccharides; acetylated oligosaccharide ethers; oligosaccharides having amino acid residues attached (small fragments of glycoprotein); oligosaccharides containing silicone moieties. These substituted and/or derivatised oligosaccharides can provide additional benefits, such as: carboxyl and hydroxymethyl substitutions can introduce readily oxidizable materials on and in the fiber, thus reducing the probability of the fiber itself being oxidized by oxidants, such as bleaches; amine substitution can bind and/or condense with oxidatively damaged regions of the fiber to rejuvenate agedI fabrics; acetylated sugar ethers can serve as bleach activators in subsequent processes where hydrogen peroxide is present; oligosaccharides having amino acid residues can improve delivery of fabric care benefits for fabrics containing proteinaceous fibers, e.g., wool and silk; and silicone-derivatised oligosaccharides can provide additional fabric softness and lubricity. $C_6$ alkyl oligosaccharide is disclosed (along with other higher, viz., $C_6$–$C_{30}$, alkyl polysaccharides) in U.S. Pat. No. 4,565,647, issued Jan. 21, 1986 to Llenado, for use as foaming agent in foaming compositions such as laundry detergents, personal and hair cleaning compositions, and fire fighting compositions. The $C_6$ alkyl oligosaccharide is a poor surfactant and not preferred for use as surfactant in the present invention, but preferably can be used to provide the fabric care benefits that are not known, appreciated and/or disclosed in U.S. Pat. No. 4,565,647. U.S. Pat. No. 4,488,981, issued Dec. 18, 1984 discloses the use of some $C_1$–$C_6$ alkylated oligosaccharides (lower alkyl glycosides) in aqueous liquid detergents to reduce their viscosity and to prevent phase separation. $C_1$–$C_6$ alkylated oligosaccharides can be used to provide the fabric care benefits that are not known, appreciated and/or disclosed in U.S. Pat. No. 4,488,981. These patents are incorporated herein by reference.

It is believed that the fabric care oligosaccharide is adsorbed and binds with cellulosic fabrics to improve the properties of the fabrics. It is believed that the fabric care oligosaccharide is bound to the cellulosic fibers, diffuses in and fills the defect sites (the amorphous region) of the fiber, to provide the above dewrinkling, increased strength and improved appearance benefits. The extent of the amorphous, non-crystalline region varies with cellulosic fiber types, e.g., the relative crystallinity of cotton is about 70.% and for regenerated cellulose, such as, rayon it is about 30.% , as reported by P. H. Hermans and A. Weidinger, "X-ray studies on the crystallinity of cellulose" in the *Journal of Polymer Science*, Vol IV, p135–144, 1949. It is believed that the amorphous regions are accessible for chemical and physical modifications, and that in the durable press treatment, the amorphous regions are filled with molecules that can crosslink cellulose polymers by covalent bonds, to deliver wrinkle-free benefits (cf. S. P. Rawland, in "Modified Cellulosics," R. M. Rowell and R. A. Young, Eds., Academic Press, New York, 1978, pp. 147–167, cited by G. C. Tesoro, in 'Crosslinking of cellulosics', Handbook of Fiber Science and Technology, Vol. 11, p. 6, edited by M. Lewin and S. B. Sello, published by Marcel Dekker, 1983. These publications are incorporated herein by reference.

For specific applications, the composition can contain from about 0.001% to about 20% of the optional, but preferred oligosaccharide, preferably from about 0.01% to about 10%, more preferably from about 0.1% to about 5%, by weight of the usage composition.

Typical composition to be dispensed from a sprayer contains a level of optional fabric care oligosaccharide of from about 0.01% to about 3%, preferably from about 0.05% to about 2%, more preferably from about 0.1% to about 1%, by weight of the usage composition.

Dryer-added compositions typically contain a level of optional fabric care oligosaccharide of from about 0.01% to about 40%, preferably from about 0.1% to about 20%, more preferably from about 1% to about 10%, by weight of the dryer-added compositions. Aqueous dryer-added compositions to be applied directly to the fabric, e.g., via a spraying mechanism, contain lower levels of fabric care polysaccharide, typically from about 0.01% to about 25%, preferably from about 0.1% to about 10%, more preferably from about 0.2% to about 5%, even more preferably from about 0.3% to about 3%, by weight of the compositions.

Both the primary fabric care polysaccharides and the adjunct fabric care oligosaccharides have a compact structure, but they have different sizes. The smaller oligosaccharides are believed to be able to diffuse and penetrate into small defective sites, such as the amorphous region of cotton fibers, while the larger polysaccharides can fill in larger openings and/or defective sites on the fabric fiber surface. Therefore depending on the fabric care benefit target, the primary fabric care polysaccharides and the adjunct fabric care polysaccharide can be used alone, or in mixtures. When the adjunct fabric care polysaccharide (e.g. oligosaccharides) are present, the weight ratio between said oligosaccharides and the fabric care polysaccharides is typically from about 1:99 to about 99:1, preferably from about 15:85 to about 85:15, and more preferably from about 30:70 to about 70:30.

(c) Starch

Starch is not normally preferred, since it makes the fabric resistant to deformation. However, it does provide increased "body" which is often desired. Starch is particularly preferred in compositions of this invention to be used with ironing. In addition, it has been observed that starches provide desirable in-wear wrinkle control when used in combination with one or more of the silicone surfactants described above. When used, starch is solubilized or dispersed in the composition.

Any type of starch, e.g. those derived from corn, wheat, rice, grain sorghum, waxy grain sorghum, waxy maize or tapioca, or mixtures thereof and water soluble or dispersible modifications or derivatives thereof, can be used in the composition of the present invention. Modified starches that can be used include natural starches that have been degraded to obtain a lower viscosity by acidic, oxidative or enzymatic depolymerization. Additionally, low viscosity commercially available propoxylated and/or ethoxylated starches are useable in the present composition and are preferred since their low viscosity at relatively high solids concentrations make them very adaptable to spraying processes. Suitable alkoxylated, low viscosity starches are submicron sized particles of hydrophobic starch that are readily dispersed in water and are prepared by alkoxylation of granular starch with a monofunctional alkoxylating agent which provides the starch with ether linked hydrophilic groups. A suitable method for their preparation is taught in U.S. Pat. No. 3,462,283. In accordance with the invention, the propoxylated or ethoxylated starch derivatives are dispersed in the aqueous medium in an amount of from about 0.1% to about 10%, preferably from about 0.5% to about 6%, more preferably from about 1% to about 4% by weight of the usage composition.

5. Perfume

The wrinkle control composition of the present invention can also optionally provide a "scent signal" in the form of a pleasant odor which provides a freshness impression to the treated fabrics. The scent signal can be designed to provide a fleeting perfume scent. When perfume is added as a scent signal, it is added only at very low levels, e.g., from about 0% to about 0.5%, preferably from about 0.003% to about 0.3%, more preferably from about 0.005% to about 0.2%, by weight of the usage composition.

Perfume can also be added as a more intense odor in product and on fabrics. When stronger levels of perfume are preferred, relatively higher levels of perfume can be added.

Any type of perfume can be incorporated into the composition of the present invention. The preferred perfume ingredients are those suitable for use to apply on fabrics and garments. Typical examples of such preferred ingredients are given in U.S. Pat. No. 5,445,747, issued Aug. 29, 1995 to Kvietok et al., incorporated herein by reference.

When long lasting fragrance odor on fabrics is desired, it is preferred to use at least an effective amount of perfume ingredients which have a boiling point of about 300° C. or higher. Nonlimiting examples of such preferred ingredients are given in U.S. Pat. No. 5,500,138, issued Mar. 19, 1996 to Bacon et al., incorporated herein by reference. It is also preferred to use materials that can slowly release perfume ingredients after the fabric is treated by the wrinkle control composition of this invention. Examples of materials of this type are given in U.S. Pat. No. 5,531,910, Sevems et al., issued Jul. 2, 1996, said patent being incorporated herein by reference.

When cyclodextrin is present, it is essential that the perfume be added at a level wherein even if all of the perfume in the composition were to complex with the cyclodextrin molecules when cyclodextrin is present, there will still be an effective level of uncomplexed cyclodextrin molecules present in the solution to provide adequate odor control. In order to reserve an effective amount of cyclodextrin molecules for odor control when cyclodextrin is present, perfume is typically present at a level wherein less than about 90% of the cyclodextrin complexes with the perfume, preferably less than about 50% of the cyclodextrin complexes with the perfume, more preferably, less than about 30% of the cyclodextrin complexes with the perfume, and most preferably, less than about 10% of the cyclodextrin complexes with the perfume. The cyclodextrin to perfume weight ratio should be greater than about 5:1 preferably greater than about 8:1, more preferably greater than about 10:1, even more preferably greater than about 20:1, still more preferably greater than 40:1 and most preferably greater than about 70:1.

Preferably the perfume is hydrophilic and is composed predominantly of ingredients selected from two groups of ingredients, namely, (a) hydrophilic ingredients having a ClogP of less than about 3.5, more preferably less than about 3.0, and (b) ingredients having significant low detection threshold, and mixtures thereof. Typically, at least about 50%, preferably at least about 60%, more preferably at least about 70%, and most preferably at least about 80% by weight of the perfume is composed of perfume ingredients of the above groups (a) and (b). For these preferred perfumes, the cyclodextrin to perfume weight ratio is typically of from about 2:1 to about 200:1; preferably from about 4:1 to about 100:1, more preferably from about 6:1 to about 50:1, and even more preferably from about 8:1 to about 30:1.

(a) Hydrophilic Perfume Ingredients

The hydrophilic perfume ingredients are more soluble in water, have less of a tendency to complex with the cyclodextrins, and are more available in the odor absorbing composition than the ingredients of conventional perfumes. The degree of hydrophobicity of a perfume ingredient can be correlated with its octanol/water partition coefficient P. The octanol/water partition coefficient of a perfume ingredient is the ratio between its equilibrium concentration in octanol and in water. A perfume ingredient with a greater partition coefficient P is considered to be more hydrophobic. Conversely, a perfume ingredient with a smaller partition coefficient P is considered to be more hydrophilic. Since the partition coefficients of the perfume ingredients normally have high values, they are more conveniently given in the form of their logarithm to the base 10, logP. Thus the preferred perfume hydrophilic perfume ingredients of this invention have logP of about 3.5 or smaller, preferably of about 3.0 or smaller.

The logP of many perfume ingredients have been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logp" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are used instead of the experimental logP values in the selection of perfume ingredients which are useful in the present invention.

Non-limiting examples of the more preferred hydrophilic perfume ingredients are allyl amyl glycolate, allyl caproate, amyl acetate, amyl propionate, anisic aldehyde, anisyl acetate, anisole, benzaldehyde, benzyl acetate, benzyl acetone, benzyl alcohol, benzyl formate, benzyl iso valerate, benzyl propionate, beta gamma hexenol, calone, camphor gum, laevo-carveol, d-carvone, laevo-carvone, cinnamic alcohol, cinnamyl acetate, cinnamic alcohol, cinnamyl formate, cinnamyl propionate, cis-jasmone, cis-3-hexenyl acetate, coumarin, cuminic alcohol, cuminic aldehyde, Cyclal C, cyclogalbanate, dihydroeuginol, dihydro isojasmonate, dimethyl benzyl carbinol, dimethyl benzyl carbinyl acetate, ethyl acetate, ethyl aceto acetate, ethyl amyl ketone, ethyl anthranilate, ethyl benzoate, ethyl butyrate, ethyl cinnamate, ethyl hexyl ketone, ethyl maltol, ethyl-2-methyl butyrate, ethyl methylphenyl glycidate, ethyl phenyl acetate, ethyl salicylate, ethyl vanillin, eucalyptol, eugenol, eugenyl acetate, eugenyl formate, eugenyl methyl ether, fenchyl alcohol, flor acetate (tricyclo decenyl acetate), fructone, frutene (tricyclo decenyl propionate), geraniol, geranyl oxyacetaldehyde, heliotropin, hexenol, hexenyl acetate, hexyl acetate, hexyl formate, hinokitiol, hydrotropic alcohol, hydroxycitronellal, hydroxycitronellal diethyl acetal, hydroxycitronellol, indole, isoamyl alcohol, iso cyclo citral, isoeugenol, isoeugenyl acetate, isomenthone, isopulegyl acetate, isoquinoline, keone, ligustral, linalool, linalool oxide, linalyl formate, lyral, menthone, methyl acetophenone, methyl amyl ketone, methyl anthranilate, methyl benzoate, methyl benzyl acetate, methyl cinnamate, methyl dihydrojasmonate, methyl eugenol, methyl heptenone, methyl heptine carbonate, methyl heptyl ketone, methyl hexyl ketone, methyl isobutenyl tetrahydropyran, methyl-N-methyl anthranilate, methyl beta naphthyl ketone, methyl phenyl carbinyl acetate, methyl salicylate, nerol, nonalactone, octalactone, octyl alcohol (octanol-2), para-anisic aldehyde, para-cresol, para-cresyl methyl ether, para hydroxy phenyl butanone, para-methoxy acetophenone, para-methyl acetophenone, phenoxy ethanol, phenoxyethyl propionate, phenyl acetaldehyde, phenylacetaldehyde diethyl ether, phenylethyl oxyacetaldehyde, phenyl ethyl acetate, phenyl ethyl alcohol, phenyl ethyl dimethyl carbinol, prenyl acetate, propyl butyrate, pulegone, rose oxide, safrole, terpineol, vanillin, viridine, and mixtures thereof.

Nonlimiting examples of other preferred hydrophilic perfume ingredients which can be used in perfume compositions of this invention are allyl heptoate, amyl benzoate, anethole, benzophenone, carvacrol, citral, citronellol, citronellyl nitrile, cyclohexyl ethyl acetate, cymal, 4-decenal, dihydro isojasmonate, dihydro myrcenol, ethyl methyl phenyl glycidate, fenchyl acetate, florhydral, gamma-nonalactone, geranyl formate, geranyl nitrile, hexenyl isobutyrate, alpha-ionone, isobomyl acetate, isobutyl benzoate, isononyl alcohol, isomenthol, para-isopropyl phenylacetaldehyde, isopulegol, linalyl acetate, 2-methoxy naphthalene, menthyl acetate, methyl chavicol, musk ketone, beta naphthol methyl ether, neral, nonyl aldehyde, phenyl heptanol, phenyl hexanol, terpinyl acetate, Veratrol, yara-yara, and mixtures thereof.

The preferred perfume compositions used in the present invention contain at least 4 different hydrophilic perfume ingredients, preferably at least 5 different hydrophilic perfume ingredients, more preferably at least 6 different hydrophilic perfume ingredients, and even more preferably at least 7 different hydrophilic perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

(b) Low Odor Detection Threshold Perfume Ingredients

The odor detection threshold of an odorous material is the lowest vapor concentration of that material which can be olfactorily detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978, both of said publications being incorporated by reference. The use of small amounts of perfume ingredients that have low odor detection threshold values can improve perfume odor character, even though they are not as hydrophilic as perfume ingredients of group (a) which are given hereinabove. Perfume ingredients that do not belong to group (a) above, but have a significantly low detection threshold, useful in the composition of the present invention, are selected from the group consisting of ambrox, bacdanol, benzyl salicylate, butyl anthranilate, cetalox, damascenone, alpha-damascone, gamma-dodecalactone, ebanol, herbavert, cis-3-hexenyl salicylate, alpha-ionone, beta-ionone, alpha-isomethylionone, lilial, methyl nonyl ketone, gamma-undecalactone, undecylenic aldehyde, and mixtures thereof. These materials are preferably present at low levels in addition to the hydrophilic ingredients of group (a), typically less than about 20%, preferably less than about 15%, more preferably less than about 10%, by weight of the total perfume compositions of the present invention. However, only low levels are required to provide an effect.

There are also hydrophilic ingredients of group (a) that have a significantly low detection threshold, and are especially useful in the composition of the present invention. Examples of these ingredients are allyl amyl glycolate, anethole, benzyl acetone, calone, cinnamic alcohol, coumarin, cyclogalbanate, Cyclal C, cymal, 4-decenal, dihydro isojasmonate, ethyl anthranilate, ethyl-2-methyl butyrate, ethyl methylphenyl glycidate, ethyl vanillin, eugenol, flor acetate, florhydral, fructone, frutene, heliotropin, keone, indole, iso cyclo citral, isoeugenol, lyral, methyl heptine carbonate, linalool, methyl anthranilate, methyl dihydrojasmonate, methyl isobutenyl tetrahydropyran, methyl beta naphthyl ketone, beta naphthol methyl ether, nerol, para-anisic aldehyde, para hydroxy phenyl butanone, phenyl acetaldehyde, vanillin, and mixtures thereof. Use of low odor detection threshold perfume ingredients minimizes the level of organic material that is released into the atmosphere.

6. Antimicrobial Active

Optionally, but preferably, solubilized, water-soluble, antimicrobial preservative can be added to the composition of the present invention because these aqueous products may be prime breeding grounds for certain microorganisms, especially when in aqueous compositions. This drawback can lead to the problem of storage stability of these solutions for any significant length of time. Contamination by certain microorganisms with subsequent microbial growth can result in an unsightly and/or malodorous solution. Because microbial growth in aqueous solutions is highly objectionable when it occurs, it is highly preferable to include a solubilized, water-soluble, antimicrobial preservative, which is effective for inhibiting and/or regulating microbial growth in order to increase storage stability of the preferably clear, aqueous consumer products such as the subject product of this patent.

Typical microorganisms that can be found in raw materials for these products and whose growth can be found in the resulting aqueous solutions include bacteria, both Gram (−) and (+). Gram (−) contaminants may include species such as *Escherichia coli* and *Pseudomonas aeruginosa* which may be found in some water sources, and can be introduced during the preparation of these solutions. Other Pseudomonas species, such as *P. cepacia*, are typical microbial contaminants in surfactant manufacturing facilities and may readily contaminate packed finished products. Typical other Gram (−) bacterial contaminants may include Burkholderia, Enterobacter and Gluconobacter species,. Gram (+) species may include Bacillus species e.g. *B. cereus* and *B. sphaericus*; and may also include other Gram (+) such as Staphylococcus species, e.g. *S. aureus*.

Fungal contaminants may include Aspergillus species.

Therefore, it is preferable to use a broad spectrum preservative, e.g., one that is effective on both bacteria (both gram positive and gram negative) and fungi. A limited spectrum preservative, e.g., one that is only effective on a single group of microorganisms, e.g., fungi, can be used in combination with a broad spectrum preservative or other limited spectrum preservatives with complimentary and/or supplementary activity. A mixture of broad spectrum preservatives can also be used. In some cases where a specific group of microbial contaminants is problematic (such as Gram negatives), aminocarboxylate chelators, such as those described hereinbefore, can be used alone or as potentiators in conjunction with other preservatives. These chelators which include, e.g., ethylenediaminetetraacetic acid (EDTA), hydroxyethylenediaminetriacetic acid, diethylenetriaminepentaacetic acid (DTPA), and other aminocarboxylate chelators, and mixtures thereof, and their salts including phosphonates, and mixtures thereof, can increase preservative effectiveness against Gram-negative bacteria, especially Pseudomonas species.

Antimicrobial preservatives useful in the present invention include biocidal compounds, i.e., substances that kill microorganisms, or biostatic compounds, i.e., substances that inhibit and/or regulate the growth of microorganisms. Preferred antimicrobial preservatives are those that are water-soluble and are effective at low levels. Water-soluble preservatives useful in the present invention are those that have a solubility in water of at least about 0.3 g per 100 ml of water, i.e., greater than about 0.3% at room temperature, preferably greater than about 0.5% at room temperature.

The water-soluble antimicrobial preservative in the present invention is included at an effective amount. The term "effective amount" as herein defined means a level sufficient to prevent spoilage, or prevent growth of inadvertently added microorganisms in the packaged product, for a specific period of time. In other words, the preservative is not being used to kill microorganisms on the surface onto which the composition is deposited. Instead, it is preferably being used to prevent spoilage of the product solution in order to increase the shelf-life of the composition. Preferred levels of preservative are from about 0.0001% to about 0.5%, more preferably from about 0.0002% to about 0.2%, most preferably from about 0.0003% to about 0.1%, by weight of the usage composition.

The preservative can be any organic preservative material which will not cause damage to fabric appearance, e.g., discoloration, coloration, bleaching. Preferred water-soluble preservatives include organic sulfur compounds, halogenated compounds, cyclic organic nitrogen compounds, low molecular weight aldehydes, quaternary ammonium acompounds, dehydroacetic acid, phenyl and phenolic compounds, alcoholic solvents and mixtures thereof.

The following are non-limiting examples of preferred water-soluble preservatives for use in the present invention. A more complete list is found in U.S. Pat. No. 5,714,137, incorporated hereinbefore by reference.

(a) Organic Sulfur Compounds

Preferred water-soluble preservatives for use in the present invention are organic sulfur compounds. Some non-limiting examples of organic sulfur compounds suitable for use in the present invention are:

(i) 3-Isothiazolone Compounds

A preferred preservative is an antimicrobial, organic preservative containing 3-isothiazolone groups. This class of compounds is disclosed in U.S. Pat. No. 4,265,899, Lewis et al., issued May 5, 1981, and incorporated herein by reference. A preferred preservative is a water-soluble mixture of 5-chloro-2-methyl-4-isothiazolin-3-one and 2-methyl-4-isothiazolin-3-one, more preferably a mixture of about 77% 5-chloro-2-methyl-4-isothiazolin-3-one and about 23% 2-methyl-4-isothiazolin-3-one, a broad spectrum preservative available as a 1.5% aqueous solution under the trade name Kathon® CG by Rohm and Haas Company.

When Kathon® is used as the preservative in the present invention it is present at a level of from about 0.0001% to about 0.01%, preferably from about 0.0002% to about 0.005%, more preferably from about 0.0003%!/o to about 0.003%, most preferably from about 0.0004% to about 0.002%, by weight of the composition.

Other isothiazolins include 1,2-benzisothiazolin-3-one, available under the trade name Proxel® products; and 2-methyl-4,5-trimethylene-4-isothiazolin-3-one, available under the trade name Promexal®. Both Proxel and Promexal are available from Zeneca. They have stability over a wide pH range (i.e., 4–12). Neither contain active halogen and are not formaldehyde releasing preservatives. Both Proxel and Promexal are effective against typical Gram negative and positive bacteria, fungi and yeasts when used at a level from about 0.001% to about 0.5%, preferably from about 0.005% to about 0.05%, and most preferably from about 0.01% to about 0.02% by weight of the usage composition.

(ii) Sodium Pyrithione

Another preferred organic sulfur preservative is sodium pyrithione, with water solubility of about 50%. When sodium pyrithione is used as the preservative in the present invention it is typically present at a level of from about 0.0001% to about 0.01%, preferably from about 0.0002% to about 0.005%, more preferably from about 0.0003% to about 0.003%, by weight of the usage composition.

Mixtures of the preferred organic sulfur compounds can also be used as the preservative in the present invention.

(b) Halogenated Compounds

Preferred preservatives for use in the present invention are halogenated compounds. Some non-limiting examples of halogenated compounds suitable for use in the present invention are:

5-bromo-5-nitro-1,3-dioxane, available under the trade name Bronidox L® from Henkel. Bronidox L® has a solubility of about 0.46% in water. When Bronidox is used as the preservative in the present invention it is typically present at a level of from about 0.0005% to about 0.02%, preferably from about 0.001% to about 0.01%, by weight of the usage composition;

2-bromo-2-nitropropane-1,3-diol, available under the trade name Bronopol® from Inolex can be used as the preservative in the present invention. Bronopol has a solubility of about 25% in water. When Bronopol is used as the preservative in the present invention it is typically present at a level of from about 0.002% to about 0.1%, preferably from about 0.005% to about 0.05%, by weight of the usage composition;

1,1'-hexamethylene bis(5-(p-chlorophenyl)biguanide), commonly known as chlorhexidine, and its salts, e.g., with acetic and gluconic acids can be used as a preservative in the present invention. The digluconate salt is highly water-soluble, about 70% in water, and the diacetate salt has a solubility of about 1.8% in water. When chlorhexidine is used as the preservative in the present invention it is typically present at a level of from about 0.0001% to about 0.04%, preferably from about 0.0005% to about 0.01%, by weight of the usage composition.

1,1,1-Trichloro-2-methylpropan-2-ol, commonly known as chlorobutanol, with water solubility of about 0.8%; a typical effective level of chlorobutanol is from about 0.1% to about 0.5%, by weight of the usage composition.

4,4'-(Trimethylenedioxy)bis-(3-bromobenzamidine) diisethionate, or dibromopropamidine, with water solubility of about 50%; when dibromopropamidine is used as the preservative in the present invention it is typically present at a level of from about 0.0001% to about 0.05%, preferably from about 0.0005% to about 0.01% by weight of the usage composition.

Mixtures of the preferred halogenated compounds can also be used as the preservative in the present invention.

(c) Cyclic Organic Nitrogen Compounds

Preferred water-soluble preservatives for use in the present invention are cyclic organic nitrogen compounds. Some non-limiting examples of cyclic organic nitrogen compounds suitable for use in the present invention are:

(i) Imidazolidinedione Compounds

Preferred preservatives for use in the present invention are imidazolidione compounds. Some non-limiting examples of imidazolidinedione compounds suitable for use in the present invention are:

1,3-bis(hydroxymethyl)-5,5-dimethyl-2,4-imidazolidinedione, commonly known as dimethyloldimethylhydantoin, or DMDM hydantoin, available as, e.g., Glydant® from Lonza. DMDM hydantoin has a water solubility of more than 50% in water, and is mainly effective on bacteria. When DMDM hydantoin is used, it is preferable that it be used in combination with a broad spectrum preservative such as Kathon CG®, or formaldehyde. A preferred mixture is about a 95:5 DMDM hydantoin to 3-butyl-2-iodopropynylcarbamate mixture, available under the trade name Glydant Plusg from Lonza. When Glydant Plus® is used as the preservative in the present invention, it is typically present at a level of from about 0.005% to about 0.2% by weight of the usage composition;

N-[1,3-bis(hydroxymethyl)2,5-dioxo-4-imidazolidinyl]-N,N'-bis(hydroxymethyl) urea, commonly known as diazolidinyl urea, available under the trade name Germall II® from Sutton Laboratories, Inc. (Sutton) can be used as the preservative in the present invention. When Germall II® is used as the preservative in the present invention, it is typically present at a level of from about 0.01% to about 0.1% by weight of the usage composition;

N,N"-methylenebis {N'-[1-(hydroxymethyl)-2,5-dioxo-4-imidazolidinyl]urea}, commonly known as imidazolidinyl urea, available, e.g., under the trade name Abiol® from 3V-Sigma, Unicide U-13® from Induchem, Germall 115® from (Sutton) can be used as the preservative in the present invention. When imidazolidinyl urea is used as the preservative, it is typically present at a level of from about 0.05% to about 0.2%, by weight of the usage composition.

Mixtures of the preferred imidazolidinedione compounds can also be used as the preservative in the present invention.

(ii) Polymethoxy Bicyclic Oxazolidine

Another preferred water-soluble cyclic organic nitrogen preservative is polymethoxy bicyclic oxazolidine, available under the trade name Nuosept® C from Huils America. When Nuosept® C is used as the preservative, it is typically present at a level of from about 0.005% to about 0.1%, by weight of the usage composition.

Mixtures of the preferred cyclic organic nitrogen compounds can also be used as the preservative in the present invention.

(d) Low Molecular Weight Aldehydes and Alcohols (i) Formaldehyde

A preferred preservative for use in the present invention is formaldehyde. Formaldehyde is a broad spectrum preservative which is normally available as formalin which is a 37% aqueous solution of formaldehyde. When formaldehyde is used as the preservative in the present invention, typical levels are from about 0.003% to about 0.2%, preferably from about 0.008% to about 0.1%. more preferably from about 0.01% to about 0.05%, by weight of the usage composition.

(ii) Glutaraldehyde

A preferred preservative for use in the present invention is glutaraldehyde. Glutaraldehyde is a water-soluble, broad spectrum preservative commonly available as a 25% or a 50% solution in water. When glutaraldehyde is used as the preservative in the present invention it is typically present at a level of from about 0.005% to about 0.1%, preferably from about 0.01% to about 0.05%, by weight of the usage composition.

(iii) Ethanol

A preferred potentiator or preservative enhancer in this invention may be an alcohol, such as ethanol, an effective amount of solvent, preferably from about 1% to about 15%, more preferably from about 1% to about 10%, most preferably from about 1% to about 5%, by weight of the composition to assist in the drying of the spray product during use and for increased efficacy of the preservative system in the bottled product.

(e) Ouaternary Compounds

Preferred preservatives for use in the present invention are cationic and/or quaternary compounds. Such compounds include polyaminopropyl biguanide, also known as polyhexamethylene biguanide having the general formula:

$$HCl.NH_2—(CH_2)_3—[—(CH_2)_3—NH—C(=NH)—NH—C(=NH.HCl)—NH—(CH_2)_3—]_x—(CH_2)_3—NH—C(=NH)—NH.CN$$

Polyaminopropyl biguanide is a water-soluble, broad spectrum preservative which is available as a 20% aqueous solution available under the trade name Cosmocil CQ® from ICI Americas, Inc., or under the trade name Mikrokill® from Brooks, Inc.

1-(3-Chlorallyl)-3,5,7-triaza-1-azoniaadamantane chloride, available, e.g., under the trade name Dowicil 200 from Dow Chemical, is an effective quaternary ammonium preservative. It is freely soluble in water, however, it has a tendency to discolor (yellow), and therefore it is not highly preferred.

Mixtures of the preferred quaternary ammonium compounds can also be used as the preservative in the present invention.

When quaternary ammonium compounds are used as the preservative in the present invention, they are typically present at a level of from about 0.005% to about 0.2%, preferably from about 0.01% to about 0.1%, by weight of the usage composition.

(f) Dehydroacetic Acid

A preferred preservative for use in the present invention is dehydroacetic acid. Dehydroacetic acid is a broad spectrum preservative preferably in the form of a sodium or a potassium salt so that it is water-soluble. This preservative acts more as a biostatic preservative than a biocidal preservative. When dehydroacetic acid is used as the preservative it is typically used at a level of from about 0.005% to about 0.2%, preferably from about 0.008% to about 0.1%, more preferably from about 0.01% to about 0.05%, by weight of the usage composition.

(g) Phenyl and Phenolic Compounds

Some non-limiting examples of phenyl and phenolic compounds suitable for use in the present invention are:

4,4'-diamidino-α,ω)-diphenoxypropane diisethionate, commonly known as propamidine isethionate, with water solubility of about 16%; and 4,4'-diamidino-α,ω-diphenoxyhexane diisethionate, commonly known as hexamidine isethionate. Typical effective level of these salts is about 0.0002% to about 0.05% by weight of the usage composition.

Other examples are benzyl alcohol, with a water solubility of about 4%; 2-phenylethanol, with a water solubility of about 2%; and 2-phenoxyethanol, with a water solubility of about 2.67%; typical effective level of these phenyl and phenoxy alcohol is from about 0.1% to about 0.5%, by weight of the usage composition.

(h) Mixtures thereof

The preservatives of the present invention can be used in mixtures in order to control a broad range of microorganisms.

Bacteriostatic effects can sometimes be obtained for aqueous compositions by adjusting the composition pH to an acid pH, e.g., less than about pH 4, preferably less than about pH 3, or a basic pH, e.g., greater than about 10, preferably greater than about 11. Low pH is a suitable approach in the present invention because the low pH may minimize the potential of bacterial contamination. High pH 10, preferably greater than about 11, also may minimize bacterial and antimicrobial contamination, but is not preferred when optional cyclodextrin is present since the cyclodextrin will be ionized and this will render it less effective to complexing some odor molecules. High pH's can also lead to skin irritaiton. Therefore, aqueous compositions of the present invention should have a pH of from about 3 to about 6, preferably from about 4 to about 6, more preferably from about 4. 5 to about 6. The pH is typically adjusted with inorganic molecules such as (HCl) or NaOH.

7. Aminocarboxylate Chelator

Chelators, e.g., ethylenediaminetetraacetic acid (EDTA), hydroxyethylene-diaminetriacetic acid, diethylenetriamine-pentaacetic acid (DTPA also known commercially as Dequest 2060), aminotri(methylenphosphonic aicd) penta sodium salt (known commerically as Dequest 2006), and other aminocarboxylate chelators, and mixtures thereof, and their salts and phosphonates, and mixtures thereof, can optionally be used to increase antimicrobial and preservative effectiveness against Gram-negative bacteria, especially Pseudomonas species. Although sensitivity to EDTA/DTPA and other aminocarboxylate chelators is mainly a characteristic of Pseudomonas species, other bacterial species highly susceptible to chelators include Achromobacter, Alcaligenes, Azotobacter, Escherichia, Salmonella, Spirillum, and Vibrio. Other groups of organisms also show increased sensitivities to these chelators, including fungi and yeasts. Furthermore, aminocarboxylate chelators can help, e.g., maintaining product clarity, protecting fragrance and perfume components, and preventing rancidity and off odors.

Although these aminocarboxylate chelators may not be potent biocides in their own right, they function as potentiators for improving the performance of other antimicrobials/preservatives in the compositions of the present invention. Aminocarboxylate chelators can potentiate the performance of many of the cationic, anionic, and nonionic antimicrobials/preservatives, phenolic compounds, and isothiazolinones, that are used as antimicrobials/preservatives in the composition of the present invention. Nonlimiting examples of cationic antimicrobials/preservatives potentiated by aminocarboxylate chelators in solutions are chlorhexidine salts (including digluconate, diacetate, and dihydrochloride salts), and Quatemium-15, also known as Dowicil 200, Dowicide Q, Preventol D1, benzalkonium chloride, cetrimonium, myristalkonium chloride, cetylpyridinium chloride, lauryl pyridinium chloride, and the like. Nonlimiting examples of useful anionic antimicrobials/preservatives which are enhanced by aminocarboxylate chelators are sorbic acid and potassium sorbate.

Nonlimiting examples of useful nonionic antimicrobials/preservatives which are potentiated by aminocarboxylate chelators are DMDM hydantoin, phenethyl alcohol, monolaurin, imidazolidinyl urea, and Bronopol (2-bromo-2-nitropropane-1,3-diol).

Examples of useful phenolic antimicrobials/preservatives potentiated by these chelators are chloroxylenol, phenol, tert-butyl hydroxyanisole, salicylic acid, resorcinol, and sodium o-phenyl phenate. Nonlimiting examples of isothiazolinone antimicrobials/preservatives which are enhanced by aminocarboxylate chelators are Kathon, Proxel and Promexal.

The optional chelators are present in the compositions of this invention at levels of, typically, from about 0.01% to about 0.3%, more preferably from about 0.02% to about 0.1%, most preferably from about 0.02% to about 0.05% by weight of the usage compositions to provide antimicrobial efficacy in this invention.

Free, uncomplexed aminocarboxylate chelators are required to potentiate the efficacy of the antimicrobials. Thus, when excess alkaline earth (especially calcium and magnesium) and transitional metals (iron, manganese, copper, and others) are present, free chelators are not available and antimicrobial potentiation is not observed. In the case where significant water hardness or transitional metals are available or where product esthetics require a specified chelator level, higher levels may be required to allow for the availability of free, uncomplexed aminocarboxylate chelators to function as antimicrobial/preservative potentiators.

8. Other Optional Ingredients

The composition of the present invention can optionally contain other adjunct odor-controlling materials, chelating agents, additional antistatic agents if more static control is desired, insect and moth repelling agents, colorants, especially bluing agents, viscosity control agents, and mixtures thereof in addition to the antiwrinkle ingredients, e.g., polymers. The total level of optional ingredients is preferably less than about 10%, more preferably less than about 5% even more preferably less than about 3%, and still more preferably less than about 2%, by weight of the usage composition. These optional ingredients exclude the other ingredients specifically mentioned hereinbefore. Incorporating adjunct odor-controlling materials can enhance the capacity of the cyclodextrin to control odors as well as broaden the range of odor types and molecule sizes which can be controlled. Such materials include, for example, the metallic salts described hereinbefore, water-soluble cationic and anionic polymers in addition to those already disclosed, zeolites as discussed hereinbefore, water-soluble bicarbonate salts, and mixtures thereof. Other optional materials are salts for viscosity control, antistatic agents, insect or moth repelling agent, optional colorant, optional anti-clogging agent, and mixtures thereof of optional ingredients.

(a) Optional Water-Soluble Polyionic Polymers

Some water-soluble polyionic polymers, e.g., water-soluble cationic polymer and water-soluble anionic polymers in addition to those discussed hereinbefore, can be used in the composition of the present invention to provide additional odor control benefits.

(i) Cationic polymers, e.g., polvamines

Water-soluble cationic polymers, e.g., those containing amino functionalities, amido functionalities, and mixtures thereof, are useful in the present invention to control certain acid-type odors.

(ii) Anionic polymers. e.g., polyacrylic acid

Water-soluble anionic polymers in addition to those described hereinbefore, e.g., polyacrylic acids and their water-soluble salts are useful in the present invention to control certain amine-type odors. Preferred polyacrylic acids and their alkali metal salts have an average molecular weight of less than about 20,000, more preferably less than 10,000, even more preferably from about 500 to about 5,000. Added polymers must not cause the composition to exceed acceptable limits on the Trouton's ratio. Salts are useful viscosity control agents, as disclosed below to use together with polymers to control the Trouton's ratio, if necessary. Polymers containing sulfonic acid groups, phosphoric acid groups, phosphonic acid groups, and their water-soluble salts, and mixtures thereof, and mixtures with carboxylic acid and carboxylate groups, are also suitable. Cross-linked polymers are also useful.

Water-soluble polymers containing both cationic and anionic functionalities are also suitable. Examples of these polymers are given in U.S. Pat. No. 4,909,986, issued Mar. 20, 1990 to N. Kobayashi and A. Kawazoe, incorporated herein by reference. Another example of water-soluble polymers containing both cationic and anionic functionalities is a copolymer of dimethyldiallyl ammonium chloride and acrylic acid, commercially available under the trade name Merquat 280® from Calgon.

When a water-soluble polymer is used it is typically present at a level of from about 0.001% to about 3%, preferably from about 0.005% to about 2%, more preferably from about 0.01% to about 1%, and even more preferably from about 0.05% to about 0.5%, by weight of the usage composition.

(b) Optional Antistatic Agents

The composition of the present invention can optionally contain additional effective amounts of other antistatic agent to provide the treated clothes with in-wear static. Preferred antistatic agents are those that are water soluble in at least an effective amount, such that the composition remains a clear solution. Examples of these antistatic agents are monoalkyl cationic quaternary ammonium compounds, e.g., mono ($C_{10}$–$C_{14}$ alkyl)trimethyl ammonium halide, such as monolauryl trimethyl ammonium chloride, hydroxycetyl hydroxyethyl dimethyl ammonium chloride, available under the trade name Dehyquart E® from Henkel, and ethyl bis(polyethoxy ethanol) alkylammonium ethylsulfate, available under the trade name Variquat 66® from Witco Corp., polyethylene glycols, polymeric quaternary ammonium salts, such as polymers conforming to the general formula:

$$-[N(CH_3)_2-(CH_2)_3-NH-CO-NH-(CH_2)_3-N(CH_3)_2^+-CH_2CH_2OCH_2CH_2]-_x^{2+}2x[Cl^-]$$

available under the trade name Mirapol A-15® from Rhone-Poulenc, and $$-[N(CH_3)_2-(CH_2)_3-NH-CO-(CH_2)_4-CO-NH-(CH_2)_3-N(CH_3)_2-(CH_2CH_2OCH_2CH_2]-_x^{+}x[Cl^-],$$

available under the trade name Mirapol AD-1® from Rhône-Poulenc, quaternized polyethyleneimines, vinylpyrrolidone/methacrylamidopropyltrimethylammonium chloride copolymer, available under the trade name Gafquat HS-100® from GAF; triethonium hydrolyzed collagen ethosulfate, available under the trade name Quat-Pro E® from Maybrook; neutralized sulfonated polystyrene, available, e.g., under the trade name Versa TL-130® from Alco Chemical, neutralized sulfonated styrene/maleic anhydride copolymers, available, e.g., under the trade name Versa TL-4® from Alco Chemical; and mixtures thereof.

It is preferred that a no foaming, or low foaming, agent is used, to avoid foam formation during fabric treatment. It is also preferred that polyethoxylated agents such as polyethylene glycol or Variquat 66® are not used when alpha-cyclodextrin is used. The polyethoxylate groups have a strong affinity to, and readily complex with, alpha-cyclodextrin which in turn depletes the uncomplexed cyclodextrin available for odor control.

When an antistatic agent is used it is typically present at a level of from about 0.05% to about 10%, preferably from about 0.1% to about 5%, more preferably from about 0.3% to about 3%, by weight of the usage composition.

(c) Optional Insect and/or Moth Repelling Agent

The composition of the present invention can optionally contain an effective amount of insect and/or moth repelling agents. Typical insect and moth repelling agents are pheromones, such as anti-aggregation pheromones, and other natural and/or synthetic ingredients. Preferred insect and moth repellent agents useful in the composition of the present invention are perfume ingredients, such as citronellol, citronellal, citral, linalool, cedar extract, geranium oil, sandalwood oil, 2-(diethylphenoxy)ethanol, 1-dodecene, etc. Other examples of insect and/or moth repellents useful in the composition of the present invention are disclosed in U.S. Pat. Nos. 4,449,987; 4,693,890; 4,696,676; 4,933,371; 5,030,660; 5,196,200; and in "Semio Activity of Flavor and Fragrance Molecules on Various Insect Species", B. D. Mookherjee et al., published in *Bioactive Volatile Compounds from Plants*, ASC Symposium Series 525, R. Teranishi, R. G. Buttery, and H. Sugisawa, 1993, pp. 35–48, all of said patents and publications being incorporated herein by reference. When an insect and/or moth repellent is used it is typically present at a level of from about 0.005% to about 3%, by weight of the usage composition.

(d) Optional Colorant

Colorants and dyes, especially bluing agents, can be optionally added to the wrinkle control compositions for visual appeal and performance impression. When colorants are used, they are used at extremely low levels to avoid fabric staining. Preferred colorants for use in the present compositions are highly water-soluble dyes, e.g., Liquitint® dyes available from Milliken Chemical Co. Non-limiting examples of suitable dyes are, Liquitint Blue HP®, Liquitint Blue 65®, Liquitint Patent Blue®, Liquitint Royal Blue®, Liquitint Experimental Yellow 8949-43®, Liquitint Green HMC®, Liquitint Yellow II®, and mixtures thereof, preferably Liquitint Blue HP®, Liquitint Blue 65®, Liquitint Patent Blue®, Liquitint Royal Blue®, Liquitint Experimental Yellow 8949-43®, and mixtures thereof.

(e) Optional Anti-Clogging Agent Optional anti-clogging agent which enhances the wetting and anti-clogging properties of the composition, especially when starch is present, is chosen from the group of polymeric glycols of alkanes and olefins having from 2 to about 6, preferably 2 carbon atoms. The anti-clogging agent inhibits the formation of "plugs" in the spray nozzle. An example of the preferred anti-clogging agent is polyethylene glycol having an average molecular weight of from about 800 to about 12,000, more preferably from about 1,400 to about 8,000. When used, the anti-clogging agent is present at a level of from about 0.01% to about 1%, preferably from about 0.05% to about 0.5%, more preferably, from about 0.1% to about 0.3% by weight of the usage composition.

(f) pH

Product pH can be below about 7 or above about 7. The pH is generally chosen to maintain stability of the components, maintain the efficacy of the components, provide additional benefits (e.g. odor control) and also to provide a non-irritating consumer product.

When polyalkylene oxide polysiloxanes are empolyed it is useful to adjust the pH of the solution to at least about pH 5.5 and below about pH 9.5 since these materials are most stable in this pH rang. When cyclodextrin is present, it is desirable to maintain a pH below about 11 since above about pH 11, the ability of cyclodextrin to form complexes and to control odor is diminished. To prevent irritation it is preferable for the pH of the product to be maintained above about a pH of 3 and below a pH of about 12. pH adjustment is achieved by the addition of mineral acids, organic acids and/or the addition of caustic alkali or other strong bases such as amine containing compounds. Nonlimiting examples of acids include HCl, ntric acid, sulfuric acid, acetic acide, etc. Nonlimiting examples of suitable caustic alkalis for use herein include sodium and potassium hydroxides. Nonlimiting examples of suitable caustic bases and amine compounds include metal hydroxides (e.g. NaOH, KOH), triethanolamine, N,N,N',N'-tetrakis(2-hydroxypropyl)-ethylenediamine and ammonium hydroxide.

(g) Buffer

Buffer is preferred when compositions contain materials that tend to hydrolyze and cause pH drift. Polyalkylene oxide polysiloxanes are materials that tend to hydrolyze with the trisiloxane materials being particularly susceptible to this behavior. The polyalkylene oxide polysiloxanes are most stable to hydrolysis between pH at least about 5.5. and below about pH 9.5. Therefore, when the composition contains optional polyalkylene oxide polysiloxane it is preferably for the formulation to be buffered such that the pH is at least about 5.5 and less than pH about 9.5. Suprisingly, it is not as simple as adjusting such solutions to the appropriate pH, because some level of hydrolysis can still occur resulting in a pH drop that will further accelerate hydrolysis and degradation. To prevent this degradation it is essential to buffer the solution and to provide enough buffering capacity to compensate for any acid or base produced by any small amount of hydrolysis.

Buffering capacity is related to having a sufficient level or concentration of a buffering system in the composition to prevent large changes in pH as acids or bases are added to a buffered system. Buffering capacity is typically expressed as dB/dpH which is a unitless, positive number representing the gram equivalents per liter of strong acid or base which must be added to a system to effect a change in the pH of the system by one unit. The buffering capacity is related to the initial pH of the system as well as the disassociation constant and the concentration of the buffer.

Buffering capacity of a system, in this case the present compositions, can be calculated from the following equation:

$$dB/dpH=2.3\ K_a C[H^+]/(K_a+[H^+])^2$$

wherein $K_a$=the ionization constant of the buffer, C=the concentration of the buffer and $[H^+]$=the initial concentration of the hydrogen ion in the composition. As an example, simply adjusting the pH using a weak base, like triethanolamine, is not sufficient to provide necessary buffering capacity to this system, and the above calculation is performed for the amount of triethanolarnine necessary to raise the pH of the a composition from pH=6.8 (a typical pH for the deionized water used to formulate the said composition) to pH=9, a preferred pH level for the said composition. For triethanolamine the $K_a=1.2\times10^{-8}$ and the initial=$1\times10^{-9}$. The amount of triethanolamine necessary to raise the pH from 6.8 to 9 is 0.1 g per liter or $6.7\times10^{-4}$. The buffering capacity of the above system is equal to:

$$2.3(1.2\times10^{-8})(6.7\times10^{-4})(1\times10^{-9})/(1.2\times10^{-8}+1\times10^{-9})^2=0.00011$$

This result indicates that a composition where pH is simply raised to a high pH by a base, even a buffering base such as triethanolamine, has very little buffering capacity. The buffering capacity indicates that it takes only 0.00011 gram equivalents per liter of a strong acid to change the pH by one unit. Such a system is not robust to pH drift over time and tends to hydrolyze at an increasingly rapid rate. The buffering capacity introduces an important concept—the concentration (or level) of the buffer in the composition is important because the concentration of buffer present is directly related to how much hydrogen ion the system can absorb without significant changes in pH. A thorough discussion of buffering capacity and the theory associated with it is given in the treatise "On the Measurement of Buffer Values and on the Relationship of Buffer Value to the Dissociation Constant of the Buffer and the Concentration and Reaction of the Buffer Solution" by Donald D. Van Slyke, *J. Biol. Chem.*, volume 52, pp 525–570, 1922, which is hereby incorporated herein by reference.

Many commonly used buffers are listed and discussed in the book *Buffers for pH and Metal Ion Control* by D. D. Perrin and B. Dempsey (John Wiley & Sons, 1974) and in references therein, which are hereby incorporated by reference. Buffering agents preferred for use in the compositions discussed herein are selected from the group consisting of buffering systems, acid-base conjugate pairs, and salts together with an acid or a base, and are incorporated in the present compositions at a level that maintains the pH of the composition at least about 5.5, preferably at least about 6, and more preferably at least about 7 and even more preferably at least about 7.5, but less than pH about 9.5, and preferably less than about 9 for a period of at least about 3 months, preferably at least about 6 months, more preferably at least about 12 months, even more preferably at least about 18 months, and still more preferably at least about 24 months.

Some nonlimiting examples of preferred buffer systems include the Tris/HCl pair (Tris=Tris (hydroxymethyl) aminomethane available from the Angus® Sigma Chemical Co. St. Louis, Mo. ), Borax/HCl (Borax is available from U.S. Borax, Inc., Valencia, Calif.), Diethanolamine/HCl (Diethanolamine is available from Dow Chemial, Midland, Mich.), sodium borate/NaOH (sodium borate is available from U.S. Borax, Inc., Valencia, Calif.), sodium bicarbonate/NaOH (sodium bicarbonate is available from the FMC Corporation, Philadelphia, Pa.), sodium hydrogen phosphate/NaOH (sodium hydrogen phosphate is available from Monsanto, St. Louis, Mo.), sodium carbonate/sodium bicarbonate (sodium carbonate and sodium bicarbonate are available from FMC Corporation, Philadelphia, Pa.), boric acid/NaOH (boric acid is available from U.S. Borax, Inc., Valencia, Calif.), glycine/NaOH (glycine is available from Sigma Chemcial, Inc, St. Louis, Mo.), and KCl/NaOH (KCl is available from North American Chemical Co., Overland Pk., Kans.). Sodium hydroxide is available from FMC Corporation, Philadelphia, Pa. and hydrogen chloride is available from Air Products and Chemicals, Inc., Allentown, Pa.

An effective amount of a buffering system wherein the concentration of all components of the buffering system including the acid-base conjugate pair as well as any salt used to boost the buffering capacity typically constitute from about 0.05% to about 10%, preferably from about 0.02% to about 8%, more preferably from about 0.1% to about 5%, and most preferably from about 0.2% to about 2.5% of the composition by weight. Preferred buffering systems are chosen from the group consisting of, but not limited to, buffering systems, acid-base conjugate pairs, and salts paired with an acid or a base, or self-buffering compounds and together with any salt intended to improve the buffering capacity of the system and utilized at a level that maintains the pH of the composition to be at least about 5.5., preferably at least about 6, more preferably at least about 7 and even more preferably at least about 7.5 but less than a pH of about 9.5, preferably less than about 9 for a period of at least about 3 months, preferably at least about 6 months, more preferably at least about 12 months, even more preferably at least about 18 months, and still more preferably at least about 24 months. The preferred buffering capacity of the system is at least about 0.01, and more preferably at least about 0.02.

(h) Whiteness Preservatives

When it is desireable to have lubrication under conditions where oxidation or polymerization are a risk, a whiteness preservative selected from the group of chelants, fabric substantive chelants, optical brightening agents, bluing agents, UV absorbers, and oxidative stabilizers such as anti-oxidants and/or reductive agents as well as mixtures of whiteness preservatives can be used. When whiteness preservatives are used, they should be added at levels of at least about 0.001, preferably at least about 0.005%, more preferably at least about 0.01%, even more preferably at least about 0.05%, still more preferably at least about 0.2%, but typically below about 10%, preferably below about 5%, more preferably below about 3%, and still more preferably below about 1.5%.

Suprisingly, it was found that over time and especially in cases where clothes are exposed to excessive heat (e.g. as in extensive drying or drying in commercial dryers) and/or confined to an enclosed space after treating, an undesirable yellowish cast begins to be apparent on white items. This yellowing will be perceived as a negative by consumers. Not to be bound by theory, but the yellowing is believed to be caused by the auto-oxidation of unsaturated materials in the composition, particularly polyunsaturated materials which are know to catalyze auto-oxidation. Under some conditions some level of polyunsaturate is desirable in the composition as it contributes, since the raw material is cheaper and easier to produce if the supplier is not constrained to minimizing or eliminating polyunsaturate. Some level of polyunsaturate is also desirable for preserving the clarity of the composition, especially when the composition is exposed to low temperatures (40° F. or below). Therefore, it is not acceptable in all cases to eliminate the yellowing problem by simply removing all polyunsaturated softener compositions. Attempts to eliminate polyunsaturated fatty acyl groups and specifically, the $C_{18:3}$ species can reduce the overall cis/trans isomer ratio, resulting in poorer clarity at lower temperatures, i.e., 40° F. or lower. Instead, it is surprisingly found that the yellowing can be significantly mitigated without removing polyunsaturated softeners by introducing materials that control the auto-oxidation reaction and/or, optionally, optically mask the yellow cast.

(i) Metal Chelating Agent.

Metals present in fabrics, products, water supply or arriving from other sources, especially transition metals and particularly copper and iron, can act to catalyze auto-oxidation of unsaturated materials, which can produce colored compounds. Therefore, metal chelating agents, which can be fabric substantive are added to the composition to control and reduce, or eliminate, catalysis of auto-oxidation reactions by metals. Metal chelating agents contain amine and especially tertiary amine moieties since these tend to be fabric substantive and very effectively chelate copper and iron as well as other metals. Aldehydes are produced by the auto-oxidation reactions, these are easily oxidized, and are believed to propagate the auto-oxidation reactions. Therefore amine-based metal chelating agents, and especially tertiary amine moieties, are also preferred since these react with aldehydes to terminate the auto-oxidation reactions.

The product contains at least about 0.01%, preferably at least about 0.05%, more preferably at least about 0.10% even more preferably about 0.5%, and most preferably at least about 0.75% and less than about 10%, preferably less than about 5.0% and more preferably less than about 1.0% by weight of a metal chelating agent. Levels below 1.0% are especially preferred in this formulation, since higher levels of metal chelating agents lead to instability in the formulation.

The structural description of a amine-based metal chelating compound for use in this composition is given below:

$$(R_1)(R_2)N(CX_2)_nN(R_3)(R_4)$$

wherein X is selected from the group consisting of hydrogen, linear or branched, substituted or unsubstituted alkyl having from 1 to 10 carbons atoms and substituted or unsubstituted aryl having at least 6 carbon atoms; n is an integer from 0 to 6; $R_1$, $R_2$, $R_3$, and $R_4$ are independently selected from the group consisting of alkyl; aryl; alkaryl; arylalkyl; hydroxyalkyl; polyhydroxyalkyl; polyalkylether having the formula—$((CH_2)_yO)_zR_7$ where $R_7$ is hydrogen or a linear, branched, substituted or unsubstituted alkyl chain having from 1 to 30 carbon atoms and where y is an integer from 2 to 10 and z is an integer from 1 to 30; alkoxy; polyalkoxy having the formula: —$(O(CH_2)_y)_zR_7$; the group —$C(O)R_8$ where $R_8$ is alkyl; alkaryl; arylalkyl; hydroxyalkyl; polyhydroxyalkyl and polyalkyether as defined in $R_1$, $R_2$, $R_3$, and $R_4$; $(CX_2)_nN(R_5)(R_6)$ with no more than one of $R_1$, $R_2$, $R_3$, and $R_4$ being $(CX_2)_nN(R_5)(R_6)$ and wherein $R_5$ and $R_6$ are alkyl; alkaryl; arylalkyl; hydroxyalkyl; polyhydroxyalkyl; polyalkylether; alkoxy and polyalkoxy as defined in $R_1$, $R_2$, $R_3$, and $R_4$; and either of $R_1$+$R_3$ or $R_4$ or $R_2$+$R_3$ or $R_4$ can combine to form a cyclic substituent.

Preferred agents include those where $R_1$, $R_2$, $R_3$, and $R_4$ are independently selected from the group consisting of alkyl groups having from 1 to 10 carbon atoms and hydroxyalkyl groups having from 1 to 5 carbon atoms, preferably ethyl, methyl, hydroxyethyl, hydroxypropyl and isohydroxypropyl. The color care agent has more than about 1% nitrogen by weight of the compound, and preferably more than 7%. A preferred agent is tetrakis-(2-hydroxylpropyl) ethylenediamine (TPED).

Other suitable water-soluble chelating agents can be selected from the group consisting of amino carboxylates, amino phosphonates, polyfunctionally-substituted aromatic chelating agents and mixtures thereof, all as hereinafter defined. The chelating agents disclosed in said U.S. Pat. No. 5,759,990 at column 26, line 29 through column 27, line 38 are suitable.

A suitable amine-based metal chelator, EDDS, that can be used herein (also known as ethylenediamine-N,N'-disuccinate) is the material described in U.S. Pat. No. 4,704,233, cited hereinabove, and has the formula (shown in free acid form):

$$HN(L)C_2H_4N(L)H$$

wherein L is a $CH_2(COOH)CH_2(COOH)$ group.

A wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.05% to about 10%, more preferably from about 0.75% to about 5%, by weight of the compositions herein, in addition to those that are stabilizers. Preferred chelators include DETMP, DETPA, NTA, EDDS, and EDTA.

Mixtures of metal chelating agents are acceptable for use herein.

(ii) Brighteners

Optical brighteners also known as fluorescent whitening agents (FWAs) or fluorescent brighteners preserve whiteness by compensating for the yellow appearance by adding a complementary color to the fabric and thus the undesired yellowing is rendered invisible. Not to be bound by theory, but auto-oxidation of the polyunsaturated softener compounds generates compounds that appear yellow on white fabrics because these compounds absorb short-wavelength light, light in the range of violet to blue or wavelengths between about 370 nm to 550 mn. Optical brighteners replace this missing part of the spectrum and so a white appearance is retained. Optical brighteners absorb light shorter wavelength ultraviolet light and emit light via fluorescence in the blue to blue violet range of the spectrum.

The product contains from at least about 0.005%, preferably at least about 0.01%, more preferably at least about 0.05%, even more preferably at least about 0.1%, still more preferably at least about 0.17% and less than about 5%, preferably less than about 3%, more preferably less than about 2% and most preferably less than about 1% of an agent know as an optical brightening agent (brightener). Lower levels of brightener are used in the presence of the metal chelating compound. In the absence of the metal chelating compound, higher levels of brightener are preferred.

Preferred optical brighteners are colorless on the substrate and do not absorb in the visible part of the spectrum. Preferred optical brighteners are also lightfast, meaning that these do not degrade substantially in sunlight. Optical brighteners suitable for use in this invention absorb light in the ultraviolet portion of the spectrum between 275 nm and about 400 nm and emit light in the violet to violet-blue range of the spectrum from about 400 rn to about 550 nm. Preferably, the optical brightener will contain an uninterrupted chain of conjugated double bounds. Optical brighteners are typically, but not limited to, derivatives of stilbene or 4,4'-diaminostilbene, biphenyl, five-membered heterocycles such as triazoles, oxazoles, imidiazoles, etc., or six-membered heterocycles (coumarins, naphthalamide, s-triazine, etc. ). Many specific brightener structures are described in *The Kirk-Othmer Encyclopedia of Chemistry* $3^{rd}$ Ed., pp 214–226 and in references therein U.S. Pat. No. 5,759,990 at column 21, lines 15–60; said references being incorporated herein by reference as suitable for use in this invention. Ionic brighteners with a positive or negative charge are preferred as this improves solubility in the compositions disclosed herein and thus are easier to formulate and are more stable.

Some preferred, but nonlimiting brighteners are Optiblanc® GL and Optiblanc® LSN from 3V Inc., Weehawken, N.J., Tinopals® CBS SP Slurry 33, PLC, UNPA-GX, 4BM, 4BMS, 5BM, 5BMS, 5BM-GX, AMS-GX, DMS-X, DCS Liquid, K, ERN, LCS, LFW, and TAS, Univex®, SK, ERN, and AT, from Ciba, High Point, North Carolina, Blankophor® FBW, FB, LPG , and HRS, from Mobay. In addition to preventing auto-oxidation, some brighteners also prevent dye transfer.

(iii) Bluing Agents

Bluing agents also act to preserve whiteness by compensating for the yellow appearance by again adding a complementary color to the fabric and thus the undesired yellowing is no longer noticeable. Like optical brighteners, bluing agents replace this missing part of the spectrum and so a white appearance is retained. Typically, the water soluble blue dyes that are used as bluing agents are anionic and associate with cationic softener actives and thereby deposit on fabric along with the softener active(s). Typically the bluing agents are included at levels of at least about 0.005%, more preferably at 0.001% even more preferably at 0.005% and most preferably at least about 0.01% and less than about 10%, preferably less than about 5%, and more preferably less than about 1% by weight of the composition. Examples are Polar Brilliant Blue (Acid Blue 127:1), Liquitint Patent Blue, and Liquitint Blue 65, all from Milliken & Company and Acid Blue 80 from the Hilton-Davis Co., Cincinnati, Ohio. Oil soluble blue dyes and pigments can also be used.

(iv) UV Absorbers

Not to be bound by theory, but UV absorbers can operate by protecting the fabric and any fabric softener compound deposited on the fabric from UV exposure. UV light is know to initiate auto-oxidation processes and suprisingly, UV absorbers can be deposited on fabric in such a way that UV light is blocked from the fabric and fabric plus composition thus preventing the initiation of auto-oxidation.

Preferably the UV absorber compound absorbs light at a wavelength of from about 315 nm to about 400 nm and is a preferably solid having a melting point of from about 25° C. to about 75° C., more preferably from about 25° C. to about 50° C. UV absorbers are included at levels of at least about 0.005% preferably at least about 0.05% and less than about 10%, preferably less than about 5% by weight of the composition.

Preferably these UV absorber compounds contain at least one chromophore selected from the group consisting of:

(I)

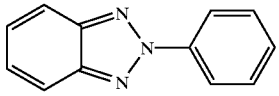

Phenylbenzotriazole (II)

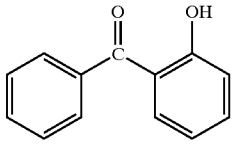

2-Hydroxybenzophenone (III)

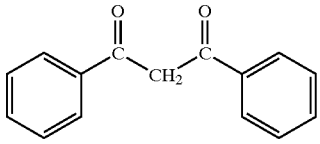

Dibenzoylmethane (IV)

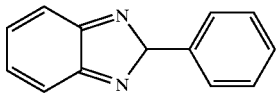

Phenylbenzimidazole (V)

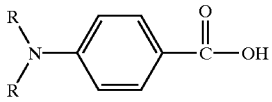

Esters of P-Aminobenzoic Acid (PABA)

(VI)

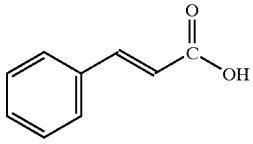

Esters of Cinnamic Acid (VII)

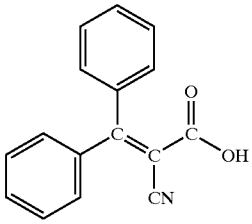

Esters of 2-Cyano-3, 3-diphenyl-2-Propenoic Acid (VIII)

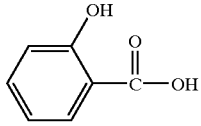

Esters of Salicyclic Acid and (IX)

mixtures thereof;

wherein each R is a hydrogen, methyl, ethyl, $C_1$ to $C_{22}$ branched or straight chain alkyl group and mixtures thereof, preferably a methyl group; and wherein the compound containing the chromophore is a non-fabric staining, light stable compound containing preferably at least one $C_8$–$C_{22}$ hydrocarbon fatty organic moiety; wherein the chromophore absorbs light at a wavelength of from about 290 nm to about 450 nm; wherein the compound is a solid having a melting point of from about 25° C. to about 90° C. or, optionally, a viscous liquid at a temperature of less than about 40° C.

Preferably the UV absorber compound is a compound containing at least one chromophore selected from the group consisting of (I), (II), (III), (IV), (V), (VII), (VIII), and mixtures thereof; more preferably the UV absorber compound is a compound containing at least one chromophore selected from the group consisting of (I), (II), (III), (IV), and mixtures thereof; and even more preferably (I), (II), and mixtures thereof. Furthermore, compounds containing at least one formula (I) chromophore are especially preferred.

More preferably these UV absorber compounds are selected from the group consisting of:

(I)

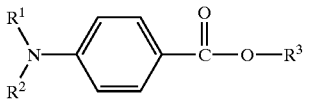

(II)

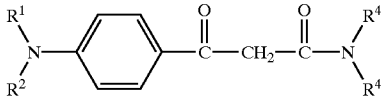

(III)

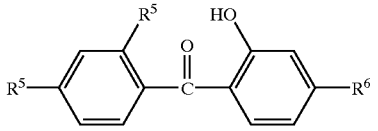

(IV)

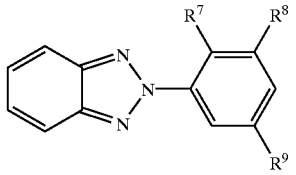

(V)

mixtures thereof;

wherein $R^1$ is a hydrogen or a $C_1$ to $C_{22}$ alkyl group; preferably a hydrogen or a methyl group;

$R^2$ is a hydrogen or a $C_1$ to $C_{22}$ alkyl group; preferably a hydrogen or methyl group;

$R^3$ is a $C_1$ to $C_{22}$ alkyl group; preferably a $C_8$ to $C_{18}$ alkyl group; more preferably a $C_{12}$ to $C_{18}$ alkyl group;

each $R^4$ is a hydrogen, a $C_1$ to $C_{22}$ alkyl group, and mixtures thereof; preferably a methyl group, a $C_8$ to $C_{22}$ alkyl group, and mixtures thereof, more preferably one $R^4$ is a $C_{10}$ to $C_{20}$ alkyl group, preferably a $C_{12}$ to $C_{18}$ alkyl group, and the other $R^4$ group is a methyl group;

each $R^5$ is a hydrogen, hydroxy group, a $C_1$ to $C_{22}$ alkyl group, (which can be an ester, amide, or ether interrupted group), and mixtures thereof, preferably a hydrogen, hydroxy group, and mixtures thereof, more preferably hydrogen;

$R^6$ is a hydrogen, hydroxy group, methoxy group, a $C_1$ to $C_{22}$ alkyl group, (which can be an ester, amide, or ether interrupted group), and mixtures thereof, preferably a $C_1$ to $C_{22}$ alkyl group with an ether or ester interrupted group, and mixtures thereof, more preferably a methoxy group, a $C_8$ to $C_{22}$ alkyl group with an ester interrupted group, and mixtures thereof, $R^7$ is a hydrogen, hydroxy group, or a $C_1$ to $C_{20}$ alkyl group, preferably a hydrogen or a hydroxy group, more preferably a hydroxy group;

$R^8$ is a hydrogen, hydroxy group, or a $C_1$ to $C_{22}$ alkyl group, (which can be an ester, amide, or ether interrupted group); preferably a $C_1$ to $C_{22}$ alkyl group; more preferably a $C_1$ to $C_8$ alkyl group, and even more preferably a methyl group, a "tert"-amyl group, or a dodecyl group; and $R^9$ is a hydrogen, hydroxy group, or a $C_1$ to $C_{22}$ alkyl group, (which can be an ester, amide, or ether interrupted group); preferably a "tert"-amyl, methyl phenyl group, or a coco dimethyl butanoate group.

These UV absorber compounds absorb light at a wavelength of from about 290 nm to about 450 nm, preferably from about 315 nm to about 400 nm.

$R_5$, $R_6$, $R_7$, $R_8$, and $R_9$ can be interrupted by the corresponding ester linkage interrupted group with a short alkylene ($C_1$–$C_4$) group.

Preferred UV absorber agents of the present invention are selected from the group consisting of fatty derivatives of PABA, benzophenones, cinnamic acid, and phenyl benzotriazoles, specifically, octyl dimethyl PABA, dimethyl PABA lauryl ester, dimethyl PABA oleoyl ester, benzophenone-3 coco acetate ether, benzophenone-3 available under the tradename Spectra-Sorb® UV-9 from Cyanamid, 2-(2'-Hydroxy-3',5'-di-tert-amylphenyl benzotriazole which is available under the tradename Tinuvin(& 328 from Ciba-Geigy, Tinuvin® coco ester 2-(2'-Hydroxy, 3'-(coco dimethyl butanoate)-5'-methylphenyl) benzotriazole, and mixtures thereof. Preferred UV absorbers agents of the present invention are benzotriazole derivatives since these materials absorb broadly throughout the UV region. Preferred benzotriazole derivatives are selected from the group consisting of 2-(2'-Hydroxy, 3'-dodecyl, 5'-methylphenyl) benzotriazole available under the tradename Tinuvin®571 (Ciba) available from Ciba-Geigy, and Coco 3-[3'-(2H-benzotriazol-2'-yl)-5-tert-butyl-4'-hydroxyphenyl] propionate.

Other conventional UV absorbers can be used but are generally less suitable because they less effectively deposit on surfaces, sometimes discolor fabrics, are not always stable or compatible with other components in the composition, and are often expensive.

(v) Oxidative Stabilizers

Oxidative stabilizers can be present in the compositions of the present invention to prevent yellowing by acting as a scavenger for oxidative processes, thus preventing and/or terminating auto-oxidation or by reversing oxidation and thus reversing yellowing. The term "oxidative stabilizer," as used herein, includes antioxidants and reductive agents. These agents are present at a level of from 0% to about 2%, preferably from about 0.01% to about 0.2%, more preferably from about 0.035% to about 0.1% for antioxidants, and, preferably, from about 0.01% to about 0.2% for reductive agents.

Examples of antioxidants that can be added to the compositions and in the processing of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and Tiron®, available from Kodak with a chemical name of 4,5-di-hydroxy-m-benzene-sulfonic acid/sodium salt, and DTPA®, available from Aldrich with a chemical name of diethylenetriaminepentaacetic acid.

Oxidative stabilizers can also be added at any point during the process of making fabric softener raw materials where polyunsaturated compounds would be present. E.g., these could be added into oils used to make fatty acids, during fatty acid making and/or storage during fabric softener making and/or storage. These assure good odor stability under long term storage conditions. It is especially critical to add these to the process steps used to make unscented or low scent products (no or low perfume).

(vi) Combinations whiteness preservatives

Combinations of whiteness preservatives are also useful for the present invention.

10. Mixtures Thereof

A variety of mixtures and combinations of optional supplemental wrinkle control agents, optional odor control agents, optional perfumes, optional antimicrobial actives, optional aminocarboxylate chelators, optional water-soluble polyionic polymers, optional antistatic agents, optional insect repellants, optional colorants, optional anti-clogging agents, can be used in the present wrinkle controlling compositions.

II. Spray Pattern

Providing an optimal spray pattern is important to producing optimal performance in a spray that will be used to treat fabrics. The key parameter effective in minimizing staining and reducing dry time is to achieve uniform distribution of a liquid product over the surface area of the fabric. This becomes more critical as components are added to an aqueous system and the amount of water vs. other components is reduced. The higher the level of non-water components becomes, the greater the risk of leaving a stain on fabrics. Uniform distribution in a spray pattern is measured as: the volume of product dispensed per unit of surface area and the standard deviation in the volume deposited per unit of surface area. To achieve uniform distribution, the sprayer chosen must be capable producing an acceptable spray pattern that falls within the limits on volume of product dispensed per unit area and on the standard deviation in volume per unit surface area disclosed herein.

The composition must also meet certain requirements to achieve a good distribution pattern. Not to be bound by theory, but as the extensional viscosity of the product increases, it becomes more difficult ior particles to separate on spraying and the cone angle of the spray collapses resulting in the liquid dispensing over a smaller area on the surface of the fabric, forcing the formation of 'hot spots' even when acceptable sprayers are used. Therefore, the product composition must meet certain requirements for extensional viscosity. The extensional viscosity is typically expressed as the Trouton ratio, that is the ratio of extensional viscosity to shear viscosity.

There are many techniques that can be used to measure the extensional rheology of fluids, and they usually fall into two categories. The first category contains "flow through" devices, and the second one contains "stagnation point" devices. Note that it is more accurate to call the measuring equipment "indexers" rather than "rheometers", since in the extensional measurement equipment the stress response is not usually free of extraneous stress contributions.

Most of the first devices rely on the fluid being spinnable, like the tubeless siphon, and spinning techniques. These techniques are usually limited to low rates of strain and to generally highly viscous or elastic fluids. Therefore, their applicability to spraying might be limited. Examples of the spinning techniques are fiber spinning, "falling droplet" or "filament stretching". Alternatively, orifice flow techniques, which measure the pressure drop across a contraction, can be used for fluids that cannot be spinned. However, the interpretation of the data is not straightforward even for Newtonian fluids. For non-Newtonian fluids, the difficulty is even more pronounced as recirculating vortices and viscoelastic instabilities are present. Other variations of the flow technique are those of flow through "packed beds" or "screen packs". Increased flow resistance through beds or packs indicates the presence of extensional viscosity. However, rather than measuring an absolute value, the flow through screen packs yields a relative index of extensional viscosity.

On the other hand, the stagnation point devices, such as the roll mill, ubricated-die converging flow rheometer, cross-slot cell, and the opposing jet device can be used to study the extensional behavior of low-viscosity fluids. The Rheometrics RFX rheometer (Rheometric Scientific Inc., Piscataway, N.J.) is an opposing-jet device that is commercially available. Finally, comparison of the extensional viscosity data from the various devices that were referred to above is difficult due to the different strain history that each device imposes on the sample. Thus, it is expected that the viscosity results from these different devices will be scattered considerably.

Sprayers that provide an acceptable spray pattern dispense a volume per unit surface area of less than about 0.07 ml/inch$^2$ (0.011 ml/cm$^2$); preferably less than about 0.05 ml/inch$^2$(0.0078 ml/cm$^2$); more preferably less than about 0.035 ml/inch$^2$ (0.0054 ml/cm$^2$); even more preferably less than about 0.025 ml/inch$^2$ (0.0039 ml/cm$^2$); and still more preferably less than about 0.02 ml/inch$^2$ (0.0031 ml/cm$^2$); with a standard deviation in the volume per unit surface area of less than about 0.056 ml/inch$^2$ (0.0087 ml/cm$^2$); preferably less than about 0.05 ml/inch$^2$ (0.0078 mU/cm$^2$); more preferably less than about 0.03 ml/inch$^2$ (0.0047 ml/cm$^2$); even more preferably less than about 0.022 ml/inch$^2$ (0.0034 ml/cm$^2$); still more preferably less than about 0.02 ml/inch$^2$ (0.0031 ml/cm$^2$); and still more preferably less than about 0.018 ml/inch$^2$ (0.0028 ml/cm$^2$).

The Trouton ratio, at the extension and shear rates of less than about 20,000 $s^{-1}$, should be less than about 10,000, preferably less than about 5,000, more preferably less than about 1,000, even more preferably less than about 500, and still more preferably less than about 100.

Suitable spray dispensers used to provide the desired spray pattern herein include, but are not limited to, the Indesco T-8500 available from Continental Sprayers Inc., and the TS-800–2 and TS-800–2E available from Calmar, Inc.

III. Article of Manufacture

The present invention also encompasses articles of manufacture comprising (1) a spray dispenser, (2) container, and (3) a wrinkle controlling composition. Optionally, an article of manufacture of the present invention can include a set instructions in association with the article. A variety of containers, compositions, spray dispensers and instructions can be utilized in the present articles of manufacture as described hereinafter.

The present articles of manufacture optionally, but preferably, comprise a set of instructions that are typically associated with the container. The set of instructions typically communicates to the consumer of the present articles to dispense the composition in an amount effective to provide a solution to problems involving, and/or provision of a benefit relating to, those selected from the group consisting of: killing or reducing the level of, microorganisms; reducing odors; improving softness, improving appearance, repelling pests, and/or reducing static in addition to the reduction of wrinkles. It is important that the consumer of the present article be aware of these benefits, since otherwise the consumer would not know that the composition would solve these problems or combination of problems and/or provide these benefits or combination of benefits.

As used herein, the phrases "in association with" and "associated with" mean the set of instructions are either directly printed on the container itself packaging for the container or presented in a separate manner including, but not limited to, a brochure, print advertisement, electronic advertisement, and/or broadcast communication, so as to communicate the set of instructions to a consumer of the article of manufacture. The set of instructions preferably comprises the instruction to apply an effective amount of the composition, preferably by spraying, to provide the indicated benefit, e.g., wrinkle reduction, and, optionally, antimicrobial action, and/or anti-static effect, etc. and, also optionally, the provision of odor control and/or reduction.

A more complete disclosure of the instructions is presented hereinafter.

A. Spray Dispensers Providing Spray Pattern

Sprayers providing the spray pattern should provide a spray pattern consistent with uniform distribution as described by the volume per unit of surface area and the standard deviation in the volume per unit of surface area. Optimal spray patterns have been described hereinbefore. Nonlimiting examples of sprayers producing such a pattern include the TS-800-2 and TS-800-2E from available Calmar, Inc. and the Indesco T-8500 available from Continental Sprayers Inc. ("CSI").

B. Container

The wrinkle controlling composition may be retained in and dispensed from any conventional container. The container serves as a reservoir for the wrinkle controlling composition but is not otherwise critical to the invention. The container may be a variety of sizes for particular uses. For instance, a container containiner more than about 500 ml of the wrinkle controlling composition may be preferred for re-fill purposes. A 500 ml capacity container may be more preferred for everday dispensing of the composition. Further, a container having a capacity of less than about 400 ml, preferably less than 250 ml, and even more preferably less than 150 ml is conveniently portable for use when "travelling".

C. Wrinkle Controlling Composition

The present article of manufacture can comprise a wrinkle controlling composition according to the compositions described hereinbefore in Section I. The present compositions are preferably held in a container such as spray dispenser to easily dispense the compositions onto fabrics to be treated D. Set of Instructions An article of manufacture can optionally comprise the composition of the present invention in a container in association with a set of instructions to use the composition in an amount effective to provide a solution to problems involving and/or provision of a benefit related to those selected from the group consisting of: killing or reducing microbes; reducing odor; reducing time and/or effort involved in ironing fabrics, and/or reducing static in addition to the reduction in wrinkles. It is important that the consumer be aware of these additional benefits, since otherwise the consumer would not know that the composition would solve these problems and /or provide these benefits.

As used herein, the phrases "in association with" and "associated with" mean that the set of instructions are either directly printed on the container itself or presented in a separate manner including, but not limited to, a brochure, print advertisement, electronic advertisement, and/or verbal communication, so as to communicate the set of instructions to a consumer of the article of manufacture. The set of instructions preferably comprises the instruction to apply an effective amount of the composition, preferably by spraying, to provide the indicated benefit, e.g. wrinkle reduction, antimicrobial action, static effect, and/or reduction in time and/or effort of ironing and, optionally, the provision of the main effect of odor control and/or reduction.

The set of instructions of the present articles can comprise the instruction or instructions to achieve the benefits discussed herein by carrying out any of the methods of using wrinkle controlling compositions, including the present silicone oil emulsion compositions, as described herein.

IV. Methods of Use

A wrinkle controlling composition as described hereinbefore, which comprises essentially water and optional components, e.g., alkylene oxide polysiloxane copolymer, surfactant, odor control agents, fragrance, antimicrobial compound, etc., can be used by distributing, e.g., by placing, an effective amount of the aqueous solution onto the surface or article to be treated. Distribution can be achieved by using a spray-type dispensers distributing wrinkle composition. For wrinkle control, an effective amount means an amount sufficient to remove or noticeably reduce the appearance of wrinkles on fabric. For odor control, an effective amount, as defined herein, means an amount sufficient to absorb odor to effect a noticeable reduction in the perceived odor, preferably to the point that it is not discernible, by the human sense of smell. For static control an effective amount, as defined herein, means and amount sufficient to noticeably reduce voltage on fabrics and cling between fabrics. Preferably, the amount of solution is not so much as to saturate or create a pool of liquid on said article or surface and so that when dry there is no visual deposit readily discernible.

Preferably, the present invention does not encompass distributing the composition onto non-fabric surfaces. However when optional cyclodextrin in the composition it can be used on other surfaces for odor control. However, care should be taken when treating such composition on shiny surfaces including, e.g., chrome, glass, smooth vinyl, leather, shiny plastic, shiny wood, etc., because spotting and filming can occur on such surfaces. However, when appearance is not important, the composition of the present invention containing optional cyclodextrin can be sprayed onto shiny surfaces to obtain odor control benefit. Although the cyclodextrin solution can be used on human skin, care should be taken, especially when an antimicrobial active is present in the composition.

The compositions and articles of the present invention which contain a fabric wrinkle control agent can be used to treat fabrics, garments, household fabrics, e.g. curtains, bed spreads, pillowcases, table clothes, napkins, and the like to remove or reduce, undesirable wrinkles, in addition to the optional removal or reduction of undesirable odor on said objects.

An effective amount of the liquid composition of the present invention is preferably sprayed onto fabrics, particularly clothing. When the composition is sprayed onto fabric, an effective amount should be deposited onto the fabric, with the fabric becoming damp or totally saturated with the composition, at least where the wrinkle exists, typically from about 5% to about 150%, preferably from about 10% to about 100%, more preferably from about 20% to about 75%, by weight of the fabric. The amount of polymer active typically sprayed onto the fabric is from about 0.001% to about 2%, preferably from about 0.01% to about 0.5%, more preferably from about 0.02% to about 0.2%, by weight of the fabric. Once an effective amount of the composition is sprayed onto the fabric the fabric is optionally, but preferably stretched while still damp. The fabric is typically stretched perpendicular to the wrinkle, where the wrinkle has a clearly defined line. The fabric can also be smoothed by hand after it has been sprayed and is still damp. In some cases, it is acceptable to simply hang the fabric, while still damp on a hanger or clothes line without further manipulation by hand after spraying. The smoothing movement works particularly well on areas of clothing that have an interface sewn into them, or on the hems of clothing. Once the fabric has been sprayed and optionally, but preferably, stretched or smoothed, it is hung until dry or maintained under stress to reduce the reappearance of the wrinkle.

The compositions of the present invention can also be used as ironing aids. An effective amount of the composition can be sprayed onto fabric and the fabric is ironed at the normal temperature at which it should be ironed. The fabric can either be sprayed with an effective amount of the composition, allowed to dry and then ironed, or sprayed and ironed immediately.

The compositions herein are especially useful, when used to treat garments for extending the time before another wash cycle is needed. Such garments include uniforms and other garments which are normally treated in an industrial process, which can be dewrinkled and/or refreshed and the time between treatments extended.

The presence of the preferred alkylene oxide silicone copolymer imparts softness and lubricity to the surface that can counteract the harsh feel cyclodextrin, other formulations components or detergent residues. The presence of the preferred surfactant promotes spreading of the solution and the highly preferred antimicrobial active provides improved odor control as well as antimicrobial action, by minimizing the formation of odors. Both the surfactant and the antimicrobial active provide improved performance and the mixture is especially good. When the compositions are applied in the form of the very small particles (droplets), as disclosed hereinbefore, additional benefits are found, since the distribution is even fuirther improved and overall performance is improved.

Fabrics can be treated with wrinkle controlling compositions in either the dry state or a wet state. For some situations it is preferable to treat garments or fabrics while those garments or fabrics are dry. For instance, if the fabric is already dry and/or in place where removal would be difficult, e.g., if the wrinkle controlling composition will be used to smooth window curtains or shower curtains that are already hanging or bed clothes that are already on the bed, or dry clothes with minor wrinkles that will be worn soon, it is preferable to treat these items in the already dry state. A particularly preferred situation involves dry clothing or fabrics that have wrinkles caused by compression, e.g. stored in tight containers (suitcases, trunks), compressed in tight spaces (closets, cabinets), left for some period of time after the end of the drying cycle in an automatic clothes dryer, and/or wrinkled after in-wear conditions. For some situations it may be preferable to treat the fabrics while they are in the wet state before they are dry to simplify smoothing. For instance a consumer will normally find it convenient to treat fabrics as these fabrics are being hung to dry on a line or a hanger, e.g., when hand washing garments it is often more convenient to treat the garment just after the rinse and before drying. In general, for wrinkle controlling compositions treating in the wet state is preferable because the active from the wrinkle controlling compositions spreads better on wet fabrics vs. dry fabrics, since the dry fabrics will absorb some of the water and/or solvent, thus decreasing the mobility of the actives.

If the wrinkle controlling compositions show any separation, it will be desirable to shake well before using to guarantee good distribution and consistent dosing. The sprayer tip is then moved to the position marked "on" or to the position that is marked indicating the sprayer stream will be released when the triggering mechanism is activated. There can be more than one position marked to indicate different rates of delivery, or spray patterns. The stream with the desired characteristics is chosen. When treating the garments with the wrinkle controlling compositions herein it is recommended to hold the distribution means, e.g., a spray bottle, with the nozzle pointed towards the garment with the nozzle typically at distances where the lower distance from the fabric is at least about 2 inches from the fabric, preferably at least about 3 inches from the fabric, more preferably at least about 4 inches from the fabric, still more preferably at least about 5 inches from the fabric and most preferably at least about 6 inches from the fabric, while the upper distance from fabric is less than about 15 inches, preferably less than about 12 inches, more preferably less than about 10 inches, still more preferably less than about 9 inches and most preferably less than about 8 inches. Typically, wrinkle controlling compositions should be applied in a manner that achieves even coverage over the entire fabric surface. While it is acceptable to treat the overall garment using a discrete spraying action e.g. spray a spot on a fabric and then move to another spot on the fabric and spray, it is preferably to spray fabrics using a sweeping motion over the fabric to aid maximum spreading and coverage of the wrinkle controlling composition. This even distribution is conveniently achieved by using a powered sprayer e.g. battery or electrical powered. In cases where more difficult wrinkles exist on the fabrics, it is usually desirable to concentrate a higher dose of wrinkle controlling composition on these wrinkled sites vs. the bulk of the fabric. For garments that have a few lighter wrinkles, it is normally preferable to apply wrinkle controlling compositions generally over these sites. However, it is acceptable to treat only the part of a fabric that will be visible, e.g., the front of a shirt where only the front will be visible since the back will be covered by a jacket.

When dry fabrics are treated with the wrinkle controlling compositions, the amount of wrinkle controlling composition that should be used is dependent on several factors including, but not limited to, the weight of the fabric, the type of fabric, and the type of wrinkle in the fabric. Fabrics can have several types of wrinkles. One type of wrinkle is characterized by its relative depth and sharpness. Such wrinkles are difficult to remove and require more of wrinkle controlling compositions and more work by the user to remove. When fabrics have such tough to remove wrinkles or the fabric is heavy, wrinkle controlling compositions are typically applied at higher levels of at least about 0.01 times the weight of the fabric, preferably at least about 0.1 time the weight of the fabric, more preferably at least about 0.25 times the weight of the fabric and at higher levels of about 2 times the weight of the fabric, more preferably about 1.5 times the weight of the fabric, even more preferably about 1 times the weight of the fabric and most preferably about 0.75 times the weight of the fabric.

Another type of wrinkle is characterized by its broad nature and lack of depth; such wrinkles are often referred to as "bumpiness", "waviness", or "rumples". Such wrinkles are often less difficult to remove than the sharp type of wrinkle discussed above. When fabrics are lighter in weight or have wrinkles that are less difficult to remove wrinkle controlling compositions are typically applied at lower levels of about 0.001 times the weight of the fabric, preferably about 0.01 times the weight of the fabric, more preferably about 0.05 times the weight of the fabric, even more preferably about 0.1 times the weight of the fabric and most preferably about 0.25 times the weight of the fabric and at higher levels of about 1.5 times the weight of the fabric, preferably about 1 times the weight of the fabric, more preferably about 0.75 times the weight of the fabric and most preferably about 0.5 times the weight of the fabric. To reduce the potential for staining, it is always preferable to minimize the total amount of wrinkle controlling composition needed to remove the wrinkles form the fabric.

After fabrics are treated with the wrinkle controlling composition, there are several manipulations that can be employed to aid in controlling the wrinkles. The garments can be stretched both perpendicular and parallel to the wrinkle (or at any angle around the wrinkle) which will help to ease the wrinkle out of the clothing. Stretching the fabrics in a direction perpendicular to the line of the wrinkle is especially helpful in removing the wrinkle from clothing. The fabrics can also be smoothed using the hands with pressing and gliding motions similar to those employed with an iron. The stretching and/or smoothing procedure can be performed with the garment hung vertically, e.g., on a clothes hanger or spread on a horizontal surface, such as, a bed, an ironing board, a table surface, and the like. Another method to loosen wrinkles after treating involves shaking out fabrics with enough energy to loosen wrinkles, in some cases it may be necessary to impart enough energy to cause the fabric to make a snapping noise or motion. The wrinkles could also be manipulated out of the fabric using an implement designed to help smooth the fabrics. Such an implement would be useful in preventing contacts between hands and wrinkle controlling composition, if desired. Many fabrics or garments also contain bends in the fabrics, often termed creases or pleats, that are desireable. Such creases or pleats are often found on the front of pant legs and the sides of sleeves. These can be reinforced while the garment is being shaped to preseve the crease. Creases are reinforced by applying pressure usually by pinching the fabric either with hands or an implement and pulling the crease through the pressure point or by hanging the garment so that it folds at the crease and reinforces it with the pressure of gravity. The fabric should then be laid out flat to dry or hung on a hanger or with some other apparatus such that the fabric will remain smooth while drying. Weights can be attached to critical points on fabrics and garments to aid in maintaining smooth appearance during drying. Depending on the amount of product used to treat the garment and the weight of the garment, the garment should be dried in air for an upper time of less than about 24 hours, preferably less than about 12 hours, more preferably less than about 6 hours, still more preferably less than about 3 hours, and most preferably equal to or less than about 2 hours and the lower limit of drying time is equal to or greater than about 5 minutes, preferably greater than about 10 minutes, more preferably equal to or greater than about 15 minutes, still more preferably greater than or equal to about 30 minutes and most preferably greater than or equal to about 60 minutes. It is preferable to let fabrics that were very wet prior to treating with the wrinkle controlling composition dry for longer periods. It is also preferable to let fabrics that are treated with higher amounts of the wrinkle controlling composition dry for longer periods of time.

It is preferable to assist the drying, either by heating, or blowing air across the fabric surface, or both. Thus, at times it is desirable to follow the use of wrinkle controlling composition by treating the fabric with an appliance that can help dry the clothes. Nonlimiting examples of such appliances are clothes dryers and hand-held hair dryers. The wrinkle controlling composition, in combination with an appliance, can be used on both dry or wet fabrics. For instance, when clothes are dried in a clothes dryer and then inadvertently left in the clothes dryer or in a laundry basket or piled on some surface or in some container with out folding, both wet and dry clothes can become badly wrinkled. To remedy this situation, the wrinkle controlling composition can be used in combination with a clothes dryer to remove wrinkles from single fabrics or garments as well as batches, or loads, of fabrics and garments. Drying with low-heat or cool air is preferred for fabrics that normally have a tendency to shrink, such as wool, silk, rayon, and the like.

The wrinkle controlling composition can be sprayed onto fabrics or garments prior to adding fabrics or garments to the dryer to treat garments in batches and/or dry garments faster after spraying.

When using the wrinkle controlling composition through the dryer, it is preferred, to use smaller bundle sizes with typical sizes below about 15 lbs (about 6.8 kg), preferably below about 10 lbs (about 4. 5 kg), more preferably below about 8 lbs. (about 3.6 kg), even more preferably below about 6 tbs. (about 2.7 kg) and most preferably at or below about 4 lbs. (about 1.8 kg)

When treating fabrics in the clothes dryer the amount of wrinkle controlling composition used is dependent on the size of the load of fabrics. For a preferred 4 lbs. bundle of fabrics, wrinkle controlling compositions should be used typically at lower levels of least about 10 g, preferably at least about 20 g, even more preferably at least about 30 g, still more preferably at least about 50 g, and most preferably about 66 g, and at higher levels of equal to or less than about 3000 g, preferably equal to or less than about 1500 g, more preferably equal to or less than about 750 g, still more preferably equal to or less than about 500 g and most preferably equal to or less than about 100 g. When the bundle size is greater than about 4 lbs., higher amounts of wrinkle controlling composition are appropriate and when the bundle size is smaller than about 4 lbs. (about 1.8 kg) lower amounts of wrinkle controlling composition are appropriate.

Garments and fabrics should be removed as soon as possible, preferably immediately, following the drying cycle and arranged to maintain the smooth appearance of the fabrics with for instance, but not limited to, arranging sleeves, collars, pant legs so these are smooth and not twisted in any way, hanging the fabric on a hanger, laying the fabric flat on a or putting the fabric to its natural use to maintain its appearance e.g. hang curtains, put bed linens on the bed, put table linens on the table. Preferably the fabric will not be folded and stored until it is completely dry.

A hand-held hair dryer can be used to increase the speed of drying of individual fabrics. It is preferably to use the hand-held hair dryer on fabrics that are not very wet since it can be time consuming to dry fabrics with such an appliance. Therefore, it is preferably to employ this method on fairly dry fabrics, e.g., those that started in the dry state.

When using a hand-held hair dryer, wrinkle controlling compositions are applied preferably evenly over fabrics and preferably using the minimal amount of wrinkle controlling composition necessary. Preferably, the fabric is manipulated as described above to remove wrinkles prior to drying with the hand-held hair dryer. The hand-held dryer is turned on either low, medium, or high heat, preferably medium or high heat and the air stream is applied evenly over the fabrics until the fabrics are dry. However, care should be taken to preferably use low-heat and/or cool air to dry fabrics that are prone to shrinkage, such as, wool, silk, rayon, and the like, especially when the fabrics are reaching the point of drying completely. After drying the fabric should be placed in a configuration that will maintain its smoothness until use as discussed above.

Wrinkle controlling compositions can be used as ironing aids with either wet or dry fabrics to help ease removal of wrinkles by the ironing process. Wrinkle controlling composition is preferably applied to fabrics prior to ironing. A preferred way to deliver the wrinkle controlling composition to the fabrics is by spraying. The wrinkle controlling composition can also be delivered employing many of the through-the-dryer methods articulated above. Finally, in some embodiments, it is acceptable to deliver the wrinkle controlling composition through the iron concurrent with the ironing process. The iron should be set to a temperature appropriate for ironing the fabric. The wrinkle controlling compositions aid in "plasticizing" the fibers and thus reduce the time and effort involved in ironing wrinkles out of fabrics. In general, wrinkle controlling compositions should be used in a way similar to starch or water when starch or water are used as ironing aids. After ironing, the fabric should be placed in a configuration that will maintain its smoothness as discussed above.

Many household fabrics can be treated with the wrinkle controlling composition while these household fabrics are residing in their typical environment. For instance, shower curtains comprised of fabrics and window curtains can be treated while hanging on the rods, bed spreads, quilts, sheets, ruffles, and dusters can be treated while these are on the bed, table linens can be treated while on the table. Spraying is a preferred method for treating fabrics residing in their typical environment. In these cases, reasonable care should be taken to avoid staining the environment around the fabric. For instance, table linens should be sprayed very lightly to prevent water from soaking through to the table, if the table underneath comprises wood or any other material that will stain, warp, or otherwise become disfigured upon picking up water or components of the wrinkle controlling compositions. In many cases, spraying household fabrics in their natural environment can replace time consuming, costly, inconvenient, or undesirable processes. For instance, shower curtains are often dewrinkled by using the bathroom plumbing to generate a large quantity of steam. Spraying wrinkle controlling composition on the shower curtains eliminates the need to waste a large quantity of water producing steam, the potentially undesirable effects of steam on other elements of the bathroom (e.g., wall covers may peel), and the inconvenience of having to close the bathroom to use for a certain period of time. Spraying wrinkle controlling composition on curtains and bed clothes eliminates the often awkward and time consuming job of trying to iron large, irregular items; a process (e.g. ironing) that often results in accidentally generating even deeper more obvious and harder-to-remove wrinkles, as the user struggles to control both the large, irregularly shaped fabric and the iron. Thus, treating household fabrics as they hang in place with wrinkle controlling composition often minimizes frustration and struggle. It is especially desirable to dispense wrinkle removal compositions from a powered sprayer as disclosed above to further improve the performance and convenience.

Wrinkle controlling compositions allow a consumer the freedom to purchase a wider array of garments and fabrics e.g. garments and fabrics which are desirable but typically avoided during purchase decisions due to their tendency to wrinkle. Wrinkle controlling compositions change the care situation of these items from an impractical, time consuming, and frustrating process into a practical task; thus maximizing the pleasure inherent in owning such items by minimizing the tedium associated with taking care of them.

It is preferably to hang the garments to be treated with the wrinkle removal compositions using a swivel clothes hanger. The swivel clothes hanger has a frame that can be rotated around the stem of the hook. A garment hung on said swivel hanger can be oriented in many directions. This facilitates an even and thorough treatment of the garment with the wrinkle composition when using the spray to treat the garments. Additionally, the swivel hanger facilitates inspection and manipulation of the garment and so is generally useful when used together with wrinkle controlling compositions.

V. Test Methods

A. Patternator Test

The Patternator Test method is used to evaluate a spray pattern of a spray dispenser. The Patternator Test generates data to quantify a spray pattern in terms of volume of liquid per unit of surface area covered by the spray. A standard deviation is also calculated from this test method.

An apparatus used to perform the Patternator Test method is shown in FIG. 1. The Patternator Test is carried out according to the following method.

A wrinkle control composition is placed in a plastic bottle 10 with a spray head 12 attached thereto to form a spray dispenser 18. The spray head 12 of the plastic bottle 10 is placed in a vise-like clamp 14 and attached to the patternator apparatus 16.

The spray dispenser 18 is aimed towards a two-dimensional 17×17 tube array 20 of graduated 14 mL conical tubes 22 (289 tubes total) with a 1.50 cm diameter at the top of each tube 22 and 1 mL graduation marks on each tube 22. There are 10 tubes 22 per 15.2 cm length in both the horizontal and vertical direction on the tube array 20. The nozzle 24 of the spray dispenser 18 is positioned 6 inches (2.36 cm) from the tube array 20 and aimed toward the center of the tube array 20, such that when the wrinkle control composition is sprayed towards the tube array 20, the tubes 22 will collect the composition. The spray dispenser 18 is aimed at the tube array 20 such that the spray stream is perpendicular to the tube array 20 and the tube array 20 is at a 45° angle to a horizontal surface 26. Each tube 22 corresponds to a surface area element of about 1.77 $cm^2$.

An actuator 28 is used to trigger the spray dispenser 18 at a controlled pressure. The actuation pressure is chosen based on measuring the sprayer piston cylinder pressure developed as consumers used typical examples of spray dispensers. The actuation pressure is from about 40 to about 50 pounds per square inch (psi). The piston 30 driving the actuator 28 is powered by compressed air fed through a flexible tube 32 connected to the piston 30.

The spray dispenser 18 is triggered by the actuator 28 100 times and the composition dispensed from the 100 sprays is collected by the tubes 22 of the 17×17 tube array 20. After the liquid from 100 sprays is collected, each tube 22 is removed from the tube array 20 and the amount of liquid in each tube 22 is recorded. This data is inputted into a spreadsheet computer program (Microsoft Excel 2000™) which is used to calculate the volume of liquid per unit of surface area and the standard deviation thereof. The results of these data are plotted as a function of volume vs. surface area to create a three-dimensional graph.

B. Staining Test

The Staining Test is carried out by spraying a composition onto a hanging fabric from a selected spray dispenser with a distance of 6 inches between the nozzle of the spray dispenser and the surface of the fabric. The fabric used to assess staining comprises a medium dark color, like green or blue polycotton (Springmaid TREMODE combed broadcloth, polycotton fabric 65% polyester and 35% cotton, any medium dark color, e.g. a nonlimiting example is color# 99555 called kelly green). Each time a dispenser is tested with a wrinkle control composition, ten swatches are sprayed. The number of swatches with a visible stain are tabulated and the number of stains per ten swatches sprayed is reported.

C. Dry Time Test

The Dry Time Test is carried out under conditions where the relative humidity is 20–27 RH at a temperature of 71–73° F. as measured by an Omega CTH100 temperature/relative humidity chart recorder (from Omega Engineering). A composition is dispensed from a spray dispenser onto fabric (Springmaid TREMODE combed combed broadcloth, polycotton fabric 65% polyester and 35% cotton) at a distance of 6 inches between the nozzle of the sprayer and the fabric. The fabric is sprayed while it hangs on a suspending device designed to sit on a typical lab scale (e.g. Mettler PM4000; Mettler PM2000) as it suspends the drying fabric. The suspending device is a T-shaped metal stand that fabric can be clipped onto. The fabric is attached to the suspending device as it is sitting on the scale. After the fabric is attached to the suspending device on the scale, then sprayed as directed above. Immediately, the initial weight of the fabric is noted at time=0 minutes. The weight of the fabric is noted at time=2 minutes, 5 minute, and 10 minutes after spraying. The % change in weight from the initial value is plotted as a function of time. To generate the dry time, for each sprayer type, two sprayers are used and two replicates are done per sprayer. Therefore, for each sprayer, the dry time data is repeated four times. The data is averaged over the four runs for the plot.

The following are non-limiting examples of the present invention. All percentages, ratios, and parts herein, in the Specification, Examples, and Claims are by weight and are the normal approximations unless otherwise stated.

EXAMPLE I

The following are Examples of wrinkle controlling compositions of the present invention:

| Compound | 1 | 2 | 3 | 4 |
|---|---|---|---|---|
| Ethanol | 15% | — | 3% | 2% |
| Isopropanol | — | 12% | 2% | 1% |
| Perfume | 0–0.04% | 0–0.04% | 0–0.04% | 0–0.04% |
| Water | balance | balance | balance | balance |
| **Compound** | **5** | **6** | **7** | **8** |
| SH3772[1] | 0.2% | — | — | — |
| SH3748[1] | — | 0.3% | — | — |
| SH8700[1] | — | — | 0.3% | — |
| KF354[2] | — | — | — | 0.2% |
| hexylene glycol | 10% | — | — | — |
| dipropylene glycol | — | 5% | — | — |
| 3-methoxybutanol | — | — | 5% | — |
| ethanol | — | — | 5% | 10% |
| perfume | 0–0.02% | 0–0.02% | 0–0.02% | 0–0.02% |
| water | balance | balance | balance | balance |
| **Compound** | **9** | **10** | **11** | **12** |
| Silwet ® L7602[3] | 0.2 | 0.3 | 0.5 | 1.0% |
| Isopropanol | 5 | — | 2.5 | — |
| Hexylene glycol | — | 5 | — | 2.5% |
| Isoprene glycol | — | — | — | 2.5% |
| Hydroxypropyl-β—cyclodextrin | — | — | 0.5% | |
| methylated cyclodextrin | — | — | — | 0.75% |
| Perfume | 0–0.04 | 0–0.04% | 0–0.04% | 0–0.04% |
| Water | balance | balance | balance | balance |

-continued

| Compound | 13 | 14 | 15 | 16 |
|---|---|---|---|---|
| Freedom SCO–75[4] | 1.0% | 0.8% | 0.5% | 0.7% |
| EtOH | 8.0% | 5.0% | 5.0% | 3.0% |
| Stepanol WAC[5] | 0.5% | | 0.1% | |
| Neodol 25-9[6] | 0.5% | — | — | 1.0% |
| Neodol 23-3[7] | — | — | 1.0% | — |
| Perfume | 0–0.1% | 0–0.1% | 0–0.1% | 0–0.1% |
| Water | balance | balance | balance | balance |

| Compound | 17 | 18 | 19 | 20 |
|---|---|---|---|---|
| Dow Corning ® 190 Surfactant[8] | 0.01% | 0.1% | — | — |
| Ethanol | 20% | 10% | 10% | 20% |
| 3M Fluorad ® [9] | — | — | 0.01 | 0.1% |
| Perfume | 0–0.1% | 0–0.1% | 0–0.1% | 0–0.1% |
| Water | balance | balance | balance | balance |

| Compound | 21 | 22 | 23 | 24 |
|---|---|---|---|---|
| Dow Corning 190 Surfactant | 0.01% | 0.1% | — | — |
| Ethanol | 20% | 10% | 10% | 20% |
| 3M Fluorad | — | — | 0.01 | 0.1% |
| Hydroxypropyl-β-cyclodextrin | 0.5% | 1.0% | | |
| methylated cyclodextrin | — | — | 1.0! | 0.75% |
| Perfume | 0–0.1% | 0–0.1% | 0–0.1% | 0–0.1% |
| Water | balance | balance | balance | balance |

| Compound | 25 | 26 | 27 | 28 |
|---|---|---|---|---|
| EtOH | 8.0% | 5.0% | 5.0% | 3.0% |
| Stepanol WAC[5] | 0.5% | 0.7% | 0.1% | |
| Neodol 25-9[6] | 0.5% | — | — | 1.0% |
| Neodol 23-3[7] | — | — | 1.0% | — |
| Perfume | 0–0.1% | 0–0.1% | 0–0.1% | 0–0.1% |
| Water | balance | balance | balance | balance |

| Compound | 29 | 30 | 31 | 32 |
|---|---|---|---|---|
| Freedom SCO–75 | 1.0% | 0.8% | 0.5% | 0.7% |
| Perfume | 0–0.1% | 0–0.1% | 0–0.1% | 0–0.1% |
| Water | balance | balance | balance | balance |

| Compound | 33 | 34 | 35 | 36 | 37 | 38 | 39 | 40 |
|---|---|---|---|---|---|---|---|---|
| Neodol ® 23-3 | 0.5 | 0.5 | 0.5 | 0.5 | — | — | — | — |
| Neodol ® 23-2 | | | | | 0.5 | 0.5 | 0.25 | 0.5 |
| Silwet ® L77 | — | — | 0.75 | — | 1.75 | — | — | — |
| Silwet ® L7280 | 2.0 | — | 0.75 | 0.5 | — | 1.75 | 1.0 | — |
| Silwet ® L7608 | — | 2.0 | — | 1.0 | — | — | — | 1.0 |
| Silwet ® L7600 | — | — | — | — | 0.25 | — | — | 0.25 |
| Silwet ® L7607 | — | — | — | — | — | 0.25 | 0.25 | — |
| Stepanol ® WAC[(6)] | 0.1 | 0.2 | 0.1 | 0.2 | 0.1 | 0.2 | 0.2 | 0.1 |
| Perfume | 0.02 | 0.03 | 0.02 | 0.03 | 0.03 | 0.025 | 0.01 | 0.015 |
| Tris | 0.61 | 0.61 | 0.61 | 0.61 | 0.61 | 0.61 | 0.61 | 0.61 |
| HCl | 0.02–0.12 | 0.02–0.12 | 0.02–0.12 | 0.02–0.12 | 0.02–0.12 | 0.02–0.12 | 0.02–0.12 | 0.02–0.12 |
| Distilled water | Bal. | Bal. | Bal. | Bal. | Bal. | Bal. | Bal. | Bal. |

| Compound | 41 | 42 | 43 | 44 | 45 | 46 |
|---|---|---|---|---|---|---|
| Dow Coming Q2-5211[(5)] | 2.0 | 2.0 | 1.0 | 1.0 | 1.0 | 1.0 |
| C45 AS[(4)] | 0.1 | 0.1 | 0.1 | 0.1 | 0.1 | 0.1 |
| Perfume | 0.005–0.06 | 0.005–0.06 | 0.005–0.06 | 0.005–0.06 | 0.005–0.06 | 0.005–0.06 |
| Tris | 1.22 | 1.22 | 1.22 | 1.22 | 1.22 | 1.22 |
| HCl | 0.04–0.24 | 0.04–0.24 | 0.04–0.24 | 0.04–0.24 | 0.04–0.24 | 0.04–0.24 |
| Distilled water | Bal. | Bal. | Bal. | Bal. | Bal. | Bal. |

-continued

| Compound | 47 | 48 | 49 | 50 | 51 | 52 | 53 | 54 |
|---|---|---|---|---|---|---|---|---|
| SH3772 | 0.5 | — | — | — | — | — | — | — |
| SH3748 | — | 1.0 | — | — | — | — | — | — |
| SH8700 | — | — | 1.5 | — | — | — | — | — |
| KF354 | — | — | — | 0.75 | — | — | | — |
| EtOH | 13 | 13 | 13 | 13 | 4 | 1.0 | 0.5 | 1.0 |
| propylene glycol | 4 | 4 | 4 | 4 | — | — | — | — |
| isopropyl alcohol | — | — | — | — | 4 | — | — | 0.5 |
| Neodol ® 25-12 | — | — | — | — | — | 0.1 | — | 0.3 |
| Neodol ® 45-7 | — | — | — | — | — | — | 0.5 | — |
| Water | Bal. | Bal. | Bal. | Bal. | Bal. | Bal. | Bal. | Bal. |

[1]Silicone-glycol copolymer from Toray Dow Corning Silicone Co., Ltd.
[2]Silicone-glycol copolymer from Shin-Etsu Chemical Co. Ltd.
[3]Silicone-glycol copolymer from Crompton.
[4]Sulfated castor oil available from Freedom Chemical Co. owned by BF Goodrich
[5]Sodium lauryl sulfate available from stepanol
[6]alkyl ethoxylate with 12–15 carbons and an average of 9 ethoxylates available from Shell.
[7]alkyl ethoxylate with 12–13 carbons and an average of 3 ethoxylates available from Shell
[8]Silicone glycol copolymer from Dow Corning.
[9]Nonionic fluorinated alkyl ester available from 3M.

EXAMPLE II

This Example demonstrates the differences among different spray dispensers in regard to spray pattern distribution. A variety of spray dispeners are evaluated according to the Patternator Test method described hereinbefore in Section V. A. supra.

The following wrinkle controlling composition is used to evaluate the spray pattern of the spray dispensers to be tested:

| Component | Weight of Active |
|---|---|
| Fluid 245[1] | 2.5% |
| Silwet L77[2] | 2.0% |
| Neodol 23-3[3] | 0.5% |
| Stepanol WAC[4] | 0.1% |
| Perfume | 0–0.04% |
| Preservative | 0–0.1%3 |
| Tris (hydroxy methyl)amino mentane | 0.57% |
| HCl | 0.05% |
| pH | 8–9 |
| Water | balance |

[1]Decamethylcylcopentasiloxane available from Dow Corning.
[2]Pendant copolymer of polydimethyl siloxane and ethylenoxide with average molecular weight of 600, available from CK-Witco.
[3]Alkyl ethoxylate surfactant with 12–13 carbons and an average of three ethoxylate groups available from Shell.
[4]Sodium lauryl sulfate available from Stepan.

A variety of spray dispensers are tested according to the Patternator Test. The results of the test are given in terms of a spray pattern having a volume per unit of surface area and standard deviation thereof, and are shown in the following table:

| Sprayer | Volume/Surface Area | Standard Deviation in Volume Surface |
|---|---|---|
| Mixor[1] 1.00 cc × 0.025 × 0.030 | 0.087 ml/inch$^2$ (0.014 ml/cm$^2$) | 0.080 ml/inch$^2$ (0.0124 ml/cm$^2$) |
| Mixor[2] 1.00 cc MP | 0.076 ml/inch$^2$ (0.012 ml/cm$^2$) | 0.056 ml/inch$^2$ (0.0087 ml/cm$^2$) |
| Calmar TS-800-2G[3] | 0.069 ml/inch$^2$ (0.011 ml/cm$^2$) | 0.065 ml/inch$^2$ (0.010 ml/cm$^2$) |

-continued

| Sprayer | Volume/Surface Area | Standard Deviation in Volume Surface |
|---|---|---|
| T-8500 1 cc Dow Shroud[4] | 0.020 ml/inch$^2$ (0.0031 ml/cm$^2$) | 0.021 ml/inch$^2$ (0.0033 ml/cm$^2$) |
| Calmar TS-800-2E[5] | 0.023 ml/inch$^2$ (0.0036 ml/cm$^2$) | 0.016 ml/inch$^2$ 0.0025 ml/cm$^2$) |
| Calmar TS-800-2E RO[6] | 0.017 ml/inch$^2$ (0.0026 ml/cm$^2$) | 0.009 ml/inch$^2$ (0.0014 ml/cm$^2$) |
| Calmar TS-800-2[7] | 0.012 ml/inch$^2$ (0.0019 ml/cm$^2$) | 0.007 ml/inch$^2$ (0.0011 ml/cm$^2$) |

[1]Available from Calmar, land length is 0.030, diameter of orifice in the nozzle is 0.025, the nozzle part number is 1PD04105.
[2]Available from Calmar, land length is 0.020, diameter of the orifice in the nozzle is 0.025, the nozzle part number is 1PD04105.
[3]Available from Calmar, land length is 0.060, diameter of the orifice is 0.025, the nozzle part number is 7PD04105.
[4]Available from CSI, land length is 0.031, diameter of the orifice is 0.025, and the nozzle part number is 8501.
[5]Available from Calmar, land length is 0.060, diameter of the orifice is 0.025, and the nozzle part number is 7PD04105.
[6]Available from Calmar, specifications equivalent to those in reference 5.
[7]Available from Calmar, land length is 0.040, diameter of the orifice is 0.030, and the nozzle part number is 8PD04105.

The graphs presented in FIGS. 2–13 arc generated using the results of the Patternator Test method for the spray dispensers detailed above. These three dimensioiul plots show the spray pattern distribution oF the given spray dispenser. In the graphs presented in FIGS. 2–13, the columns and rows represent the tube array 20 of FIG. 1 onto which composition is dispensed from the spray dispenser 18. The legend represents the volume of product in milliliters.

From the graphs presented in FIGS. 2–13, it can be seen that unacceptable sprayers generally have 'hot spots' where a large volume of liquid is being distributed in a small unit of surface area.

EXAMPLE III

This Example illustrates the need to utilize a spray dispenser which provides a spray pattern as desired in the present invention in order to minimize the potential staining of fabrics treated with a wrinkle controlling composition.

A variety of spray dispensers are evaluated using the Staining Test as described in Section V.B. supra. A wrinkle controlling composition consisting essentially of water is used to evaluate the affect the spray dispenser has on the potential to stain fabrics treated with the wrinkle controlling composition:

The wrinkle controlling composition is sprayed using a given sprayer according to the Staining Test method. The results of the Staining Test are shown in the following table:

| Sprayer | # Swatches Sprayed | # Swatches Stained |
|---|---|---|
| 1.0 cc Mixor | 10 | 10 |
| Calmar TS-800-2G | 10 | 10 |
| Indesco | 10 | 0 |
| Calmar TS-800-2E | 10 | 0 |

EXAMPLE IV

This Example demonstrates the affect a spray dispenser having a particular spray pattern has on the amount of time required for a fabric to dry which has been treated with a wrinkle controlling composition.

In this Example, a variety of spray dispensers are tested according to the Dry Time Test method disclosed in Section V.C. supra. A wrinkle controlling composition consisting essentially of water is used to evaluate the spray dispensers according to the Dry Time Test.

Figure 14:
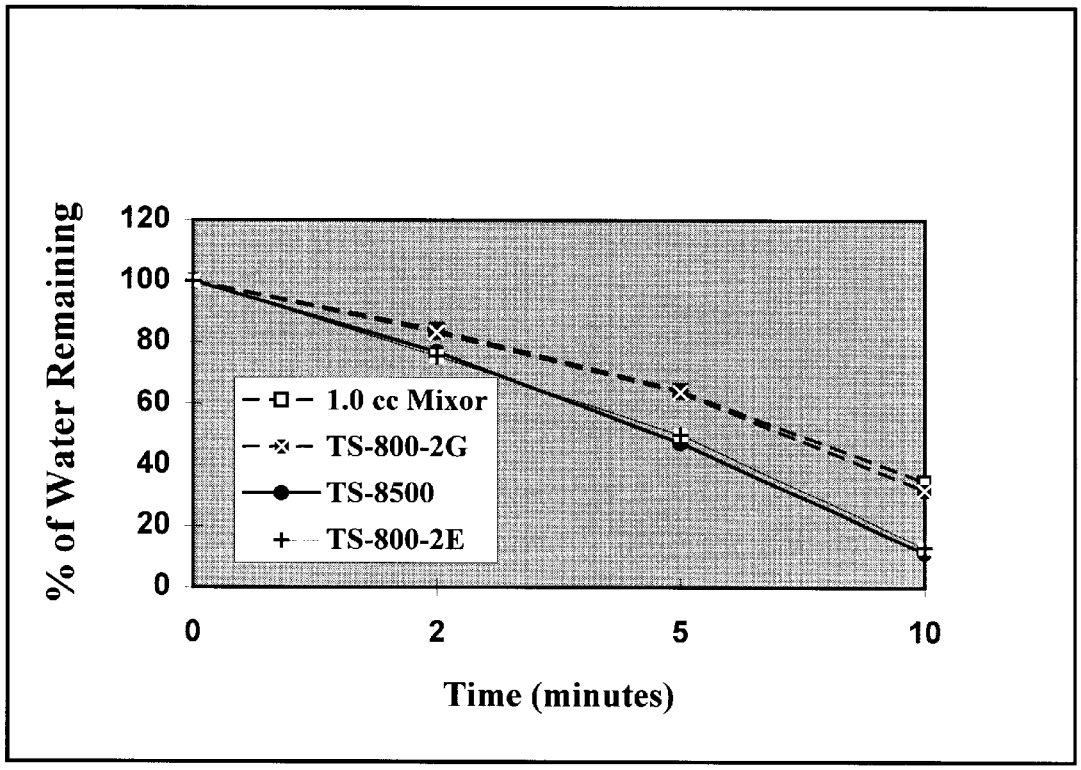
FIG. 14 is graph illustrating the percent of water remaining as a function of drying time based on water being sprayed from four different sprayers.

The data from the Dry Time Test method is collected for the given spray dispensers and plotted as a function of time vs. percent water remaining. This data is represented in the graph of FIG. 14.

Drying time, even with water alone, is significantly reduced by using a sprayer with an acceptable spray pattern of the present invention.

What is claimed is:

1. A method of controlling wrinkles in fabric comprising the step of dispensing an effective amount of a wrinkle controlling composition onto said fabric using a spray dispenser, wherein said wrinkle controlling composition comprises:

(a) an aqueous base comprising water;

(b) optionally, an effective amount to reduce surface tension of surfactant;

(c) optionally, a solvent and/or plasticizer;

(d) optionally, an effective amount of a fabric care polysaccharide to enhance wrinkle control;

(e) optionally, an effective amount to absorb malodor of an odor control agent;

(f) optionally, an effective amount of a buffering system sufficient to provide an effective amount of buffering capacity.

(g) optionally, an effective amount to provide olfactory effects of perfume;

(h) optionally, an effective amount to kill, or reduce the growth of microbes, of antimicrobial active;

(i) optionally, an effective amount to provide improved antimicrobial action of aminocarboxylate chelator;

(j) optionally, an effective amount of solubilized, water-soluble, antimicrobial preservative to inhibit or regulate microbial growth;

(k) optionally, an effective amount of a whiteness preservative to mitigate the yellowing of treated fabrics; and (l) optionally, adjunct ingredients selected from the group consisting of odor-controlling materials, chelating agents, viscosity control agents, antistatic agents, insect and moth repelling agents, colorants, anti-clogging agents, agents for pH adjustment, buffering agents, and mixtures thereof;

and wherein said spray dispenser provides a spray pattern having a volume per unit of surface area of less than about 0.011 ml/cm$^2$.

2. The method of claim 1 wherein said spray dispenser provides a spray pattern having a volume per unit of surface area of less than about 0.0054 ml/cm$^2$.

3. The method of claim 2 wherein said spray dispenser provides a spray pattern having a volume per unit of surface area of less than about 0.0031 ml/cm$^2$.

4. The method of claim 1 wherein said spray pattern has a standard deviation of said volume per unit of surface area of less than about 0.0087 ml/cm$^2$.

5. The method of claim 4 wherein said spray pattern has a standard deviation of said volume per unit of surface area of less than about 0.0047 ml/cm$^2$.

6. The method of claim 5 wherein said spray pattern has a standard deviation of said volume per unit of surface area of less than about 0.0031 ml/cm$^2$.

7. The method of claim 1 wherein said wrinkle controlling composition has a Trouton ratio of less than about 10,000.

8. The method of claim 7 wherein said Trouton ratio is less than about 1,000.

9. The method of claim 8 wherein said Trouton ratio is less than about 100.

10. The method of claim 1 wherein said wrinkle controlling composition further comprises from about 0.0001% to about 20% of a surfactant selected from the group consisting of silicone surfactant, nonionic surfactant, ionic surfactant, zwitterionic surfactant, fluorine-based surfactant, and mixtures thereof.

11. The method of claim 10 wherein said surfactant is a silicone surfactant having the formula:

$$R^1—CH_3)_2SiO—[(CH_3)_2SiO]_a—[(CH_3)(R^1)SiO]_b—Si(CH_3)_2—R^1$$

wherein a+b are from about 1 to about 50, and each $R^1$ is the same or different and is selected from the group consisting of a methyl group and a poly(ethyleneoxide/propyleneoxide) copolymer group having the general formula:

$$—(CH_2)_nO(C_2H_4O)_c(C_3H_6O)_dR^2$$

wherein at least one $R^1$ is a poly(ethyleneoxy/propyleneoxy) copolymer group, and wherein n is 3 or 4; total c (for all polyalkyleneoxy side groups) has a value of from 1 to about 100; total c+d has a value of from about 5 to about 150, and each $R^2$ is the same or different and is selected from the group consisting of hydrogen, an alkyl having 1 to 4 carbon atoms, and an acetyl group.

12. The method of claim 11 wherein said silicone surfactant is at a level of at least about 0.01% by weight of said wrinkle controlling composition.

13. The method of claim 10 wherein said surfactant is a fluorine-based surfactant selected from the group consisting of fluorinated alkyl polyoxyalkylenes, fluorinated alkyl esters, and mixtures thereof.

14. The method of claim 10, wherein said surfactanit is selected from the group consisting of sulfated vegetable oil, sulfated castor oil, sulfated canola oil, and mixtures thereof.

15. The method of claim 1, wherein the composition comprises a solvent present at a level above about 15%.

16. The method of claim 1, wherein the composition comprises a solvent present at a level below about 15%.

17. The method of claim 1, wherein the composition comprises a fabric care polysaccharide selected from the group consisting of primary fabric care polysaccharides, adjunct fabric care oligosacchrides, starch, and mixtures thereof.

18. The method of claim 17, wherein the composition comprises a starch derived from a material selected from the group consisting of corn, wheat, rice, grain sorghum, waxy grain sorghum, waxy maize, tapioca, modified starches, and mixtures thereof.

19. The method of claim 18, wherein the starch comprises a degraded starch produced by acidic, oxidative, or enzymatic depolymerization or a modified starch produced by alkoxylation of the starch.

20. The method of claim 1 wherein the composition comprised a malodor control agent selected from the group consisting of cyclodextrin, polyols, metal salts, souble carbonate and/or bicarbonate salts, enzymes, zeolites, activated carbons, and mixtures thereof.

21. The method of claim 1, wherein the buffer system is selected from the group consisting of:

(i) tris(hydroxymethyl)aminomethane and hydrochloric acid;

(ii) borax and hydrochloric acid;

(iii) diethanolamine and hydrochloric acid;

(iv) sodium borate and sodium hydroxide;

(v) sodium bicarbonate and sodium hydroxide;

(vi) sodium hydrogen phosphate and sodium hydroxide;

(vii) sodium carbonate and sodium bicarbonate;

(viii) boric acid and sodium hydroxide;

(ix) glycine and sodium hydroxide; and (x) potassium chloride and sodium hydroxide; and (xi) mixtures thereof.

22. The method of claim 1, wherein said buffering system has a buffering capacity of at least about 0.01.

23. The method of claim 1, wherein the said buffering system provides stability to pH drift for at least about 3 months.

24. The method of claim 1, wherein the composition has a whiteness preservative selected from the group consisting of-metal chelating agents, brighteners, bluing agents, ultraviolet absorbers, oxidative stabilizers, and mixtures thereof.

25. The method of claim 1, wherein fabrics are air-dried following treatment with the composition.

26. The method of claim 1, wherein fabrics are heated following treatement with the composition.

27. The method of claim 26, wherein fabrics are heated using a clothes dryer.

28. An article of manufacture for controlling wrinkles on fabric comprising:

(a) a wrinkle controlling composition comprising an aqueous base comprising water;

(b) a container for the wrinkle controlling composition; and (c) a spray dispenser for dispensing the composition on fabric, wherein said spray dispenser provides a spray pattern having a volume per unit of surface area of less than about 0.011 ml/cm$^2$.

29. The article of claim 28 wherein said spray dispenser provides a spray pattern having a volume per unit of surface area of less than about 0.0054 ml/cm$^2$.

30. The article of claim 28 wherein said spray dispenser provides a spray pattern having a volume per unit of surface area of less than about 0.0031 ml/cm$^2$.

31. The article of claim 28 wherein said spray pattern has a standard deviation of said volume per unit of surface area of less than about 0.0087 ml/cm$^2$.

32. The article of claim 28 wherein said spray pattern has a standard deviation of said volume per unit of surface area of less than about 0.0047 ml/cm$^2$.

33. The article of claim 28 wherein said spray pattern has a standard deviation of said volume per unit of surface area of less than about 0.0031 ml/cm$^2$.

34. The article of claim 28 wherein said wrinkle controlling composition has a Trouton ratio of less than about 10,000.

35. The article of claim 34 wherein said Trouton ratio is less than about 1,000.

36. The article of claim 34 wherein said Trouton ratio is less than about 100.

37. The article of claim 28 wherein said spray dispenser is selected from the group consisting of manually operated sprayers, non-manually operated sprayers, trigger sprayers, pre-compression sprayer, and pump sprayers.

38. The article of claim 28 wherein said spray dispenser is powered by electricity.

39. The article of claim 28, further comprising a set of instructions in association with said spray dispenser that comprises an instruction to dispense said aqueous dispersion composition from said spray dispenser onto said fabric and smooth said fabric.

40. The article of claim 39 wherein said instructions comprise an instruction to employ said article during travel.

41. The article of claim 39, wherein said instructions comprise an instruction to iron the fabric following treatment with the said composition.

* * * * *